US010267222B2

(12) United States Patent
McConville et al.

(10) Patent No.: US 10,267,222 B2
(45) **Date of Patent: *Apr. 23, 2019**

(54) METHOD FOR CONTROLLING TRANSITIONS IN A VARIABLE DISPLACEMENT ENGINE

(71) Applicant: Ford Global Technologies, LLC, Dearborn, MI (US)

(72) Inventors: Gregory Patrick McConville, Ann Arbor, MI (US); Brad Alan Boyer, Canton, MI (US); James Douglas Ervin, Novi, MI (US); Kim Hwe Ku, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 36 days.

This patent is subject to a terminal disclaimer.

(21) Appl. No.: 15/603,059

(22) Filed: May 23, 2017

(65) Prior Publication Data

US 2017/0260898 A1 Sep. 14, 2017

Related U.S. Application Data

(63) Continuation of application No. 14/512,902, filed on Oct. 13, 2014, now Pat. No. 9,657,637.

(51) Int. Cl.

| | |
|---|---|
| ***F02D 17/02*** | (2006.01) |
| ***F02B 75/02*** | (2006.01) |
| ***F02D 37/02*** | (2006.01) |
| ***F02D 41/30*** | (2006.01) |
| ***F02D 13/06*** | (2006.01) |
| ***F02D 41/00*** | (2006.01) |

(52) U.S. Cl.

CPC ..... *F02B 75/02* (2013.01); *F02D 13/06* (2013.01); *F02D 37/02* (2013.01); *F02D 41/0087* (2013.01); *F02D 41/307* (2013.01); *F02D 41/3064* (2013.01); *F02D 17/02* (2013.01); *F02D 2250/21* (2013.01)

(58) Field of Classification Search

CPC ..... F02D 13/06; F02D 17/02; F02D 41/0087; F02D 41/3064; F02D 41/307

USPC ..... 123/198 F, 481

See application file for complete search history.

(56) References Cited

U.S. PATENT DOCUMENTS

| | | | |
|---|---|---|---|
| 5,758,616 | A | 6/1998 | Motose |
| 6,244,242 | B1 | 6/2001 | Grizzle et al. |

(Continued)

FOREIGN PATENT DOCUMENTS

| | | | |
|---|---|---|---|
| CN | 103185062 | A | 7/2013 |
| WO | 2013060625 | A1 | 5/2013 |

OTHER PUBLICATIONS

Flierl, R. et al., "Turbocharged Three-cylinder Engine with Activation of a Cylinder," MTZ Motortechnische Zeitschrift, vol. 75, No. 6, Jun. 2014, Available Online Apr. 25, 2014, 6 pages.

*Primary Examiner* — Erick R Solis

(74) *Attorney, Agent, or Firm* — Julia Voutyras; McCoy Russell LLP

(57) ABSTRACT

Methods and systems are provided for controlling transitions between engine operating modes in a four-cylinder engine. One method includes transitioning engine operation between two-cylinder, three-cylinder, and four-cylinder modes wherein the transitioning includes a sequence of firing events such that successive firing events are separated by at least 120 crank angle degree intervals.

12 Claims, 26 Drawing Sheets

(56) References Cited

U.S. PATENT DOCUMENTS

| | | | | |
|---|---|---|---|---|
| 6,600,989 | B2 | 7/2003 | Sellnau et al. | |
| 6,874,463 | B1 | 4/2005 | Bolander et al. | |
| 7,059,997 | B2 | 6/2006 | Nishizawa et al. | |
| 7,571,707 | B2 | 8/2009 | Gibson et al. | |
| 7,751,963 | B2 | 7/2010 | Gecim et al. | |
| 7,891,332 | B2 | 2/2011 | Shin et al. | |
| 7,913,669 | B2 | 3/2011 | Luken et al. | |
| 8,015,960 | B2 * | 9/2011 | Watanabe | B60W 10/06 123/192.1 |
| 8,145,410 | B2 | 3/2012 | Berger et al. | |
| 8,176,891 | B2 | 5/2012 | Choi | |
| 8,210,148 | B2 | 7/2012 | Morgan et al. | |
| 8,347,849 | B2 | 1/2013 | Wermuth et al. | |
| 8,375,904 | B2 | 2/2013 | Gustafson | |
| 9,399,969 | B2 | 7/2016 | Boyer et al. | |
| 9,441,551 | B2 | 9/2016 | Boyer et al. | |
| 9,657,637 | B2 * | 5/2017 | McConville | F02D 41/0087 |
| 9,677,479 | B2 | 6/2017 | Boyer et al. | |
| 9,874,166 | B2 * | 1/2018 | Ervin | F02D 41/0087 |
| 2002/0148439 | A1 | 10/2002 | Kawasaki | |
| 2004/0011322 | A1 | 1/2004 | Gerhardt | |
| 2006/0196463 | A1 | 9/2006 | Pallett et al. | |
| 2008/0300773 | A1 | 12/2008 | Winstead | |
| 2009/0145381 | A1 | 6/2009 | Watanabe | |
| 2009/0248277 | A1 | 10/2009 | Shinagawa et al. | |
| 2009/0248278 | A1 | 10/2009 | Nakasaka | |
| 2009/0259380 | A1 | 10/2009 | Picron et al. | |
| 2015/0100221 | A1 | 4/2015 | Routledge et al. | |
| 2016/0102320 | A1 | 4/2016 | Brough et al. | |
| 2016/0201586 | A1 * | 7/2016 | Serrano | F02D 41/307 701/111 |
| 2018/0230919 | A1 * | 8/2018 | Nagashima | F02D 41/1498 |

* cited by examiner 2 cylinder firing order: 1-2-1-2-1-2

4 cylinder mode: 1-3-2-4-1-3-2-4 ⟶ 2 cylinder mode: 1-2-1-2-1-2

Cylinders 3 and 4 may be controlled by a single solenoid

METHOD FOR CONTROLLING TRANSITIONS IN A VARIABLE DISPLACEMENT ENGINE

CROSS REFERENCE TO RELATED APPLICATION

The present application is a continuation of U.S. patent application Ser. No. 14/512,902, entitled "METHOD FOR CONTROLLING TRANSITIONS IN A VARIABLE DISPLACEMENT ENGINE," filed on Oct. 13, 2014, now U.S. Pat. No. 9,657,637. The entire contents of the above-referenced application are hereby incorporated by reference in their entirety for all purposes.

FIELD

The present disclosure relates to controlling transitions between engine operating modes in a variable displacement engine.

BACKGROUND AND SUMMARY

Engines may be configured to operate with a variable number of active or deactivated cylinders to increase fuel economy, while optionally maintaining the overall exhaust mixture air-fuel ratio about stoichiometry. This operation may be referred to as VDE (variable displacement engine) operation. In some examples, a portion of an engine's cylinders may be disabled during selected conditions, where the selected conditions can be defined by parameters such as a speed/load window, as well as various other operating conditions including vehicle speed. A control system may disable selected cylinders through the control of a plurality of cylinder valve deactivators that affect the operation of the cylinder's intake and exhaust valves. By reducing displacement under low torque request situations, the engine is operated at a higher manifold pressure, reducing engine friction due to pumping, and resulting in reduced fuel consumption.

However, a potential issue with variable displacement engines may occur when transitioning between the various displacement modes, for example, when transitioning from a non-VDE (or full-cylinder) mode to a VDE (or reduced cylinder) mode, and vice-versa. As an example, a four cylinder engine that can be operated in three distinct operation modes including a full-cylinder mode, a three-cylinder mode, and a two-cylinder mode may be transitioned between the three modes in response to changes in engine loads. These transitions can significantly affect the manifold pressure, engine airflow, engine torque output, and engine power. In one example, these transitions may produce disturbances in engine torque and may increase noise, vibration, and harshness (NVH) of the engine.

The inventors herein have recognized the above issues and identified an approach to at least partially address these issues. In one example approach, a method comprises transitioning an engine with only four cylinders between two-cylinder, three-cylinder, and four-cylinder modes of operation, the transitioning including a sequence of at least two firing events, wherein the at least two firing events are successive and are separated by at least 120 crank angle degrees. In this way, operation of the four-cylinder engine may be transitioned smoothly between available modes.

In another example approach, a method comprises operating an engine in a two-cylinder mode by firing a first cylinder and a second cylinder 360 crank angle degrees apart, transitioning engine operation to a three-cylinder mode by activating a fourth cylinder and a third cylinder, deactivating the first cylinder, and firing the fourth cylinder 240 crank angle degrees after a firing event in the second cylinder. The third cylinder may be fired 240 crank angle degrees after firing the fourth cylinder to transition to three-cylinder mode.

As an example, a four-cylinder engine may be configured to operate in a two-cylinder VDE mode, a three-cylinder VDE mode, and a four-cylinder (or full-cylinder) mode. As such, three of the four cylinders may be deactivatable. The two-cylinder mode may include activating a first cylinder and a second cylinder while a third cylinder and a fourth cylinder are deactivated. Further, the first cylinder and the second cylinder may be fired at 360 crank angle degree intervals in the two-cylinder mode. The three-cylinder mode of engine operation may include deactivating the first cylinder, and activating the third cylinder and the fourth cylinder. Further, the second cylinder, the third cylinder and the fourth cylinder may be fired at evenly spaced 240 crank angle degree intervals from each other. Finally, the four-cylinder or non-VDE mode may include activating all cylinders and operating with uneven firing intervals. Herein, the first cylinder may be fired 120 crank angle degrees after a firing event in the fourth cylinder, the third cylinder may be fired 120 crank angle degrees after firing the first cylinder, the second cylinder may be fired 240 crank angle degrees after firing the third cylinder, and the fourth cylinder may be fired 240 crank angle (CA) degrees after firing the second cylinder.

Transitions between the two-cylinder mode, the three-cylinder mode, and the non-VDE mode may include activating and/or deactivating specific cylinders based on current and eventual engine operating modes. Further, the activation and/or deactivation of cylinders, as well as firing events in the activated and/or deactivated cylinders, may occur in a sequence with intervals that reduces torque disturbances.

In one example, the engine may be transitioned from two-cylinder mode to four-cylinder mode by activating the third cylinder and the fourth cylinder. A smoother transition may be achieved by activating the third cylinder earlier than the fourth cylinder and timing a transition sequence as follows: activation of the third cylinder followed by a firing event in the second cylinder, firing of the first cylinder 360 CA degrees after the firing event in the second cylinder, activation of the fourth cylinder, firing of the third cylinder 120 CA degrees after the firing event in the first cylinder, firing of the second cylinder 240 CA degrees after firing the third cylinder, and firing of the fourth cylinder 240 CA degrees after firing the second cylinder. Herein, the sequence of five successive firing events includes a firing interval of at least 120 CA degrees between at least two successive firing events.

In another example, engine operation may be transitioned from two-cylinder mode to three-cylinder mode by simultaneously activating the fourth cylinder and the third cylinder. Next, the first cylinder may be deactivated following a last firing event in the first cylinder. The second cylinder may be fired 360 CA degrees after the last firing event in the first cylinder, the fourth cylinder may be fired 240 CA degrees after firing the second cylinder, and the third cylinder may be fired 240 CA degrees after firing the fourth cylinder. Herein, the sequence of firing events in the transition may include successive firing events that occur at an interval of 240 CA degrees (at least 120 CA degrees or greater).

In this way, engine operation may be transitioned between three available modes to reduce torque disturbances. By scheduling transitions such that firing events during the transition phase occur at specific intervals, a smoother transition with reduced NVH may be attained. Fuel consumption may also be decreased by enabling timely transitions. Further, by reducing perceptible NVH, passenger comfort may be improved. Overall, engine operation and drivability may be enhanced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
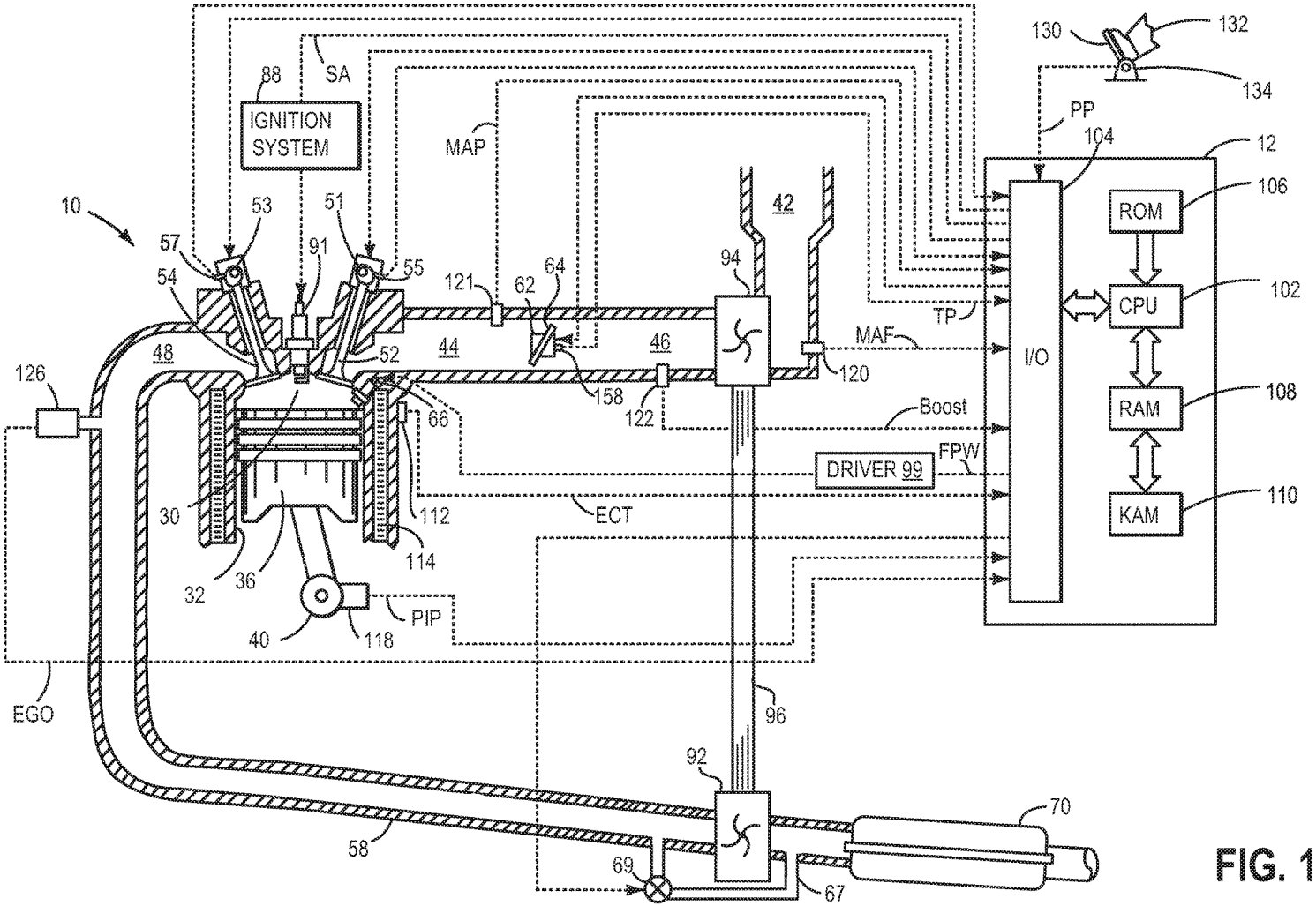
FIG. 1 shows a schematic diagram of an example cylinder within an engine.
Figure 2A:
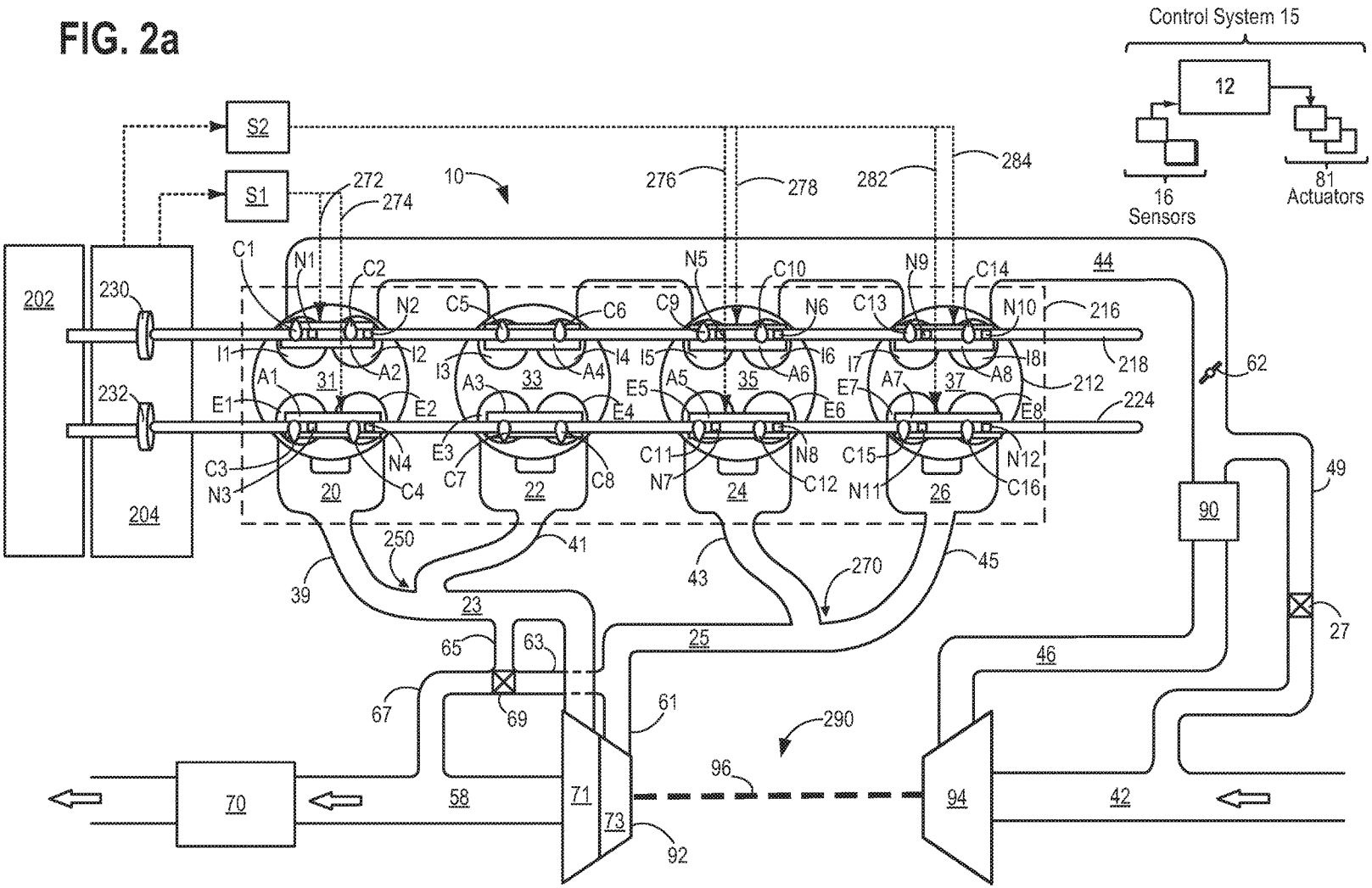
FIG. 2*a* portrays a schematic layout of a four-cylinder engine showing a common solenoid controlling valve operation in two of the four cylinders, according to an embodiment of the present disclosure.
Figure 2B:
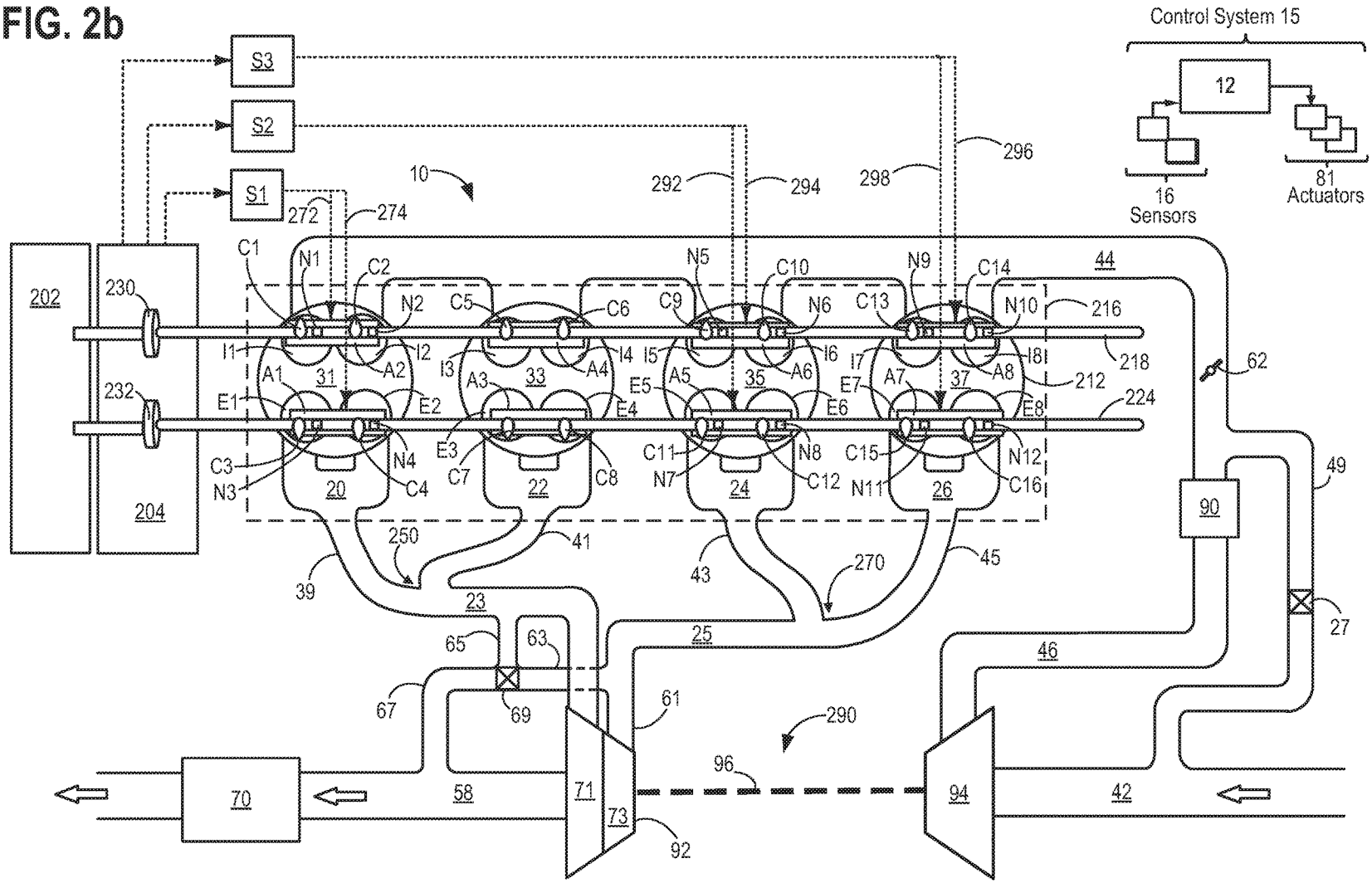
FIG. 2*b* illustrates a schematic layout of an engine similar to that of FIG. 2*a* depicting separate solenoids controlling three of the four cylinders, in accordance with an embodiment of the present disclosure.
Figure 5:
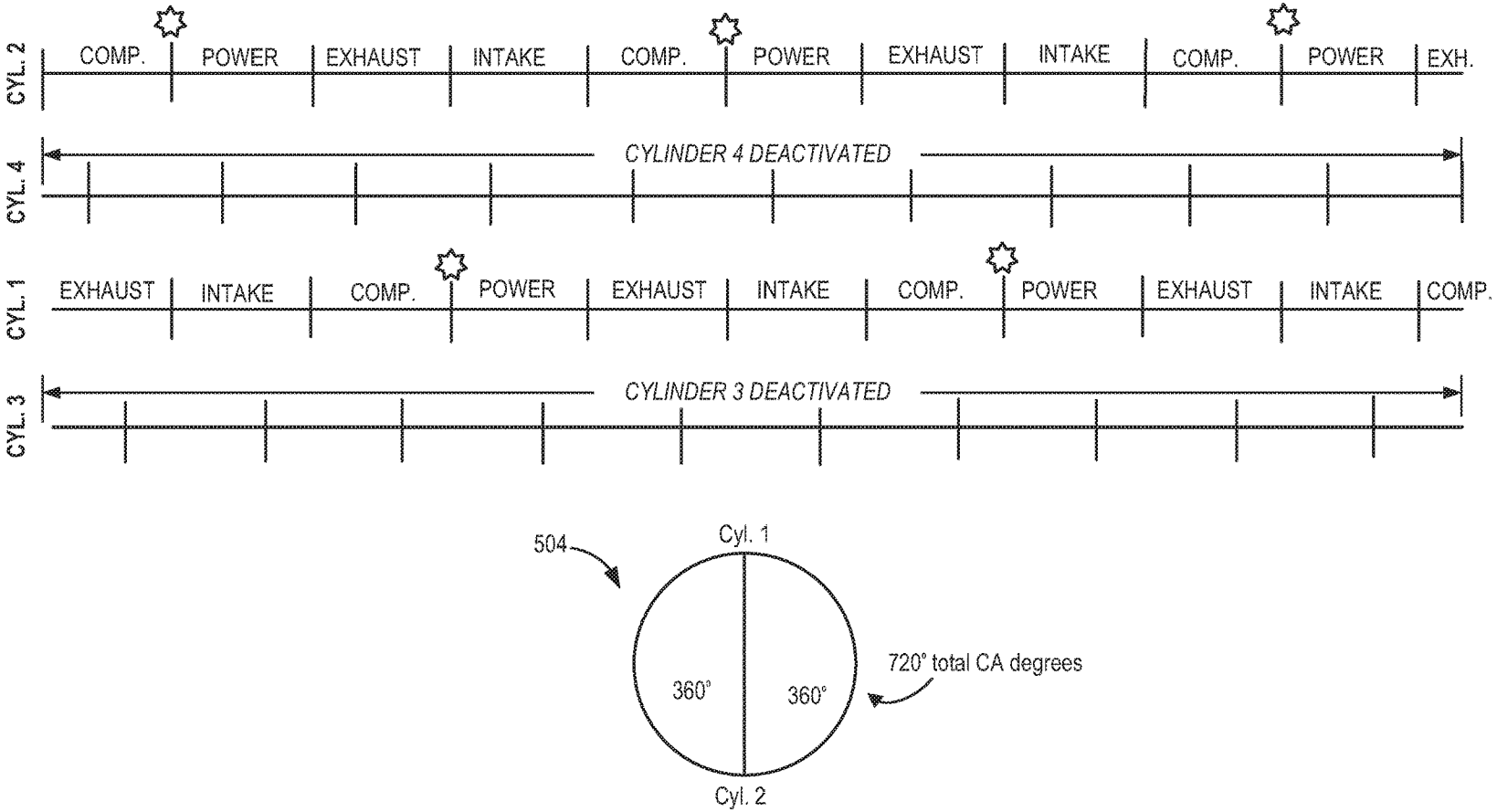
FIGS. 5-7 illustrate example spark timing diagrams in different engine operation modes.
Figure 6:
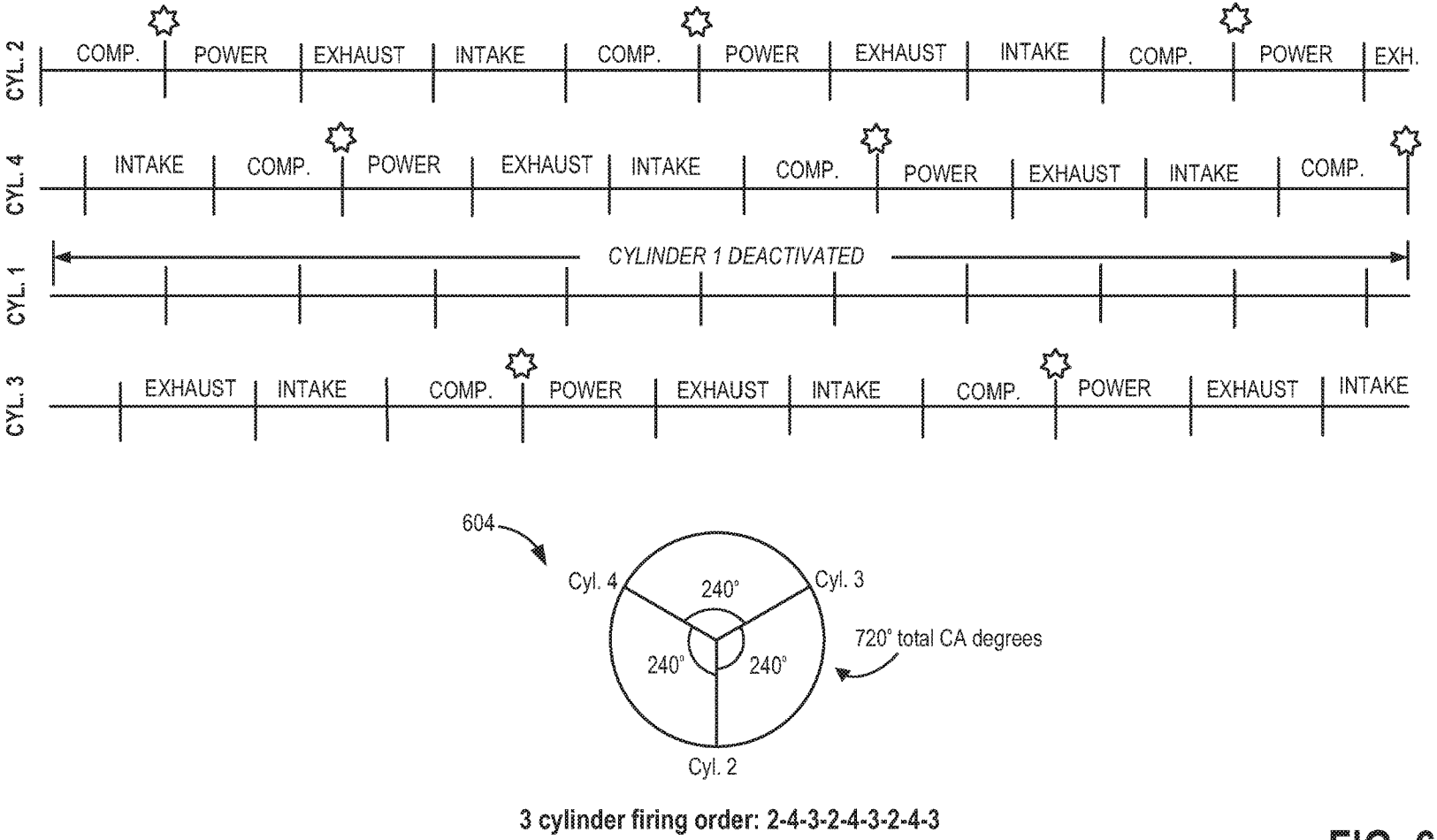
Figure 7:
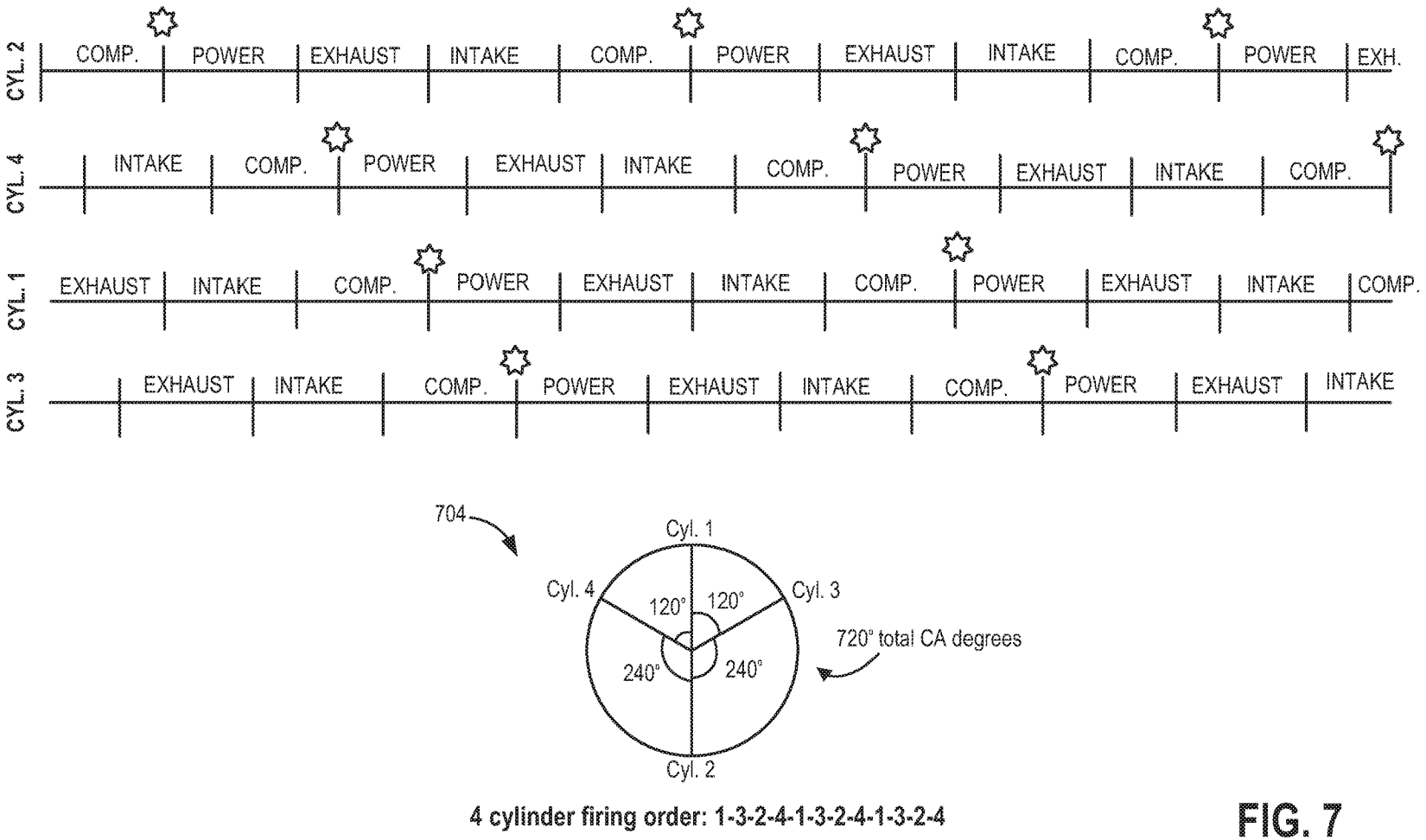
Figure 8:
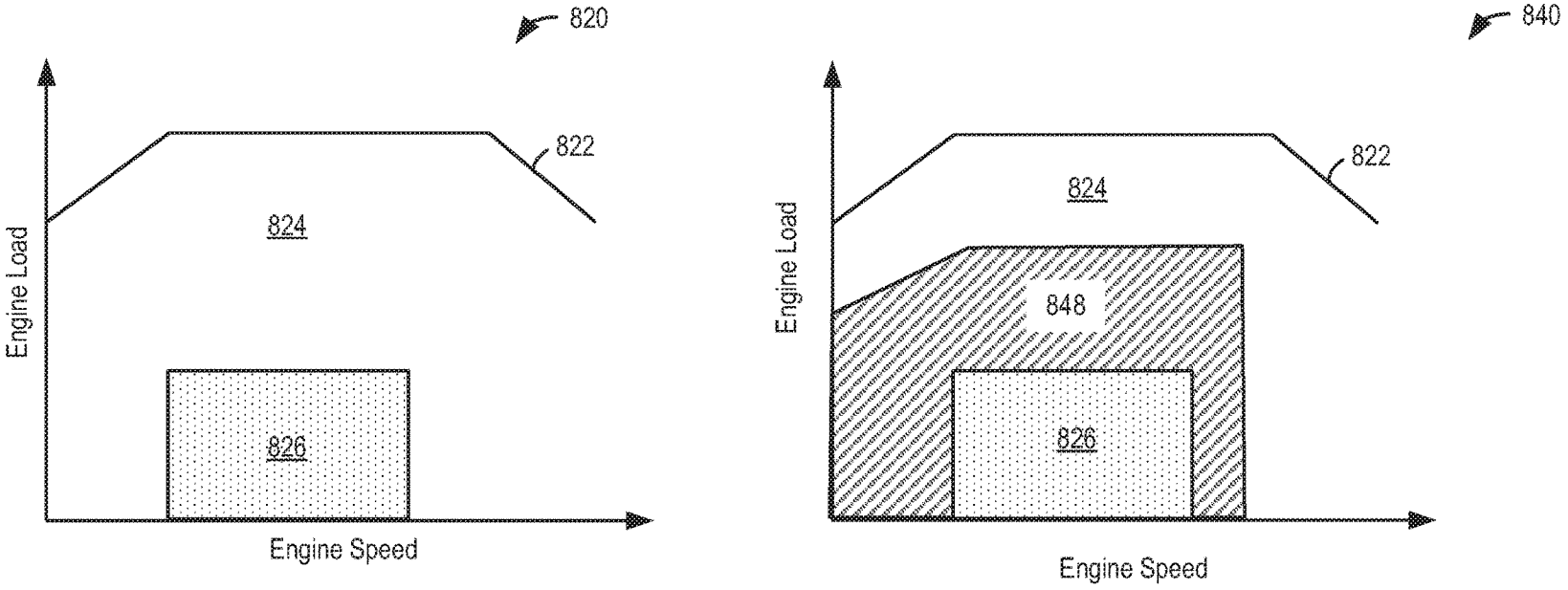
FIG. 8 depicts example plots illustrating the selection of engine operation mode based on engine speed and engine load.

The following description relates to controlling operation of an engine system, such as the engine system of FIG. 1. The engine system may be a four-cylinder engine capable of operation in variable displacement engine (VDE) mode coupled to a twin scroll turbocharger as shown in FIGS. 2*a* and 2*b*. The engine system may be supported in a vehicle by a plurality of active mounts (FIG. 4) that may be actuated to smoothen vibrations resulting from operating in and transitions between engine operating modes. Different modes of engine operation may be availed by activating or deactivating three of the four cylinders in the engine. Of the three deactivatable cylinders, two cylinders may be controlled either by a single, common solenoid (FIG. 2*a*) or by separate solenoids (FIG. 2*b*). The engine may include a crankshaft, such as the crankshaft of FIG. 3 that enables engine operation in a two-cylinder or three-cylinder mode, each with even firing, as shown in FIGS. 5 and 6, respectively. The engine may also be operated in a four-cylinder mode with uneven firing, as shown in FIG. 7. A controller may be configured to select an engine operating mode based on engine load and may transition between these modes (FIGS. 19 and 20) based on changes in engine load and speed (FIG. 8). During these transitions, a specific sequence of activation and/or deactivation of cylinders and firing events may be used (FIGS. 9-18). Further, each transition may include triggering the active mounts to adapt and adjust to ensuing powertrain vibrations (FIGS. 21-26).

Referring now to FIG. 1, it shows a schematic depiction of a spark ignition internal combustion engine 10. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion chamber 30 (also known as, cylinder 30) of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Combustion chamber 30 may receive intake air from intake manifold 44 via intake passage 42 and may exhaust combustion gases via exhaust manifold 48 and exhaust passage 58. Intake manifold 44 and exhaust manifold 48 can selectively communicate with combustion chamber 30 via respective intake valve 52 and exhaust valve 54. In some embodiments, combustion chamber 30 may include two or more intake valves and/or two or more exhaust valves.

In the example of FIG. 1, intake valve 52 and exhaust valve 54 may be controlled by cam actuation via respective cam actuation systems 51 and 53. Cam actuation systems 51 and 53 may each include one or more cams mounted on one or more camshafts (not shown in FIG. 1) and may utilize one or more of cam profile switching (CPS), variable cam timing (VCT), variable valve timing (VVT) and/or variable valve lift (VVL) systems that may be operated by controller 12 to vary valve operation. The angular position of intake and exhaust camshafts may be determined by position sensors 55 and 57, respectively. In alternate embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 12 via electronic driver 99. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake manifold 44 in a configuration that provides what is known as port injection of fuel into the intake port upstream of combustion chamber 30.

Ignition system 88 can provide an ignition spark to combustion chamber 30 via spark plug 91 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Engine 10 may further include a compression device such as a turbocharger or supercharger including at least a compressor 94 arranged along intake passage 42. For a turbocharger, compressor 94 may be at least partially driven by an exhaust turbine 92 (e.g. via a shaft) arranged along exhaust passage 58. Compressor 94 draws air from intake passage 42 to supply boost chamber 46. Exhaust gases spin exhaust turbine 92 which is coupled to compressor 94 via shaft 96. For a supercharger, compressor 94 may be at least partially driven by the engine and/or an electric machine, and may not include an exhaust turbine. Thus, the amount of compression provided to one or more cylinders of the engine via a turbocharger or supercharger may be varied by controller 12.

A wastegate 69 may be coupled across exhaust turbine 92 in a turbocharger. Specifically, wastegate 69 may be included in a bypass passage 67 coupled between an inlet and outlet of the exhaust turbine 92. By adjusting a position of wastegate 69, an amount of boost provided by the exhaust turbine may be controlled.

Intake manifold 44 is shown communicating with throttle 62 having a throttle plate 64. In this particular example, the position of throttle plate 64 may be varied by controller 12 via a signal provided to an electric motor or actuator (not shown in FIG. 1) included with throttle 62, a configuration that is commonly referred to as electronic throttle control (ETC). Throttle position may be varied by the electric motor via a shaft. Throttle 62 may control airflow from intake boost chamber 46 to intake manifold 44 and combustion chamber 30 (and other engine cylinders). The position of throttle plate 64 may be provided to controller 12 by throttle position signal TP from throttle position sensor 158.

Exhaust gas sensor 126 is shown coupled to exhaust manifold 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 58 downstream of exhaust gas sensor 126 and exhaust turbine 92. Device 70 may be a three way catalyst (TWC), NOx trap, various other emission control devices, or combinations thereof.

An exhaust gas recirculation (EGR) system (not shown) may be used to route a desired portion of exhaust gas from exhaust passage 58 to intake manifold 44. Alternatively, a portion of combustion gases may be retained in the combustion chambers, as internal EGR, by controlling the timing of exhaust and intake valves.

Controller 12 is shown in FIG. 1 as a conventional microcomputer including: microprocessor unit 102, input/output ports 104, read-only memory 106, random access memory 108, keep alive memory 110, and a conventional data bus. Controller 12 commands various actuators such as throttle plate 64, wastegate 69, fuel injector 66, and the like. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by vehicle operator 132; a measurement of engine manifold pressure (MAP) from pressure sensor 121 coupled to intake manifold 44; a measurement of boost pressure from boost pressure sensor 122 coupled to boost chamber 46; a profile ignition pickup signal (PIP) from Hall effect sensor 118 (or other type) coupled to crankshaft 40; a measurement of air mass entering the engine from mass airflow sensor 120; and a measurement of throttle position from sensor 158. Barometric pressure may also be sensed (sensor not shown) for processing by controller 12. In a preferred aspect of the present description, crankshaft or Hall effect sensor 118 which may be used as an engine speed sensor, may produce a predetermined number of equally spaced pulses for every revolution of the crankshaft from which engine speed (RPM) can be determined. Such pulses may be relayed to controller 12 as a profile ignition pickup signal (PIP) as mentioned above.

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time.

During operation, each cylinder within engine 10 typically undergoes a four stroke cycle: the cycle includes the intake stroke, compression stroke, expansion or power stroke, and exhaust stroke. During the intake stroke, generally, the exhaust valve 54 closes and intake valve 52 opens. Air is introduced into cylinder 30 via intake manifold 44, and piston 36 moves to the bottom of the cylinder so as to increase the volume within cylinder 30. The position at which piston 36 is near the bottom of the cylinder and at the end of its stroke (e.g. when cylinder 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within cylinder 30. The point at which piston 36 is at the end of its stroke and closest to the cylinder head (e.g. when cylinder 30 is at its smallest volume) is typically referred to by those of skill in the art as top dead center (TDC). In a process hereinafter referred to as injection, fuel is introduced into the combustion chamber. In one example, fuel may be introduced into cylinder 30 during the intake stroke. In another example, fuel may be injected into combustion chamber 30 during a first half of the compression stroke. In a process hereinafter referred to as ignition, the injected fuel is ignited by known ignition devices such as spark plug 91, resulting in combustion. Additionally or alternatively, compression may be used to ignite the air/fuel mixture. During the power stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, early intake valve closing, or various other examples.

Turning now to FIG. 2*a*, it shows a schematic diagram of multi-cylinder internal combustion engine, which may be engine 10 of FIG. 1. The embodiment shown in FIG. 2*a* includes a variable cam timing (VCT) system 202, a cam profile switching (CPS) system 204, a turbocharger 290, and emission control device 70. It will be appreciated that engine system components introduced in FIG. 1 are numbered similarly and not reintroduced.

Engine 10 may include a plurality of combustion chambers (i.e., cylinders) 212 which may be capped on the top by cylinder head 216. In the example shown in FIG. 2*a*, engine 10 includes four combustion chambers: 31, 33, 35, and 37. It will be appreciated that the cylinders may share a single engine block (not shown) and a crankcase (not shown).

As described earlier in reference to FIG. 1, each combustion chamber may receive intake air from intake manifold 44 via intake passage 42. Intake manifold 44 may be coupled to the combustion chambers via intake ports. Each intake port may supply air and/or fuel to the cylinder it is coupled to for combustion. Each intake port can selectively communicate with the cylinder via one or more intake valves. Cylinders 31, 33, 35, and 37 are shown in FIG. 2*a* with two intake valves each. For example, cylinder 31 has two intake valves I1 and I2, cylinder 33 has two intake valves I3 and I4, cylinder 35 has two intake valves I5 and I6, and cylinder 37 has two intake valves I7 and I8.

The four cylinders 31, 33, 35, and 37 are arranged in an inline-4 configuration where cylinders 31 and 37 are positioned as outer cylinders, and cylinders 33 and 35 are inner cylinders. In other words, cylinders 33 and 35 are arranged adjacent to each other and between cylinders 31 and 37 on the engine block. Herein, outer cylinders 31 and 37 may be described as flanking inner cylinders 33 and 35. While engine 10 is depicted as an inline four engine with four cylinders, it will be appreciated that other embodiments may include a different number of cylinders.

Each combustion chamber may exhaust combustion gases via one or more exhaust valves into exhaust ports coupled thereto. Cylinders 31, 33, 35, and 37 are shown in FIG. 2*a* with two exhaust valves each for exhausting combustion gases. For example, cylinder 31 has two exhaust valves E1 and E2, cylinder 33 has two exhaust valves E3 and E4, cylinder 35 has two exhaust valves E5 and E6, and cylinder 37 has two exhaust valves E7 and E8.

Each cylinder may be coupled to a respective exhaust port for exhausting combustion gases. In the example of FIG. 2*a*, exhaust port 20 receives exhaust gases from cylinder 31 via exhaust valves E1 and E2. Similarly, exhaust port 22 receives exhaust gases exiting cylinder 33 via exhaust valves E3 and E4, exhaust port 24 receives exhaust gases from cylinder 35 via exhaust valves E5 and E6, and exhaust port 26 receives exhaust gases leaving cylinder 37 via exhaust valves E7 and E8. Therefrom, the exhaust gases are directed via a split manifold system to exhaust turbine 92 of turbocharger 290. It will be noted that in the example of FIG. 2*a*, the split exhaust manifold is not integrated within the cylinder head 216.

As shown in FIG. 2*a*, exhaust port 20 may be fluidically coupled with first plenum 23 via runner 39 while exhaust port 22 may fluidically communicate with first plenum 23 via runner 41. Further, exhaust port 24 may be fluidically coupled to second plenum 25 via runner 43 while exhaust port 26 may fluidically communicate with second plenum 25 via runner 45. Thus, cylinders 31 and 33 may exhaust their combustion gases into first plenum 23 via respective exhaust ports 20 and 22, and via runners 39 and 41 respectively. Runners 39 and 41 may combine at Y-junction 250 into first plenum 23. Cylinders 35 and 37 may expel their exhaust gases via exhaust ports 24 and 26, respectively, into second plenum 25 via respective runners 43 and 45. Runners 43 and 45 may combine at Y-junction 270 into second plenum 25. Thus, first plenum 23 may not fluidically communicate with runners 43 and 45 from exhaust ports 24 and 26, and cylinders 35 and 37 respectively. Further, second plenum 25 may not fluidically communicate with runners 39 and 41 from cylinders 31 and 33, respectively. Additionally, first plenum 23 and second plenum 25 may not communicate with each other. In the depicted example, first plenum 23 and second plenum 25 may not be included in the cylinder head 216 and may be external to cylinder head 216.

Each combustion chamber may receive fuel from fuel injectors (not shown) coupled directly to the cylinder, as direct injectors, and/or from injectors coupled to the intake manifold, as port injectors. Further, air charges within each cylinder may be ignited via spark from respective spark plugs (not shown). In other embodiments, the combustion chambers of engine 10 may be operated in a compression ignition mode, with or without an ignition spark.

As described earlier in reference to FIG. 1, engine 10 may include a turbocharger 290. Turbocharger 290 may include an exhaust turbine 92 and an intake compressor 94 coupled on a common shaft 96. The blades of exhaust turbine 92 may be caused to rotate about the common shaft 96 as a portion of the exhaust gas stream discharged from engine 10 impinges upon the blades of the turbine. Intake compressor 94 may be coupled to exhaust turbine 92 such that compressor 94 may be actuated when the blades of exhaust turbine 92 are caused to rotate. When actuated, compressor 94 may then direct pressurized gas through boost chamber 46, and charge air cooler 90 to air intake manifold 44 from where it may then be directed to engine 10. In this way, turbocharger 290 may be configured for providing a boosted air charge to the engine intake.

Intake passage 42 may include an air intake throttle 62 downstream of charge air cooler 90. The position of throttle 62 can be adjusted by control system 15 via a throttle actuator (not shown) communicatively coupled to controller 12. By modulating air intake throttle 62, while operating compressor 94, an amount of fresh air may be inducted from the atmosphere into engine 10, cooled by charge air cooler 90 and delivered to the engine cylinders at compressor (or boosted) pressure via intake manifold 44. To reduce compressor surge, at least a portion of the air charge compressed by compressor 94 may be recirculated to the compressor inlet. A compressor recirculation passage 49 may be provided for recirculating cooled compressed air from downstream of charge air cooler 90 to the compressor inlet. Compressor recirculation valve 27 may be provided for adjusting an amount of cooled recirculation flow recirculated to the compressor inlet.

Turbocharger 290 may be configured as a multi-scroll turbocharger wherein the exhaust turbine 92 includes a plurality of scrolls. In the depicted embodiment, exhaust turbine 92 includes two scrolls comprising a first scroll 71 and a second scroll 73. Accordingly, turbocharger 290 may be a twin scroll (or dual scroll) turbocharger with at least two separate exhaust gas entry paths flowing into, and through, exhaust turbine 92. The dual scroll turbocharger 290 may be configured to separate exhaust gas from cylinders whose exhaust gas pulses interfere with each other when supplied to exhaust turbine 92. Thus, first scroll 71 and second scroll 73 may be used to supply separate exhaust streams to exhaust turbine 92.

In the example of FIG. 2*a*, first scroll 71 is shown receiving exhaust from cylinders 31 and 33 via first plenum 23. Second scroll 73 is depicted fluidly communicating with second plenum 25 and receiving exhaust from cylinders 35 and 37. Therefore, exhaust may be directed from a first outer cylinder (cylinder 31) and a first inner cylinder (cylinder 33) to a first scroll 71 of twin scroll turbocharger 290. Further, exhaust may be directed from a second outer cylinder (cylinder 37) and a second inner cylinder (cylinder 35) to a second scroll 73 of twin scroll turbocharger 290. The first scroll 71 may not receive exhaust from second plenum 25 and second scroll 73 may not receive exhaust pulses from first plenum 23.

In alternate embodiments, exhaust from cylinders 33, 35, and 37 may be delivered to second scroll 73 while exhaust from cylinder 31 may be directed to first scroll 71. Other options of directing exhaust gases to the twin-scroll turbocharger may be used without departing from the scope of this disclosure. In alternative embodiments, the turbocharger may not include multiple scrolls.

Exhaust turbine 92 may include at least one wastegate to control an amount of boost provided by said exhaust turbine. As shown in FIG. 2*a*, a common wastegate 69 may be included in bypass passage 67 coupled between an inlet and outlet of the exhaust turbine 92 to control an amount of exhaust gas bypassing exhaust turbine 92. Thus, a portion of exhaust gases flowing towards first scroll 71 from first plenum 23 may be diverted via passage 65 past wastegate 69 into bypass passage 67. Further, a different portion of exhaust gases flowing into second scroll 73 from second plenum 25 may be diverted via passage 63 through wastegate 69. Exhaust gases exiting turbine exhaust 92 and/or wastegate 69 may pass through emission control device 70 and may exit the vehicle via a tailpipe (not shown). In alternative dual scroll systems, each scroll may include a corresponding wastegate to control the amount of exhaust gas which passes through exhaust turbine 92.

Returning now to cylinders 31, 33, 35, and 37, as described earlier, each cylinder comprises two intake valves and two exhaust valves. Herein, each intake valve is actuatable between an open position allowing intake air into a respective cylinder and a closed position substantially blocking intake air from the respective cylinder. FIG. 2*a* illustrates intake valves I1-I8 being actuated by a common intake camshaft 218. Intake camshaft 218 includes a plurality of intake cams configured to control the opening and closing of the intake valves. Each intake valve may be controlled by one or more intake cams, which will be described further below. In some embodiments, one or more additional intake cams may be included to control the intake valves. Further still, intake actuator systems may enable the control of intake valves.

Each exhaust valve is actuatable between an open position allowing exhaust gas out of a respective cylinder and a closed position substantially retaining gas within the respective cylinder. FIG. 2*a* shows exhaust valves E1-E8 being actuated by a common exhaust camshaft 224. Exhaust camshaft 224 includes a plurality of exhaust cams configured to control the opening and closing of the exhaust valves. Each exhaust valve may be controlled by one or more exhaust cams, which will be described further below. In some embodiments, one or more additional exhaust cams may be included to control the exhaust valves. Further, exhaust actuator systems may enable the control of exhaust valves.

Intake valve actuator systems and exhaust valve actuator systems may further include push rods, rocker arms, tappets, etc. Such devices and features may control actuation of the intake valves and the exhaust valves by converting rotational motion of the cams into translational motion of the valves. In other examples, the valves can be actuated via additional cam lobe profiles on the camshafts, where the cam lobe profiles between the different valves may provide varying cam lift height, cam duration, and/or cam timing. However, alternative camshaft (overhead and/or pushrod) arrangements could be used, if desired. Further, in some examples, cylinders 212 may each have only one exhaust valve and/or intake valve, or more than two intake and/or exhaust valves. In still other examples, exhaust valves and intake valves may be actuated by a common camshaft. However, in alternate embodiments, at least one of the intake valves and/or exhaust valves may be actuated by its own independent camshaft or other device.

Engine 10 may be a variable displacement engine (VDE) and a subset of the four cylinders 212 may be deactivated, if desired, via one or more mechanisms. Therefore, controller 12 may be configured to deactivate intake and exhaust valves for selected cylinders when engine 10 is operating in VDE mode of operation. Intake and exhaust valves of selected cylinders may be deactivated in the VDE mode via switching tappets, switching rocker arms, or switching roller finger followers.

In the present example, cylinders 31, 35, and 37 are capable of deactivation. Each of these cylinders features a first intake cam and a second intake cam per intake valve arranged on common intake camshaft 218, and a first exhaust cam and a second exhaust cam per exhaust valve positioned on common exhaust camshaft 224.

First intake cams have a first cam lobe profile for opening the intake valves for a first intake duration. In the example of FIG. 2*a*, first intake cams C1 and C2 of cylinder 31, first intake cams C5, C6 of cylinder 33, first intake cams C9, C10 of cylinder 35, and first intake cams C13, C14 of cylinder 37 may have a similar first cam lobe profile which opens respective intake valves for a similar duration and lift. In other examples, first intake cams for different cylinders may have different lobe profiles. Second intake cams are depicted as null cam lobes which may have a profile to maintain their respective intake valves in closed position. Thus, null cam lobes assist in deactivating corresponding valves in the VDE mode. In the example of FIG. 2*a*, second intake cams N1, N2 of cylinder 31, second intake cams N5, N6 of cylinder 35, and second intake cams N9, N10 of cylinder 37 are null cam lobes. These null cam lobes can deactivate corresponding intake valves in cylinders 31, 35, and 37.

Further, each of the intake valves may be actuated by a respective actuator system operatively coupled to controller 12. As shown in FIG. 2*a*, intake valves I1 and I2 of cylinder 31 may be actuated via actuator system A2, intake valves I3 and I4 of cylinder 33 may be actuated via actuator system A4, intake valves I5 and I6 of cylinder 35 may be actuated via actuator system A6, and intake valves I7 and I8 of cylinder 37 may be actuated via actuator system A8.

Similar to the intake valves, each of the deactivatable cylinders (31, 35, and 37) features a first exhaust cam and a second exhaust cam arranged on common exhaust camshaft 224. First exhaust cams may have a first cam lobe profile providing a first exhaust duration and lift. In the example of FIG. 2*a*, first exhaust cams C3 and C4 of cylinder 31, first exhaust cams C7, C8 of cylinder 33, first exhaust cams C11, C12 of cylinder 35, and first exhaust cams C15, C16 of cylinder 37 may have a similar first cam lobe profile which opens respective exhaust valves for a given duration and lift. In other examples, first exhaust cams for different cylinders may have different lobe profiles. Second exhaust cams are depicted as null cam lobes which may have a profile to maintain their respective exhaust valves in the closed position. Thus, null cam lobes assist in deactivating exhaust valves in the VDE mode. In the example of FIG. 2*a*, second exhaust cams N3, N4 of cylinder 31, second exhaust cams N7, N8 of cylinder 35, and second exhaust cams N11, N12 of cylinder 37 are null cam lobes. These null cam lobes can deactivate corresponding exhaust valves in cylinders 31, 35, and 37.

Further, each of the exhaust valves may be actuated by a respective actuator system operatively coupled to controller 12. Therefore, exhaust valves E1 and E2 of cylinder 31 may be actuated via actuator system A1, exhaust valves E3 and E4 of cylinder 33 may be actuated via actuator system A3, exhaust valves E5 and E6 of cylinder 35 may be actuated via actuator system A5, and exhaust valves E7 and E8 of cylinder 37 may be actuated via actuator system A7.

Cylinder 33 (or first inner cylinder) may not be capable of deactivation and may not include null cam lobes for its intake and exhaust valves. Consequently, intake valves I3 and I4 of cylinder 33 may not be deactivatable and are only operated by first intake cams C5 and C6 respectively. Thus, intake valves I3 and I4 of cylinder 33 may not be operated by null cam lobes. Likewise, exhaust valves E3 and E4 may not be deactivatable and are only operated by first exhaust cams C7 and C8. Further, exhaust valves E3 and E4 may not be operated by null cam lobes. Therefore, each intake valve and each exhaust valve of cylinder 33 may be actuated by a single respective cam.

It will be appreciated that other embodiments may include different mechanisms known in the art for deactivating intake and exhaust valves in cylinders. Such embodiments may not utilize null cam lobes for deactivation. For example, hydraulic roller finger follower systems may not use null cam lobes for cylinder deactivation.

Further, other embodiments may include reduced actuator systems. For example, a single actuator system may actuate intake valves I1 and I2 as well as exhaust valves E1 and E2. This single actuator system would replace actuator systems A1 and A2 providing one actuator system for cylinder 31. Other combinations of actuator systems are also possible.

CPS system 204 may be configured to translate specific portions of intake camshaft 218 longitudinally, thereby causing operation of intake valves I1-I8 to vary between respective first intake cams and second intake cams (where applicable). Further, CPS system 204 may be configured to translate specific portions of exhaust camshaft 224 longitudinally, thereby causing operation of exhaust valves E1-E8 to vary between respective first exhaust cams and second exhaust cams. In this way, CPS system 204 may switch between a first cam for opening a valve for a first duration, and a second cam, for opening the valve for a second duration. In the given example, CPS system 204 may switch cams for intake valves in cylinders 31, 35, and 37 between a first cam for opening the intake valves for a first duration, and a second null cam for maintaining intake valves closed. Further, CPS system 204 may switch cams for exhaust valves in cylinders 31, 35, and 37 between a first cam for opening the exhaust valves for a first duration, and a second null cam for maintaining exhaust valves closed. In the example of cylinder 33, CPS system 204 may not switch cams for the intake and exhaust valves as cylinder 33 is configured with one cam per valve, and may not be deactivated.

An optional embodiment depicted in FIG. 2*a* may include solenoids S1 and S2, wherein actuator systems A2, A6, and A8 include rocker arms to actuate the first and second intake cams. Herein, CPS system 204 may be operatively coupled to solenoid S1 and solenoid S2, which in turn may be operatively coupled to the actuator systems. Further, the rocker arms may be actuated by electrical or hydraulic means via solenoids S1 and S2 to follow either the first intake cams or the second null cams. As depicted, solenoid S1 is operatively coupled solely to actuator system A2 (via 272) and not operatively coupled to actuator systems A6 and A8. Likewise, solenoid S2 is operatively coupled to actuator systems A6 (via 278), and A8 (via 284), and not operatively coupled to actuator system A2. It will be noted that solenoid S2 is common to actuator systems A6 and A8, and therefore, intake valves of each of cylinders 35 and 37 may be actuated by a single, common solenoid S2.

Solenoids S1 and S2 may also be operatively coupled to actuator systems A1, A5, and A7 to actuate the respective exhaust cams. To elaborate, solenoid S1 may be operatively coupled only to actuator system A1 (via 274) and not to actuator systems A5 and A7. Further, solenoid S2 may be operatively coupled to actuator system A5 (via 276), and actuator system A7 (via 282) but not operatively coupled to A1. Herein, rocker arms may be actuated by electrical or hydraulic means to follow either the first exhaust cams or the second null cams.

Solenoid S1 may control intake cams of intake valves I1 and I2 of cylinder 31 via rocker arms in actuator system A2 and may also control exhaust valves E1 and E2 of cylinder 31 via rocker arms. Exhaust valves E1 and E2 may be deactivated at the same time as intake valves I1 and I2. A default position for solenoid S1 may be a closed position such that rocker arm(s) operatively coupled to solenoid S1 are maintained in a pressureless unlatched (or unlocked) position resulting in no lift (or zero lift) of intake valves I1 and I2. Solenoid S2 may control each pair of intake cams of intake valves I5 and I6 of cylinder 35, and intake valves I7 and I8 of cylinder 37 respectively. Solenoid S2 may also control each pair of exhaust cams of exhaust valves E5 and E6 of cylinder 35, and exhaust valves E7 and E8 of cylinder 37. Further, the intake cams of intake valves of cylinders 35 and 37 may be actuated via rocker arms in respective actuator systems A6 and A8. Likewise, exhaust cams of exhaust valves in cylinders 35 and 37 may be actuated via rocker arms in respective actuator systems A5 and A7. Solenoid S2 may be maintained in a default closed position such that associated rocker arms are maintained in a pressureless latched position following the first intake and exhaust cams for each of the intake and exhaust valves in cylinders 35 and 37.

In an alternative optional embodiment portrayed in FIG. 2*b*, each of the deactivatable cylinders may be controlled by distinct and separate solenoids. It will be noted that FIG. 2*b* includes many of the same components as those described above in reference to FIG. 2*a* and therefore, may be similarly numbered. The significant difference between FIGS. 2*a* and 2*b* is the presence of three solenoids, each solenoid controlling one of the three deactivatable cylinders. It will also be noted that solenoids S1, S2, and S3 (where applicable) of FIGS. 2*a* and 2*b* may be termed valvetrain switching solenoids.

As depicted in the example embodiment of FIG. 2*b*, actuator systems A1 and A2 of cylinder 31 may be operatively coupled only to solenoid S1. Similarly, solenoid S2 may be operatively coupled only to actuator systems A5 and A6 of cylinder 35, and solenoid S3 may be operatively coupled only to actuator systems A7 and A8 of cylinder 37. Therefore, rocker arms in each of actuator systems of cylinders 31, 35, and 37 may be independently controlled. For example, intake valves I5 and I6 of cylinder 35 may be independently controlled relative to intake valves I7 and I8 of cylinder 37. Similarly, exhaust valves E5 and E6 of cylinder 35 may be separately controlled from exhaust valves E7 and E8 of cylinder 37. To elaborate, solenoid S1 is operatively coupled to actuator systems A1 (via 274) and A2 (via 272), and not coupled to any other actuator system. Solenoid S2 is operatively coupled only to actuator systems A5 (via 292) and A6 (via 294), and solenoid S3 is operatively coupled only to actuator systems A7 (via 298) and A8 (via 296).

CPS system 204 (in both FIGS. 2*a* and 2*b*) may receive signals from controller 12 to switch between different cam profiles for different cylinders in engine 10 based on engine operating conditions. For example, during low engine loads, engine operation may be in a two-cylinder mode. Herein, cylinders 35 and 37 may be deactivated via the CPS system 204 actuating a switching of cams from first intake and first exhaust cams to second, null cams for each valve. Simultaneously, cylinders 31 and 33 may be maintained operative with their intake and exhaust valves being actuated by their respective first cams.

In the optional embodiment of FIG. 2*a* comprising actuator systems with rocker arms wherein the rocker arms are actuated by electrical or hydraulic means, the engine may be operated in two-cylinder mode during low load conditions. Solenoid S1 may be energized to open so that respective rocker arms follow the first intake cams and first exhaust cams on cylinder 31, and solenoid S2 may be energized to open such that the respective pressureless latched rocker arms unlatch to follow the second, null intake and second, null exhaust cams in each of cylinders 35 and 37. In the alternative embodiment of FIG. 2*b* comprising separate solenoids for each of the deactivatable cylinders, solenoid S1 may be energized to open as described above. Further, each of solenoids S2 and S3 may be energized to operate the engine in two-cylinder mode. Furthermore, pressureless latched rocker arms in actuator systems A5 and A6 of cylinders 35 may unlatch to follow second, null intake cams N5 and N6, and second, null exhaust cams N7 and N8. Similarly, pressureless latched rocker arms in actuator systems A7 and A8 of cylinder 37 may unlatch to follow second, null intake cams N9 and N10, and second, null exhaust cams N11 and N12.

In another example, at a medium engine load, engine 10 may be operated in a three-cylinder mode. Herein, CPS system 204 may be configured to actuate the intake and exhaust valves of cylinders 35 and 37 with their respective first intake cams. Concurrently, cylinder 31 may be deactivated by CPS system 204 via actuating the intake and exhaust valves of cylinder 31 with respective second, null cams.

Engine 10 may further include VCT system 202. VCT system 202 may be a twin independent variable camshaft timing system, for changing intake valve timing and exhaust valve timing independently of each other. VCT system 202 includes intake camshaft phaser 230 and exhaust camshaft phaser 232 for changing valve timing. VCT system 202 may be configured to advance or retard valve timing by advancing or retarding cam timing (an example engine operating parameter) and may be controlled via controller 12. VCT system 202 may be configured to vary the timing of valve opening and closing events by varying the relationship between the crankshaft position and the camshaft position. For example, VCT system 202 may be configured to rotate intake camshaft 218 and/or exhaust camshaft 224 independently of the crankshaft to cause the valve timing to be advanced or retarded. In some embodiments, VCT system 202 may be a cam torque actuated device configured to rapidly vary the cam timing. In some embodiments, valve timing such as intake valve closing (IVC) and exhaust valve closing (EVC) may be varied by a continuously variable valve lift (CVVL) device.

The valve/cam control devices and systems described above may be hydraulically powered, or electrically actuated, or combinations thereof.

Engine 10 may be controlled at least partially by a control system 15 including controller 12 and by input from a vehicle operator via an input device (FIG. 1). Control system 15 is shown receiving information from a plurality of sensors 16 (various examples of which were described in reference to FIG. 1) and sending control signals to a plurality of actuators 81. As one example, control system 15, and controller 12, can send control signals to and receive a cam timing and/or cam selection measurement from CPS system 204 and VCT system 202. As another example, actuators 81 may include fuel injectors, wastegate 69, compressor recirculation valve 27, and throttle 62. Controller 12 may receive input data from the various sensors, process the input data, and trigger the actuators in response to the processed input data based on instruction or code programmed therein corresponding to one or more routines. Additional system sensors and actuators will be elaborated below with reference to FIG. 4.

As mentioned earlier, engine 10 of FIGS. 1, 2*a* and 2*b* may be operated in VDE mode or non-VDE (all cylinders firing) mode. In order to provide fuel economy benefits along with reduced noise, vibration and harshness (NVH), example engine 10 may be primarily operated in either an even firing three-cylinder or an even firing two-cylinder VDE mode. A first version of a four-cylinder crankshaft wherein engine firing (or cylinder strokes) occurs at 180 crank angle (CA) degree intervals may introduce NVH due to uneven firing when operating in a three-cylinder mode. For example, in a four-cylinder engine with the first version of the crankshaft enabling a firing order of 1-3-4-2 may fire at the following uneven intervals: 180°-180°-360° when operated in three-cylinder mode (1-3-4).

In order for engine 10 to operate in the three-cylinder mode with reduced NVH, a crankshaft that allows even firing during three-cylinder mode operation may be desired. For example, a crankshaft may be designed to fire three cylinders at 240° intervals while a fourth cylinder is deactivated. By providing a crankshaft that allows even firing in the three-cylinder mode, engine 10 may be operated for longer periods in the three-cylinder mode which can enhance fuel economy and ease NVH.

Figure 3:
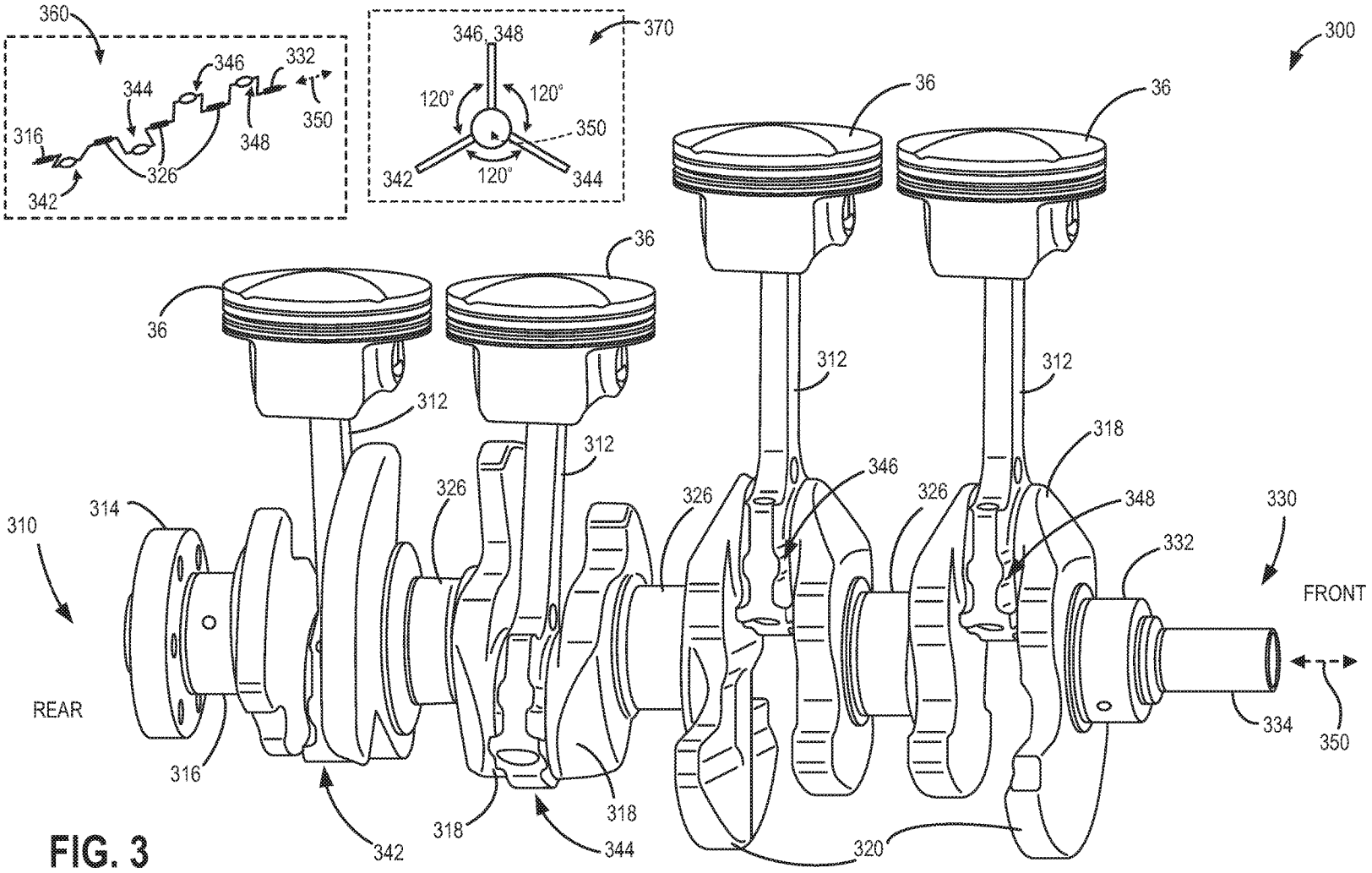
FIG. 3 is an illustration of a crankshaft in accordance with the present disclosure.

Accordingly, an example crankshaft 300 that may be utilized for operating engine 10 in a two-cylinder or three-cylinder mode with even firing is shown in FIG. 3. FIG. 3 illustrates a perspective view of crankshaft 300. Crankshaft 300 may be crankshaft 40 shown in FIG. 1. The crankshaft depicted in FIG. 3 may be utilized in an engine, such as engine 10 of FIGS. 2 and 4, having an inline configuration in which the cylinders are aligned in a single row. A plurality of pistons 36 may be coupled to crankshaft 300, as shown. Further, since engine 10 is an inline four-cylinder engine, FIG. 3 depicts four pistons arranged in a single row along a length of the crankshaft 300.

Crankshaft 300 has a crank nose end 330 (also termed front end) with crank nose 334 for mounting pulleys and/or for installing a harmonic balancer (not shown) to reduce torsional vibration. Crankshaft 300 further includes a flange end 310 (also termed rear end) with a flange 314 configured to attach to a flywheel (not shown). In this way, energy generated via combustion may be transferred from the pistons to the crankshaft and flywheel, and thereon to a transmission thereby providing motive power to a vehicle.

Crankshaft 300 may also comprise a plurality of pins, journals, webs (also termed, cheeks), and counterweights. In the depicted example, crankshaft 300 includes a front main bearing journal 332 and a rear main bearing journal 316. Apart from these main bearing journals at the two ends, crankshaft 300 further includes three main bearing journals 326 positioned between front main bearing journal 332 and rear main bearing journal 316. Thus, crankshaft 300 has five main bearing journals wherein each journal is aligned with a central axis of rotation 350. The main bearing journals 316, 332, and 326 support bearings that are configured to enable rotation of crankshaft 300 while providing support to the crankshaft. In alternate embodiments, the crankshaft may have more or less than five main bearing journals.

Crankshaft 300 also includes a first crank pin 348, a second crank pin 346, a third crank pin 344, and a fourth crank pin 342 (arranged from crank nose end 330 to flange end 310). Thus, crankshaft 300 has a total of four crank pins. However, crankshafts having an alternate number of crank pins have been contemplated. Crank pins 342, 344, 346, and 348 may each be mechanically and pivotally coupled to respective piston connecting rods 312, and thereby, respective pistons 36. It will be appreciated that during engine operation, crankshaft 300 rotates around the central axis of rotation 350. Crank webs 318 may support crank pins 342, 344, 346, and 348. Crank webs 318 may further couple each of the crank pins to the main bearing journals 316, 332, and 326. Further, crank webs 318 may be mechanically coupled to counterweights 320 to dampen oscillations in the crankshaft 300. It may be noted that all crank webs in crankshaft 300 may not be labeled in FIG. 3.

The second crank pin 346 and the first crank pin 348 are shown at similar positions relative to central axis of rotation 350. To elaborate, pistons coupled to first crank pin 348 and second crank pin 346 respectively may be at similar positions in their respective strokes. First crank pin 348 may also be aligned with second crank pin 346 relative to central axis of rotation 350. Further, the second crank pin 346, the third crank pin 344 and the fourth crank pin 342 may be arranged 120 degrees apart from each other around the central axis of rotation 350. For example, as depicted in FIG. 3 for crankshaft 300, third crank pin 344 is shown swaying towards the viewer, fourth crank pin 342 is moving away from the viewer (into the paper) while second crank pin 346 and first crank pin 348 are aligned with each other and are in the plane of the paper.

Inset 360 shows a schematic drawing of crankshaft 300 depicting the positions of the four crank pins relative to each other and relative to central axis of rotation 350. Inset 370 shows a schematic diagram of a side view of crankshaft 300 as viewed from the rear end (or flange end 310) of the crankshaft looking toward the front end (or crank nose end 330) along the central axis of rotation 350. Inset 370 indicates the relative positions of the crank pins in relation to the center axis of crankshaft 300 and central axis of rotation 350.

As shown in inset 360, the fourth crank pin 342, and the third crank pin 344 are depicted swaying in substantially opposite directions to each other. To elaborate, when viewed from the end of rear main bearing journal 316 towards front main bearing journal 332, third crank pin 344 is angled towards the right while fourth crank pin 342 is angled towards the left, relative to the central axis of rotation 350. This angular placement of third crank pin 344 relative to fourth crank pin 342 is also depicted in inset 370.

Further, it will be observed that third crank pin 344 and fourth crank pin 342 may not be arranged directly opposite from each other. These crank pins may be positioned 120 degrees apart in the clockwise direction as measured specifically from third crank pin 344 towards fourth crank pin 342 and as viewed from the flange (rear) end 310 with rear main bearing journal 316 towards crank nose end 330 with front main bearing journal 332. The fourth crank pin 342 and the third crank pin 344 are, therefore, angled relative to one another around the central axis of rotation 350. Similarly, the third crank pin 344 and the second crank pin 346 are angled relative to one another around the central axis of rotation 350. Further, first crank pin 348 and second crank pin 346 are shown aligned and parallel with each other around the central axis of rotation 350. Additionally, first crank pin 348 and second crank pin 346 are positioned adjacent to each other. As shown in inset 370, the second crank pin 346, the third crank pin 344 and the fourth crank pin 342 are positioned 120 degrees apart from each other around the center axis of crankshaft 300. Further, first crank pin 348 and second crank pin 346 are positioned vertically above the central axis of rotation 350 (e.g., at zero degrees) while third crank pin 344 is positioned 120 degrees clockwise from first crank pin 348 and second crank pin 346. Fourth crank pin 342 is positioned 120 degrees counterclockwise from first crank pin 348 and second crank pin 346.

It will be appreciated that even though first crank pin 348 is depicted aligned with second crank pin 346, and each of the two pistons coupled to first crank pin 348 and second crank pin 346 is depicted in FIG. 3 at a TDC position, the two respective pistons may be at the end of different strokes. For example, the piston coupled to first crank pin 348 may be at the end of a compression stroke while the piston associated with second crank pin 346 may be at the end of the exhaust stroke. Thus, the piston coupled to first crank pin 348 may be 360 crank angle degrees (CAD) apart from the piston coupled to second crank pin 346 when considered with respect to a 720 CAD engine firing cycle.

The crank pin arrangement of FIG. 3 supports an engine firing order of 3-2-4 in the three-cylinder mode. Herein, the firing order 3-2-4 comprises firing a third cylinder with a piston coupled to third crank pin 344 followed by firing a second cylinder with a piston coupled to second crank pin 346, and then firing a fourth cylinder with a piston coupled to fourth crank pin 342. Herein, each combustion event is separated by an interval of 240° of crank angle.

The crank pin arrangement may also mechanically constrain a firing order of 1-3-2-4 when all cylinders are activated in a non-VDE mode. Herein, the firing order 1-3-2-4 may comprise firing a first cylinder with a piston coupled to the first crank pin 348 followed by firing the third cylinder with its piston coupled to the third crank pin 344 next. The second cylinder with piston coupled to the second crank pin 346 may be fired after the third cylinder followed by firing the fourth cylinder with piston coupled to the fourth crank pin 342. In the example of engine 10 with crankshaft 300, firing events in the four cylinders with firing order 1-3-2-4 may occur at the following uneven intervals: 120°-240°-240°-120°. Since first crank pin 348 is aligned with second crank pin 346, and their piston strokes occur 360 crank angle degrees apart, firing events in the first cylinder and the second cylinder also occur at 360° intervals from each other. Engine firing events will be further described in reference to FIGS. 6, 7, and 8.

Figure 4:
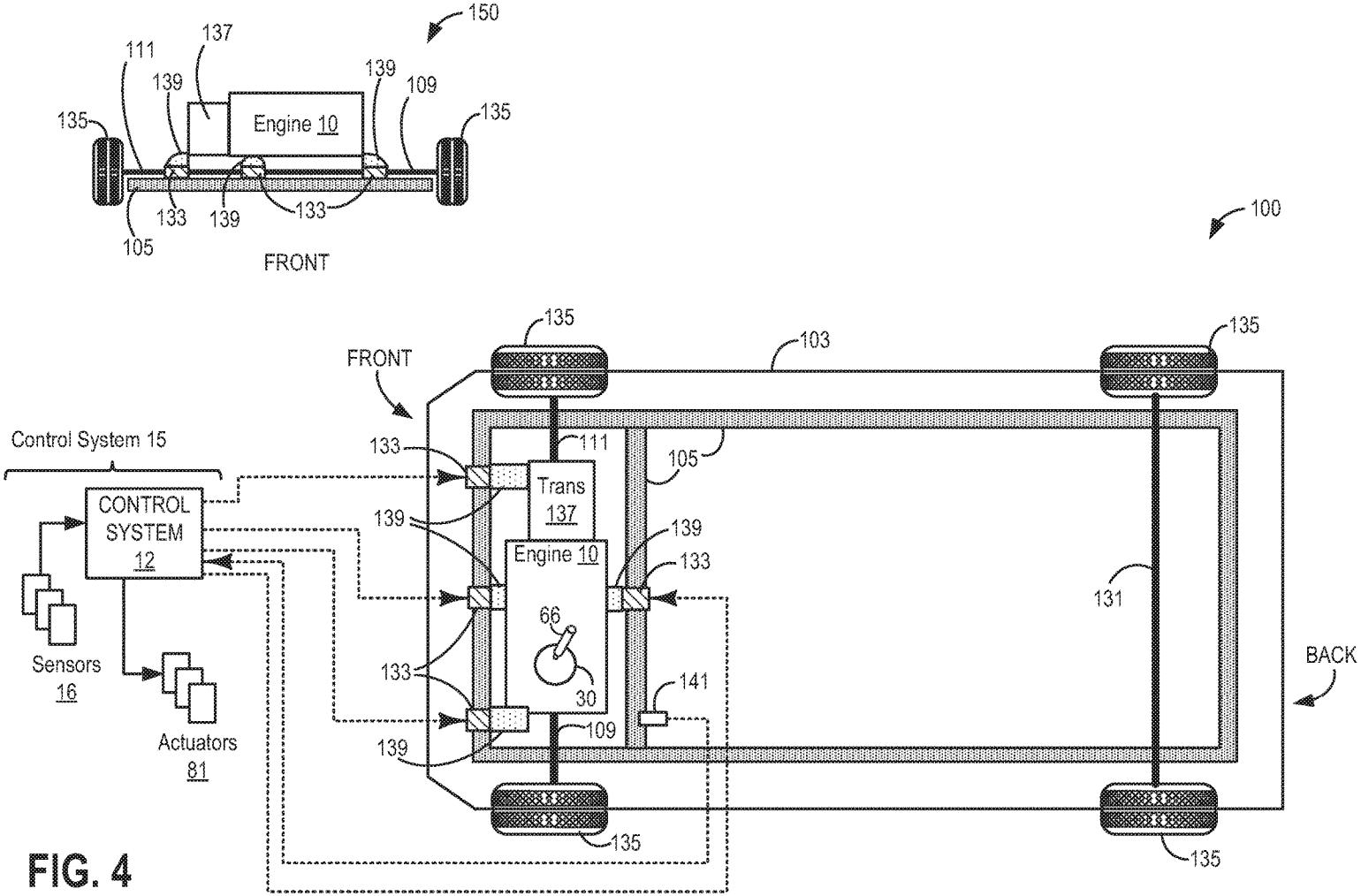
FIG. 4 schematically depicts an embodiment of a vehicle including the example engine of FIG. 1, 2*a*, or 2*b*.

FIG. 4 schematically depicts an example vehicle system 100 as shown from a top view. Vehicle system 100 comprises a vehicle body 103 with a front end, labeled "FRONT", and a back end labeled "BACK." Vehicle system 100 may include a plurality of wheels 135. For example, as shown in FIG. 4, vehicle system 100 may include a first pair of wheels adjacent to the front end of the vehicle and a second pair of wheels adjacent the back end of the vehicle.

Vehicle system 100 may include an internal combustion engine, such as example engine 10 of FIGS. 1, 2*a* and 2*b*, coupled to transmission 137. Vehicle system 100 is depicted as having a FWD transmission where engine 10 drives the front wheels via half shafts 109 and 111. In another embodiment, vehicle system 100 may have a RWD transmission which drives the rear wheels via a driveshaft (not shown) and a differential (not shown) located on rear axle 131.

Engine 10 and transmission 137 may be supported at least partially by frame 105, which in turn may be supported by plurality of wheels 135. As such, vibrations and movements from engine 10 and transmission 137 may be transmitted to frame 105. Frame 105 may also provide support to a body of vehicle system 100 and other internal components such that vibrations from engine operation may be transferred to an interior of the vehicle system 100. In order to reduce transmission of vibrations to the interior of vehicle system 100, engine 10 and transmission 137 may be mechanically coupled via a plurality of members 139 to respective active mounts 133. As depicted in FIG. 4, engine 10 and transmission 137 are mechanically coupled at four locations to members 139 and via members 139 to four active mounts 133. Alternatively, engine 10 and transmission 137 may be coupled to frame 105 via members 139 and non-active mounts 133. In yet another example, a combination of active and non-active mounts may be used. To elaborate, a proportion of members 139 may be coupled to active mounts while the remaining members 139 may be coupled to inactive or non-active mounts. As an example, two of the four members 139 may be coupled to active mounts 133 while remaining two members 139 may be coupled to non-active mounts (not shown). In other alternate embodiments, a different number of members and active (and non-active) mounts may be used, without departing from the scope of the present disclosure.

View 150 depicts a view of vehicle system 100 as observed from front end of vehicle system 100. As described earlier, control system 15 including controller 12 may at least partially control engine 10 as well as vehicle system 100. Control system 15 is shown receiving information from a plurality of sensors 16 and sending control signals to a plurality of actuators 81. In the depicted example, controller 12 may receive input data from vibration sensor 141. Vibration sensor 141, in one example, may be an accelerometer. Further, control system 15, and controller 12, can send control signals to actuators 81 which may include fuel injector 66 coupled to cylinder 30, and the plurality of active mounts 133. Controller 12 may receive input data from the various sensors, process the input data, and trigger the actuators in response to the processed input data based on instruction or code programmed therein corresponding to one or more routines.

Active mounts 133 may be operatively coupled to controller 12 and upon receiving a signal from controller 12 may adapt their damping characteristics to neutralize vibrations arising from the engine and/or transmission. In one example, changes to damping characteristics may be obtained by active damping via changing effective mount stiffness. In another example, damping characteristics may be varied by active damping via actuated masses that can create a counterforce to a perceived vibration. Herein, active mounts may filter vibrations received from the engine and/or transmission, and provide a counterforce that will nullify vibrations that were not filtered. The counterforce may be created by commanding a solenoid within each active mount to speed up or slow down within its travel limits.

Active mounts that rely on changing effective mount stiffness may be limited by frequency. Since a higher proportion of disturbances in variable displacement engine (VDE) operation may occur during lower engine speeds with a larger displacement input (target frequency<50 Hz), changing effective mount stiffness may help reduce vibrations generated during VDE mode transitions. On the other hand, active mounts that rely on providing active damping via actuating solenoids may not be able to reject low frequency vibrations. Herein, low frequency rejection capabilities of these active mounts may be travel limited, as in travel limits of the solenoid. Such active mounts may be more suited for applications wherein a balance shaft is absent and counterforces may be desired at higher engine speeds. In another example, active mounts with actuated masses may also be used for high frequency masking tasks where target frequency is greater than 50 Hz. In yet another example, these active mounts may be utilized to mimic valvetrain vibrations that may be present in a variety of valvetrain states enabling all valvetrain states to feel the same to a passenger.

The active mounts may be controlled via either open loop or closed loop systems. For example, in open loop control systems, the driving command may be synchronized with a perceived disturbance and its amplitude may be mapped according to measured transfer functions. In the example of a closed loop control system, the condition of the active mounts may be monitored regularly and the active mounts may be commanded to reject measured disturbances within authority limits. However, closed loop control may be more sensitive to errors in calculating correction vectors. Therefore, a commanded response may result in deteriorated vibrations.

In the present disclosure, NVH issues that may arise during transitions in engine operating modes may be controlled by mapping measurements of transition events. For example, vehicle system 100 with engine 10 may be operated in the three available modes (two-cylinder, three-cylinder, and full-cylinder) when on-bench and measurements of vibration frequencies may be learned during transitions between these three available modes. As depicted in FIG. 4, a vibration sensor 141 coupled to frame 105 may sense vibration frequencies during these transitions and communicate these signals to controller 12. In response to signals received from the vibration sensor 141, controller 12 may trigger active mounts 133 to counter and reduce perceived vibrations. In one example of open loop control, the active mounts may be triggered based on when the valve-train switching solenoids (e.g., S1, S2, and S3) are activated. In response to signals received from controller 12, active mounts 133 may generate vibrations that have the same amplitude as the vibrations sensed by sensor 141 but are 180 degrees out of phase.

Since each transition between operating modes may generate specific vibration frequencies in the engine, a distinct input function may be provided by the active mounts to counter these frequencies. These perceived vibration frequencies and respective active mount responses may be mapped and stored in a controller's memory. During off-bench driving conditions, the controller may use mapped data to communicate a specific signal to the active mounts based on which transition is occurring.

Accordingly, active mounts may provide a different input function for each distinct transition. In one example, all active mounts coupled to the engine may be actuated. In another example, only a selection of the plurality of active mounts may be actuated. In yet another embodiment, different active mounts may be triggered at different times, and for different durations. In this way, the controller may learn and store information regarding vibration frequencies during each transition in operating modes and corresponding response signals transmitted to the active mounts to counter these vibration frequencies. In this way, actuation of the active mounts may deliver a tactile perception of firing events.

In addition to actuating the active mounts, controller 12 may also provide an appropriate audible experience to attain a complete simulation of a firing event or transition sequence. In one example, active noise cancellation (ANC) may be used to selectively add and/or cancel noise in a vehicle cabin to provide a desired audible perception. ANC may include a network of sensors that perceive cabin noise and in response to perceived cabin noise, the ANC may activate an audio system. For example, the audio system may be commanded by the ANC to direct the speakers to reduce cabin pressure to selectively cancel noise. In another example, the audio system may be directed to add to cabin pressure for creating noise. Speaker motion within the audio system may be coordinated to match in phase, amplitude, and frequency as required for either a noise cancellation or auditory generation effect. As an overall result, the noise produced by a given frequency of engine firing operation may be cancelled. Further, auditory events that correspond to an expected transition order may be generated in order to produce a desired experience.

Operation of engine 10, particularly, the firing order, will be described now in reference to FIGS. 5-7 which depict ignition timing diagrams for the four cylinders of engine 10. FIG. 5 illustrates engine firing in a two-cylinder VDE mode for engine 10, FIG. 6 depicts engine firing in a three-cylinder VDE mode for engine 10, and FIG. 7 represents engine firing in a non-VDE mode for engine 10 wherein all four cylinders are activated. It will be appreciated that cylinders 1, 2, 3, and 4 in FIGS. 5-7 correspond to cylinders 31, 33, 35, and 37 respectively, of FIGS. 2*a* and 2*b*. For each diagram, cylinder number is shown on the y-axis and engine strokes are depicted on the x-axis. Further, ignition, and the corresponding combustion event, within each cylinder is represented by a star symbol between compression and power strokes within the cylinder. Further still, additional diagrams 504, 604, and 704, portray cylinder firing events in each active cylinder in each mode around a circle representing 720 degrees of crank rotation. It will be appreciated that though not noted, cylinders continue to undergo engine strokes after deactivation without experiencing any combustion events. Additionally, deactivated cylinders may include trapped air charges which may be a mix of combusted gases, fresh air, oil, etc. Trapped air charges may enable a cushioning effect as the piston moves within the deactivated cylinders. However, trapped air charges do not provide any power during the power strokes.

Referring to FIG. 5, an example engine firing diagram in two-cylinder VDE mode for engine 10 is illustrated. Herein, cylinders 3 and 4 are deactivated by actuating the intake and exhaust valves of these cylinders via their respective null cams. Cylinders 1 and 2 may be fired 360 CA degrees apart in a firing order of 1-2-1-2. As shown in FIG. 5, cylinder 1 may commence a compression stroke at the same time that cylinder 2 begins an exhaust stroke. As such, each engine stroke in cylinders 1 and 2 is spaced 360 CA degrees apart. For example, an exhaust stroke in cylinder 2 may occur 360 CA degrees after an exhaust stroke in cylinder 1. Similarly, ignition events in the engine are spaced 360 CA degrees apart, as shown in 504, and accordingly, power strokes in the two active cylinders occur 360 CA degrees apart from each other. The two-cylinder VDE mode may be utilized during low engine load conditions when torque demand is lower. By operating in the two-cylinder mode, fuel economy benefits may also be attained.

Turning now to FIG. 6, it portrays an example cylinder firing diagram for the cylinder firing order in an example three-cylinder VDE mode for engine 10 wherein three cylinders are activated. In this example, cylinder 1 may be deactivated while cylinders 2, 3, and 4 are activated. Ignition and combustion events within the engine and between the three activated cylinders may occur at 240 CA degree intervals similar to a three-cylinder engine. Herein, firing events may occur at evenly spaced intervals. Likewise, each engine stroke within the three cylinders may occur at 240 CA degree intervals. For example, an exhaust stroke in cylinder 2 may be followed by an exhaust stroke in cylinder 4 at about 240 CA degrees after the exhaust stroke in cylinder 2. Similarly, the exhaust stroke in cylinder 4 may followed by an exhaust stroke in cylinder 3 after an interval of 240 CA degrees. Firing events in the engine may occur similarly. An example firing order for the three-cylinder VDE mode may be 2-4-3-2-4-3. As illustrated at 604, cylinder 3 may be fired approximately 240 CA degrees after cylinder 4 is fired, cylinder 2 may be fired approximately 240 CA degrees after the firing event in cylinder 3, and cylinder 4 may be fired approximately 240 CA degrees after the firing event in cylinder 2.

It will be appreciated that the even firing intervals of 240 CA degrees in the three-cylinder VDE mode may be approximate. In one example, the firing interval between cylinder 3 and cylinder 2 may be 230 CA degrees. In another example, the firing interval between cylinder 3 and cylinder 2 may be 255 CA degrees. In yet another example, the firing interval between cylinder 3 and cylinder 2 may be exactly 240 CA degrees. Likewise, the firing interval between cylinder 2 and cylinder 4 may vary in a range between 230 CA degrees and 255 CA degrees. The same variation may apply to firing intervals between cylinder 4 and cylinder 3. Other variations may also be possible.

Further, the three-cylinder VDE mode may be selected for engine operation during engine idling conditions. Noise and vibration may be more prominent during engine idle conditions and the even firing three-cylinder mode with stable firing may be a more suitable option for engine operation during these conditions.

Turning now to FIG. 7, it portrays an example cylinder firing diagram for the cylinder firing order in an example non-VDE mode for engine 10 wherein all four cylinders are activated. In the non-VDE mode, engine 10 may be fired unevenly based on the design of crankshaft 300. In one example, crankshaft 300 shown in FIG. 3 may produce the cylinder firing order shown in FIG. 7. As shown in the depicted example, cylinder 1 may be fired between cylinders 3 and 4. In one example, cylinder 1 may be fired approximately 120 crank angle (CA) degrees after cylinder 4 is fired. In one example, cylinder 1 may be fired exactly 120 CA degrees after cylinder 4 is fired. In another example, cylinder 1 may be fired 115 CA degrees after cylinder 4 fires. In yet another example, cylinder 1 may be fired 125 CA degrees after firing cylinder 4. Further, cylinder 1 may be fired approximately 120 CA degrees before cylinder 3 is fired. For example, cylinder 1 may be fired in a range of between 115 and 125 CA degrees before cylinder 3 is fired. In addition, cylinders 2, 3, and 4 may continue to have combustion events 240 CA degrees apart with a combustion event in cylinder 1 occurring approximately midway between the combustion events in cylinder 4 and cylinder 3. Therefore, engine 10 may be fired with the following firing order: 1-3-2-4 (or 2-4-1-3 or 3-2-4-1 or 4-1-3-2 since the firing is cyclic) at uneven intervals wherein cylinder 1 is the uneven firing cylinder. As illustrated at 704, cylinder 3 may be fired approximately 120 degrees of crank rotation after cylinder 1 is fired, cylinder 2 may be fired approximately 240 degrees of crank rotation after firing cylinder 3, cylinder 4 may be fired at approximately 240 degrees of crank rotation after firing cylinder 2, and cylinder 1 may be fired again at approximately 120 degrees of crank rotation after firing cylinder 4. In other examples, the intervals between the firing events in the four cylinders may vary from the intervals mentioned above.

Turning now to FIG. 8, it shows example maps 820 and 840, featuring engine load-engine speed plots. Specifically, the maps indicate different engine operation modes that are available at different combinations of engine speeds and engine loads. Each of the maps shows engine speed plotted along the x-axis and engine load plotted along the y-axis. Line 822 represents a highest load that a given engine can operate under at a given speed. Zone 824 indicates a four-cylinder non-VDE mode for a four-cylinder engine, such as engine 10 described earlier. Zone 848 indicates a three-cylinder VDE mode, and zone 826 indicates a two-cylinder VDE mode for the four-cylinder engine.

Map 820 depicts an example of a first version of a four-cylinder engine, wherein the lone available VDE mode is a two-cylinder mode VDE option (unlike the embodiment in the present disclosure). The two-cylinder mode (zone 826) may be primarily used during low engine loads and moderate engine speeds. At all other engine speed-engine load combinations, a non-VDE mode may be used (zone 824). As will be observed in map 820, zone 826 occupies a smaller portion of the area under line 822 relative to the area representing a non-VDE mode (zone 824). Therefore, an engine operating with only two available modes (VDE and non-VDE) may provide relatively minor improvements in fuel economy over an engine without variable displacement. Further, since the transition between the two modes involves activation or deactivation of two out of four cylinders, more intrusive controls (e.g., larger changes to spark timing along with adjustments to throttle and valve timings) may be needed to compensate for torque disturbances during these transitions. As mentioned earlier, the first version of the four cylinder engine may not provide an option of operating in three-cylinder mode due to increased NVH issues.

Map 840 depicts an example of engine operation for an embodiment of the present disclosure, e.g. engine 10 of FIGS. 1, 2*a*, 2*b*, and 4. Herein, the engine may operate in one of two available VDE modes increasing fuel economy benefits over the first version option described in reference to Map 820. The engine may operate in two-cylinder VDE mode, as in the example of Map 820, during low engine loads at moderate engine speeds. Further, the engine may operate in three-cylinder VDE mode during low load-low speed conditions, during moderate load-moderate speed conditions, and during moderate load-high speed conditions. At very high speed conditions at all loads and at very high load conditions at all engine speeds, a non-VDE mode of operation may be utilized.

It will be appreciated from Map 840 that the example engine of FIGS. 1, 2*a*, 2*b* and 4 may operate substantially in a three-cylinder or a two-cylinder mode. A non-VDE mode may be selected only during the high load and very high engine speed conditions. Therefore, a relatively higher improved fuel economy may be achieved. As described earlier, the engine may be operated in three-cylinder and two-cylinder modes with even firing allowing reduced NVH issues. When operating in non-VDE mode, an uneven firing pattern may be utilized which may produce a distinct exhaust note.

It will be further appreciated that in the embodiment of engine 10 of FIGS. 1, 2*a*, 2*b* and 4, a larger proportion of operating mode transitions may include transitions from two-cylinder VDE mode to three-cylinder VDE mode (and vice versa) with fewer transitions from three-cylinder VDE mode to non-VDE mode (and vice versa). In other words, the engine may be largely operated in three-cylinder VDE mode. Further, a lower number of transitions involving a shift from four-cylinder non-VDE mode to two-cylinder VDE mode (and vice versa) may occur. Consequently, a smoother and easier transition in engine control may be enabled in the example embodiment of engine 10 described in reference to FIGS. 1, 2*a*, 2*b* and 4. Overall, drivability may be enhanced due to reduced NVH and smoother engine control.

It will also be appreciated that transitions in engine operation from two-cylinder to three-cylinder mode (and vice versa) may include transitioning between modes which involve even firing intervals. Therefore, transitioning between these modes may be more sensitive to a timing of the actual switch. That is, the timing of the transition may result in noticeable vibrations in these two even firing modes. As will be described later, throttle position changes as well as modifications in spark timing may be used to enable smoother transitions.

Activation/deactivation of cylinders and firing event sequences during transitions between engine operating modes will now be described in reference to FIGS. 9-18. Each of these figures depict ignition timing diagrams for the four cylinders of engine 10 during a specific transition. As in FIGS. 5-7, cylinders 1, 2, 3, and 4 in FIGS. 9-18 correspond to cylinders 31, 33, 35, and 37 respectively, of FIGS. 2*a* and 2*b*. For each diagram, cylinder number is shown on the y-axis and engine strokes are depicted on the x-axis. Further, ignition, and the corresponding combustion event, within each cylinder is represented by a star symbol between compression and power strokes within the cylinder. It will be noted that the firing events and cylinder strokes progress from left hand side of the diagram to the right hand side of the diagram.

Deactivation of a cylinder may include actuating the intake and exhaust valves of the cylinder via their respective null cams, and disabling a fuel injector coupled to the deactivated cylinder. As elaborated earlier, by actuating intake and exhaust valves via their respective null cams, the intake and exhaust valves may be maintained closed during their cylinder deactivation. Spark, though, may continue to be provided within the deactivated cylinder. In alternate embodiments, spark may also be disabled after a desired firing event.

It will be appreciated that though not noted, cylinders continue to undergo engine strokes after deactivation without experiencing any combustion events. To elaborate, pistons in deactivated cylinders continue their reciprocating motion without providing any power to the crankshaft. Additionally, deactivated cylinders may include trapped air charges which may be a mix of combusted gases, fresh air, oil, etc. Trapped air charges may enable a cushioning effect as the piston moves within the deactivated cylinders. However, trapped air charges do not provide any power during the power strokes.

Figure 9:
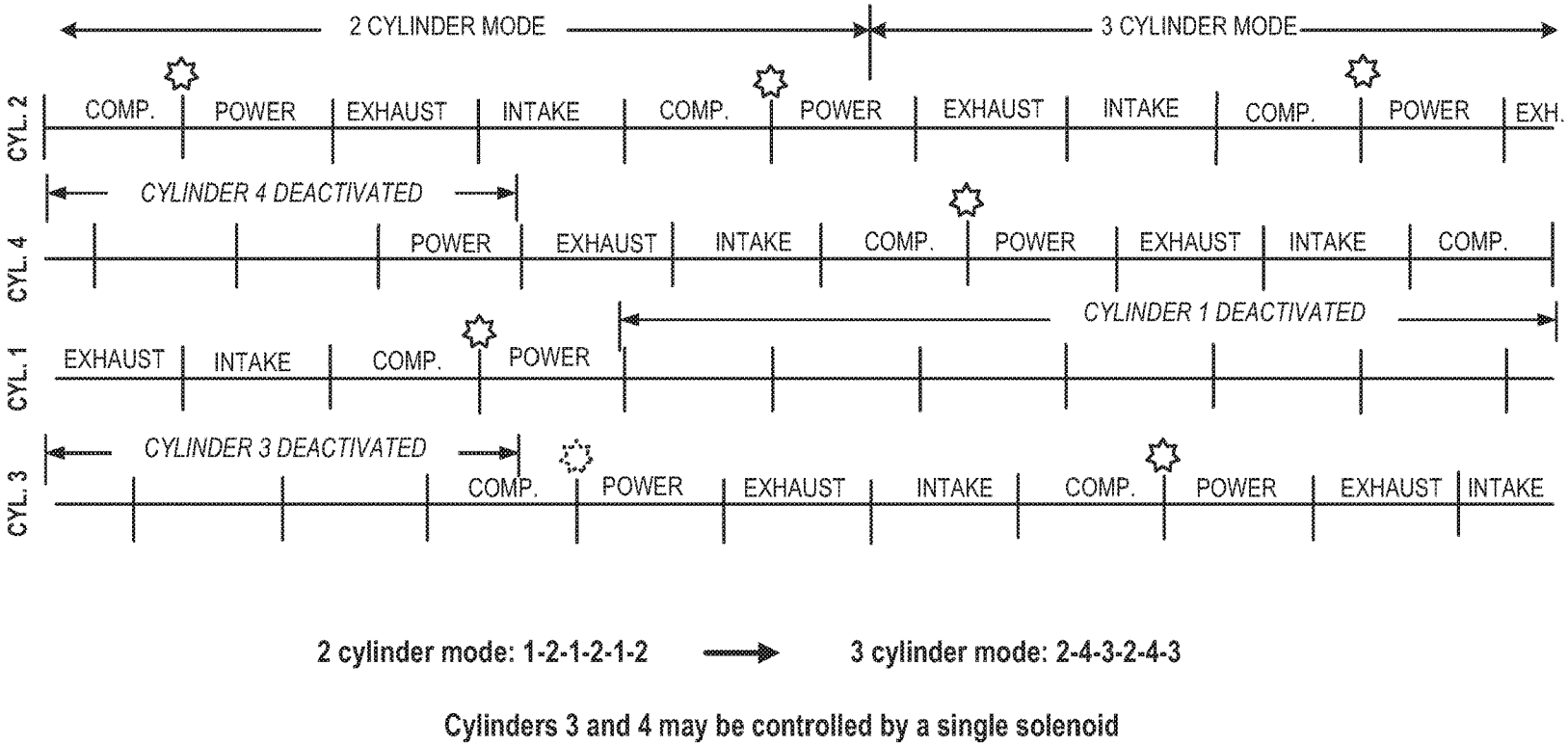
FIGS. 9-18 portray examples of available sequences for transitions between two-cylinder, three-cylinder, and full-cylinder modes of engine operation.

FIG. 9 is an example engine firing diagram illustrating a transition from two-cylinder VDE mode to three-cylinder mode. The depicted example is for the example optional embodiment of FIG. 2*a* wherein actuator systems of cylinder 3 (or cylinder 35) and cylinder 4 (or cylinder 37) are controlled by a common, single solenoid S2. At the left hand side of the diagram, the engine is shown operating in two-cylinder mode with cylinders 1 and 2 activated and firing events in the engine occurring at 360 CA degree intervals. To elaborate, cylinders 1 and 2 may be fired 360 CA degrees apart in a firing order of 1-2-1-2. Further, cylinders 3 and 4 may be deactivated by actuating the intake and exhaust valves of these cylinders via their respective null cams. Additionally, fuel injectors in cylinders 3 and 4 may be disabled. However, spark may be provided to the two deactivated cylinders. Accordingly, without fresh air and unburned fuel in these deactivated cylinders, combustion may not occur.

When a command to transition engine operation to three-cylinder mode is received, solenoid S2 may be actuated by CPS system 204 to activate cylinders 3 and 4. In response to the command, cam profiles may be switched such that intake valves and exhaust valves of cylinders 3 and 4 are now actuated by first intake cams and first exhaust cams respectively. It will be appreciated that switching between the two cams may be performed during either the compression or the power strokes. During these strokes, the cams may be positioned on their base circle enabling a smooth transition between the cam profiles. Therefore, cylinder 4 may be activated towards the end of its power stroke while cylinder 3 may be activated during a latter half of its compression stroke. Cylinders 3 and 4 may, thus, be activated simultaneously by solenoid S2.

As shown in FIG. 9, a spark may be provided to cylinder 3 immediately after its activation but combustion may not occur due to the absence of fresh air and fuel in the cylinder. This spark is depicted as a dotted spark to indicate the lack of combustion. Alternatively, spark may not be provided within cylinder 3 until after fueling post-activation. Cylinders 4 and 3 may expel trapped air charges during their respective exhaust strokes as the exhaust valves may now be actuated. Next, solenoid S1 may be commanded to deactivate cylinder 1 to transition to three-cylinder mode. Accordingly, exhaust valves and intake valves in cylinder 1 may be deactivated by switching cams from the first intake and first exhaust cams to respective second, null cams. Further, the valves may be deactivated towards the end of the power stroke in cylinder 1 such that combusted gases may be trapped within cylinder 1.

Therefore, a sequence of events in engine 10 during the transition from two-cylinder mode to three-cylinder mode may be described as: a first firing event in cylinder 2 may be followed after 360 CA degrees by a second firing event in cylinder 1. Simultaneous activation of cylinders 3 and 4 may occur after the second firing event in cylinder 1. Next, cylinder 1 may be deactivated towards the end of the ensuing power stroke after the second firing event. A third firing event may occur in cylinder 2 at 360 CA degrees after the second firing event in cylinder 1. The third firing event in cylinder 2 may be followed by a fourth firing event in cylinder 4 after 240 CA degrees, and the fourth firing event in cylinder 4 may be followed after 240 CA degrees by a fifth firing event in cylinder 3. Hereon, the engine may operate in three-cylinder mode with even firing intervals of 240 CA degrees. It will be noted that successive firing events during the transition have at least a 120 (or more) CA degree interval. The above sequence of events during the transition may allow for a smoother transition with reduced NVH as compared to the transition sequence that will be described below in reference to FIG. 10. The transition sequence described above may also be implemented in an engine embodiment with separate solenoids such as the embodiment of FIG. 2*b*. Cylinder 3 and cylinder 4 may be activated independently, but at substantially the same times in the cylinder strokes, by respective solenoids S2 and S3.

In this way, transitioning from the two-cylinder mode to the three-cylinder mode may include activating the third cylinder and the fourth cylinder simultaneously after a firing event (termed the second firing event in the description above) in the first cylinder, deactivating the first cylinder after the firing event, firing the second cylinder 360 crank angle degrees after the firing event in the first cylinder, and firing the fourth cylinder 240 crank angle degrees after firing the second cylinder.

In another example, a four cylinder engine may be transitioned from operating in two-cylinder mode to operation in three-cylinder mode. A method may comprise operating the engine in two-cylinder mode by firing a first cylinder and a second cylinder 360 crank angle degrees apart initially. Engine operation may be transitioned to three-cylinder mode by deactivating the first cylinder, activating a fourth cylinder and a third cylinder, and firing the fourth cylinder 240 crank angle degrees after a firing event in the second cylinder. Further, the third cylinder may be fired 240 crank angle degrees after firing the fourth cylinder. Furthermore, the first cylinder may not be fueled and may not be fired after deactivation.

Figure 10:
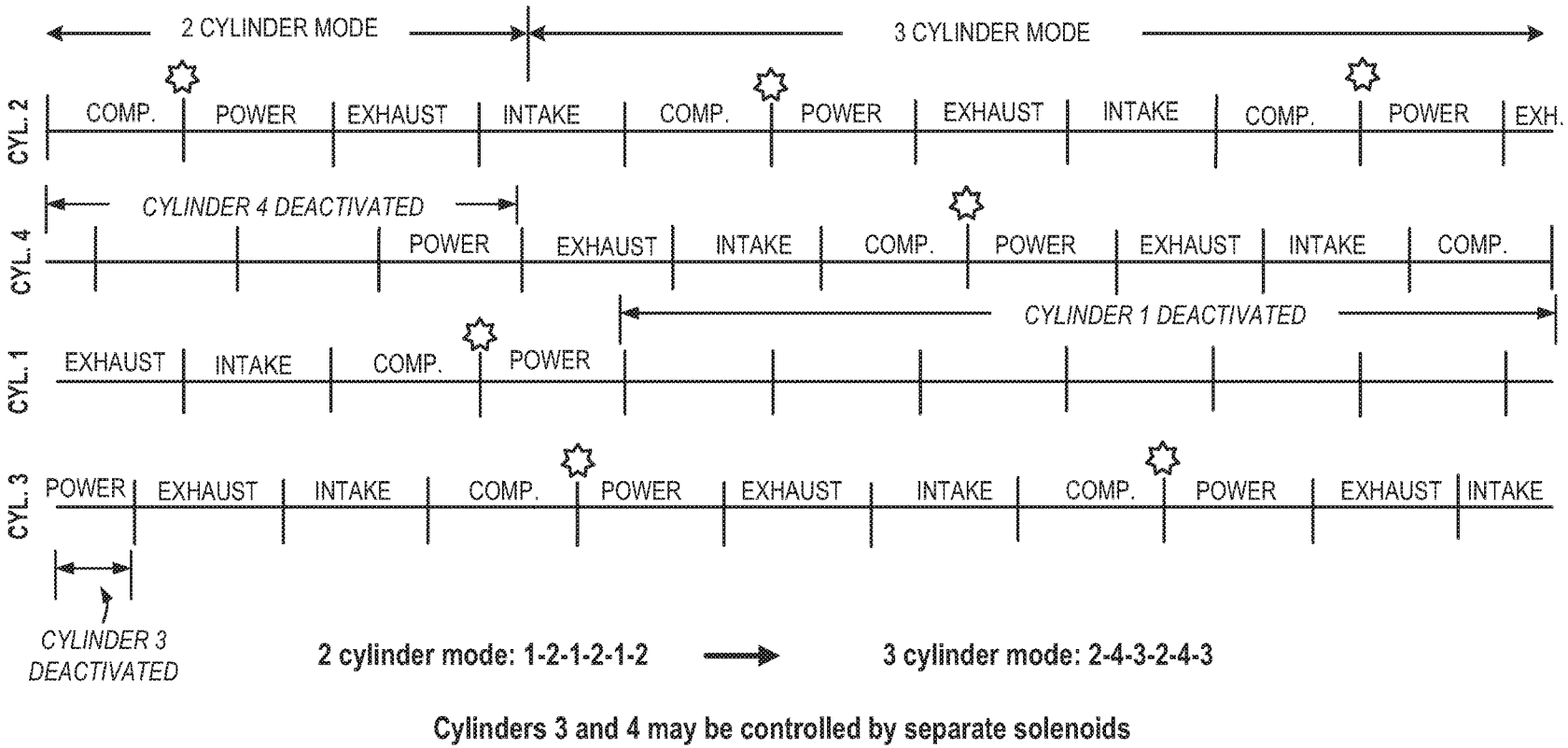

Another example transition from two-cylinder mode to three-cylinder mode is depicted in FIG. 10. This transition includes using separate solenoid control, as shown in the example alternative embodiment of FIG. 2*b*, for cylinder 3 and cylinder 4. Herein, cylinder 3 may be activated earlier than cylinder 4 such that a firing event with combustion can occur in cylinder 3 at 120 CA degrees after firing cylinder 1. As depicted, cylinder 3 may be activated towards the end of its power stroke and any trapped charge within cylinder 3 may be evacuated during the ensuing exhaust stroke. Cylinder 4 may be activated towards the end of its power stroke about 450 CA degrees after the activation of cylinder 3. Trapped gases may be expelled from cylinder 4 after activation. Further, cylinder 1 may be deactivated towards the end of its power stroke after a combustion event.

Herein, the sequence of events during the transition may be described as: activation of cylinder 3 may be followed by a first firing event in cylinder 2. A second firing event may occur in cylinder 1 at 360 CA degrees after the first firing event in cylinder 2. Cylinder 4 may be activated after the second firing event in cylinder 1. Further, a third firing event in cylinder 3 may ensue 120 CA degrees after the second firing event in cylinder 1. Cylinder 1 may be deactivated towards the end of the power stroke following the second firing event and combusted gases may be trapped. Next, cylinder 2 may be fired in a fourth firing event at 240 CA degrees after the third firing event in cylinder 3. A fifth firing event in cylinder 4 may follow at 240 CA degrees after the fourth firing event in cylinder 2. Hereon, the three activated cylinders may continue to fire evenly at 240 CA degree intervals.

The above described transition sequence may result in increased NVH due to uneven firing intervals that occur during the sequence. The uneven intervals during the sequence may be elaborated as follows: 360-120-240-240. In the successive firing events during the transition, a relatively short interval of 120 CA degrees may be observed as cylinder 3 fires closely after cylinder 1. Further, with the above sequence, power strokes delivering torque to the crankshaft change from once every 360 CA degrees to once every 240 CA degrees. The number of CA degrees between power strokes may be inversely proportional to torque produced by the crankshaft, assuming the power strokes are of similar intensity. During the intermediate period within the transition when the number of CA degrees between power strokes is 120 degrees, a momentary increase in crankshaft torque may be produced. This momentary increase could be perceived as a lack of smoothness and increased vibration. Accordingly, the transition sequence described in FIG. 9 may provide a smoother transition than the transition sequence of FIG. 10. Due to a likelihood of increased NVH, the sequence of transition in FIG. 10 may be used less frequently. It will also be noted that at least two successive firing events during the transition have a 120 CA degree interval therebetween.

The above sequence of events may not be possible in the optional example engine embodiment of FIG. 2*a* with a single, common solenoid (e.g. solenoid S2) controlling each of cylinder 3 (or cylinder 35) and cylinder 4 (or cylinder 37).

In another representation, a method may comprise transitioning from a two-cylinder mode to a three-cylinder mode of engine operation by activating a third cylinder and a fourth cylinder sequentially, followed by deactivating a first cylinder after a firing event in the first cylinder. The method may further include firing the third cylinder 120 CA degrees after the firing event in the first cylinder, firing a second cylinder 240 CA degrees after firing the third cylinder, firing the fourth cylinder 240 CA degrees after firing the second cylinder, and firing the first cylinder 120 CA degrees after firing the fourth cylinder. As mentioned above, this sequence may generate NVH due to a shorter interval of 120 CA degrees between the firing event in the first cylinder and the successive firing event in the third cylinder.

Figure 11:
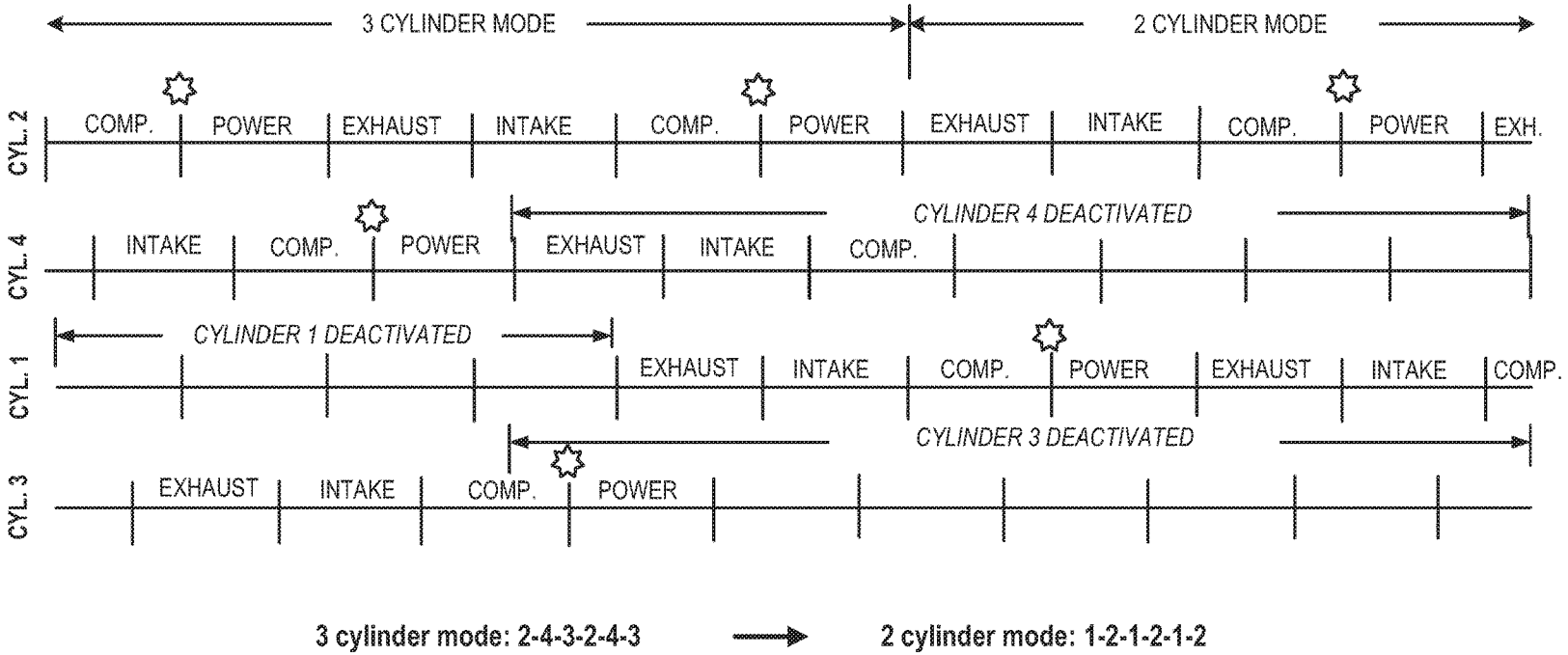

FIG. 11 is an example engine firing diagram illustrating a transition from three-cylinder VDE mode to two-cylinder mode. The depicted example is for the example optional embodiment of FIG. 2*a* wherein actuator systems of cylinder 3 (or cylinder 35) and cylinder 4 (or cylinder 37) are controlled by a common, single solenoid S2. At the left hand side of the diagram, the engine is shown operating in three-cylinder mode with cylinders 2, 3, and 4 activated such that firing events in the engine occur at evenly spaced 240 CA degree intervals. To elaborate, cylinders 2, 3, and 4 may be fired 240 CA degrees apart in a firing order of 2-4-3-2-4-3. Further, cylinder 1 is deactivated by actuating the intake and exhaust valves via their respective second null cams. Additionally, the fuel injector in cylinder 1 may be disabled. However, spark may continue to be provided but without fresh air and unburned fuel in this deactivated cylinder, combustion may not occur.

When a command to transition engine operation to two-cylinder mode is received, solenoid S2 may be actuated by CPS system 204 to deactivate cylinders 3 and 4. In response to the command, cam profiles may be switched such that intake valves and exhaust valves of cylinders 3 and 4 are now actuated by their respective second null cams. It will be appreciated that switching between the first intake and exhaust cams and the second intake and exhaust null cams may be performed during either the compression or the power strokes. During these strokes, the cams may be positioned on their base circle enabling a smooth transition between the cam profiles. Therefore, cylinder 4 may be deactivated towards the end of its power stroke following a firing event within cylinder 4. Meanwhile, cylinder 3 may be deactivated at the same time as cylinder 4. As explained earlier, deactivation of a cylinder may include actuating the intake and exhaust valves of the cylinder via their respective null cams, and disabling a fuel injector coupled to the cylinder. Spark, though, may continue to be provided within the deactivated cylinder. In alternate embodiments, spark may also be disabled after a desired firing event.

As depicted in FIG. 11, cylinder 3 may be deactivated during its compression stroke. Since cylinder fueling may occur during an intake stroke or during an earlier portion of the compression stroke, fresh fuel with fresh intake air may be present within cylinder 3 when it is deactivated. Accordingly, when spark is supplied to cylinder 3 following deactivation in its compression stroke, a combustion (or firing) event can occur in cylinder 3. However, combusted gases may remain trapped within cylinder 3 (and cylinder 4) since the exhaust and intake valves remain closed upon deactivation.

Cylinder 1 may be activated towards the end of its power stroke (no combustion in cylinder 1 during deactivation) after the firing event in cylinder 3. Solenoid S1 may be triggered to activate cylinder 1 to transition to two-cylinder mode. Accordingly, exhaust valves and intake valves in cylinder 1 may be activated by switching actuating cams from respective second, null cams to first intake and first exhaust cams. Upon activation, trapped gases in cylinder 1 may be evacuated in its ensuing exhaust stroke.

A sequence of events in engine 10 during the transition from three-cylinder mode to two-cylinder mode may be described as: a first firing event in cylinder 2 may be followed after 240 CA degrees by a second firing event in cylinder 4. Simultaneous deactivation of cylinders 3 and 4 may occur after the second firing event in cylinder 4. A third firing event may occur in cylinder 3, post-deactivation, at 240 CA degrees after the second firing event in cylinder 4. Next, cylinder 1 may be activated towards the end of its power stroke. The third firing event in cylinder 3 may be followed after 240 CA degrees by a fourth firing event in cylinder 2, and the fourth firing event in cylinder 2 may be followed after 360 CA degrees by a fifth firing event in cylinder 1. Beyond this firing event, the engine may continue to operate in two-cylinder mode with even firing intervals of 360 CA degrees in two activated cylinders (cylinder 1 and cylinder 2). It will be observed that at least two successive firing events in the sequence above have at least a 120 CA degree interval (or more) therebetween. In this example, the smallest interval between two successive firing events is 240 CA degrees.

This sequence of events during the transition from three-cylinder mode to two-cylinder mode may allow for a smoother transition with reduced NVH. In this transition sequence, firing intervals change from 240 CA degrees in the three-cylinder mode to 360 CA degrees in the two-cylinder mode. As observed in FIG. 11, intermediate firing intervals of either 120 CA degrees or 480 CA degrees may be absent and the transition is made between two modes featuring even firing intervals. As mentioned earlier, the number of CA degrees between firing intervals (or power strokes) may be inversely proportional to torque produced by the crankshaft, assuming the power strokes are of similar intensity. If there were to be an intermediate period during the transition where the number of degrees between power strokes is either 120 or 480 CA degrees, a momentary increase or decrease, respectively, in crankshaft torque may be produced. This momentary increase or decrease may be perceived as a lack of smoothness.

In this way, operation of a four cylinder engine may be transitioned from three-cylinder mode to two-cylinder mode using a single solenoid. The method may include deactivating the fourth cylinder (cylinder 4) and the third cylinder (cylinder 3) simultaneously, activating the first cylinder (cylinder 1), and firing the first cylinder 360 crank angle degrees after a firing event in the second cylinder (cylinder 2).

The transition sequence described above may also be implemented with separate solenoids as in FIG. 2*b*. Cylinder 3 and cylinder 4 may be activated independently, but at substantially the same times in the cylinder strokes, by respective solenoids S2 and S3.

In another example, a four cylinder engine may be transitioned from operating in three-cylinder mode to operation in two-cylinder mode. A method may comprise transitioning from three-cylinder mode to two-cylinder mode by deactivating the third cylinder and the fourth cylinder, activating the first cylinder, and firing the first cylinder 360 crank angle degrees after a firing event in the second cylinder. Further, the fourth cylinder may not be fueled and may not be fired after deactivation. Further still, the third cylinder may not be fueled and may not be fired after deactivation.

Figure 12:
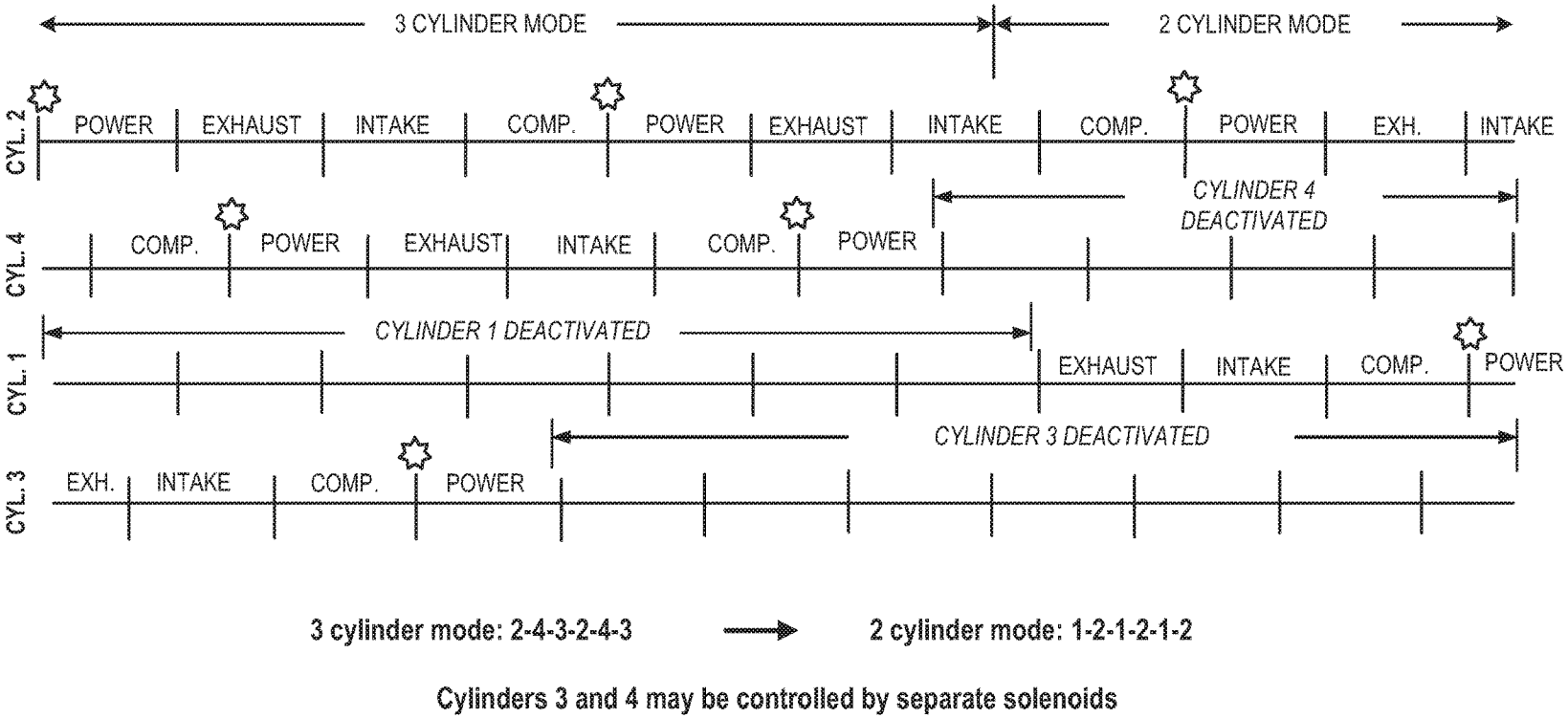

Another example transition from three-cylinder mode to two-cylinder mode is depicted in FIG. 12. This transition includes using separate solenoid control, as shown in the optional embodiment of FIG. 2*b*, for cylinder 3 and cylinder 4. Similar to FIG. 11, the left hand side of the diagram depicts the engine operating in three-cylinder mode with cylinders 2, 3, and 4 activated and firing events in the engine occurring at evenly spaced 240 CA degree intervals. Further, cylinder 1 is deactivated by actuating the intake and exhaust valves via their respective second null cams.

When a command to transition engine operation to two-cylinder mode is received, solenoids S2 and S3 may be actuated independently by CPS system 204 to deactivate cylinders 3 and 4. Herein, cylinder 3 may be deactivated earlier than cylinder 4, the deactivation occurring towards the end of a power stroke following a firing event within cylinder 3. Combusted gases resulting from the firing event in cylinder 3 may be trapped. Cylinder 4 may also be deactivated towards the end of its power stroke following a combustion event within cylinder 4. Similar to cylinder 3, combusted gases may be trapped within cylinder 4 after deactivation. Cylinder 1 may be activated via solenoid S1 towards the end of its power stroke (no combustion event in cylinder 1 during deactivation) and trapped air charge may be expelled in an exhaust stroke that follows the power stroke. Activation of cylinder 1 may follow the firing event in cylinder 4.

Herein, the sequence of events during the transition in modes may be elaborated as: a first firing event in cylinder 2 may be followed after 240 CA degrees by a second firing event in cylinder 4. A third firing event may occur in cylinder 3 at 240 CA degrees following the second firing event in cylinder 4. Further, cylinder 3 may be deactivated within its power stroke following the third firing event in cylinder 3. A fourth firing event may occur in cylinder 2 at 240 CA degrees after the third firing event in cylinder 3. Cylinder 4 may be fired in a fifth firing event at 240 CA degrees after the fourth firing event. Next, cylinder 4 may be deactivated in the power stroke ensuing after the fifth firing event within cylinder 4, and cylinder 1 may be activated after cylinder 4 is deactivated. A sixth firing event in cylinder 2 may occur at 480 CA degrees after the fifth firing event. A seventh firing event in cylinder 1 may follow at 360 CA degrees after the sixth firing event in cylinder 2. Hereon, the two activated cylinders may continue to fire evenly at 360 CA degree intervals.

The above described transition sequence may result in increased NVH due to skipped firing events between the fifth and sixth firing events resulting in uneven intervals. The uneven intervals during the above sequence may be: 240-480-360. In the successive firing events during the transition, a relatively longer interval of 480 CA degrees may be observed as cylinder 2 fires considerably after cylinder 4. This longer interval can affect engine torque output and skipped firing events can affect combustion and drivability. As such, a momentary decrease in crankshaft torque may occur which in turn may result in reduced smoothness and increased disturbances. Due to a likelihood of increased NVH and disturbances in torque output, the transition sequence of FIG. 12 may be used less frequently. It will also be noted that at least a 120 CA degree interval is present between two successive firing events during the transition. In this example, the shortest interval between two successive firing events is 240 CA degrees.

The above sequence of events may not be possible with a single, common solenoid (e.g. solenoid S2) controlling each of cylinder 3 (or cylinder 35) and cylinder 4 (or cylinder 37).

Figure 13:
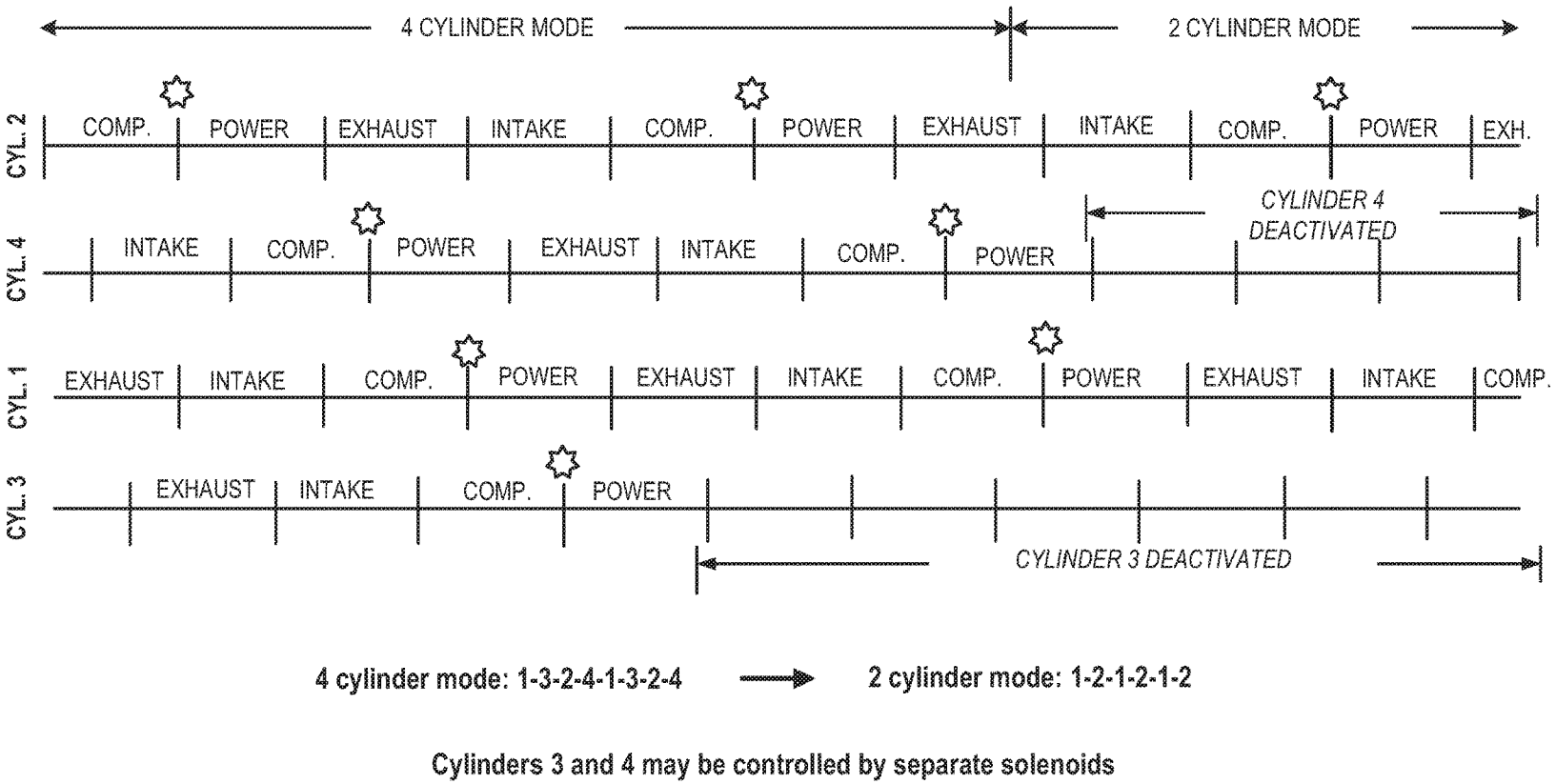

FIG. 13 is an example engine firing diagram illustrating a transition from four-cylinder (or non-VDE) mode to two-cylinder mode. The depicted example is for the example optional embodiment of FIG. 2*b* wherein actuator systems of cylinder 3 (or cylinder 35) and cylinder 4 (or cylinder 37) are controlled by different solenoids e.g. S2 and S3. At the left hand side of the diagram, the engine is shown operating in four-cylinder mode with all four cylinders activated and firing events in the engine occurring in an uneven mode. Specifically, cylinder 3 may be fired 120 CA degrees after a firing event in cylinder 1, cylinder 2 may be fired 240 CA degrees after the firing in cylinder 3, and cylinder 4 may be fired 240 CA degrees after the firing in cylinder 2. Cylinder 1 may be fired 120 CA degrees after firing cylinder 4. The firing order in full-cylinder mode may therefore be: 1-3-2-4 at the following intervals 120-240-240-120. Further, intake and exhaust valves in cylinders 1, 3, and 4 may be actuated by their first intake and first exhaust cams respectively.

When a command to transition engine operation to two-cylinder mode is received, solenoids S2 and S3 may be actuated by CPS system 204 to deactivate cylinders 3 and 4. In response to the command, cam profiles in cylinders 3 and 4 may be switched such that their respective intake valves and exhaust valves are now actuated by their respective second, null cams. It will be appreciated that switching between the first intake and exhaust cams and the second intake and exhaust null cams may be performed during either the compression or the power strokes. During these strokes, the cams may be positioned on their base circle enabling a smooth transition between the cam profiles. Each of cylinder 3 and cylinder 4 may be deactivated towards the end of their respective power strokes which ensue after respective firing events. Further, each of cylinders 3 and 4 may trap combusted gases within. However, cylinder 3 may be deactivated earlier than cylinder 4.

A sequence of events in engine 10 during the transition from non-VDE mode to two-cylinder mode may be described as: a first firing event in cylinder 2 followed after 240 CA degrees by a second firing event in cylinder 4. A third firing event may occur in cylinder 1 at 120 CA degrees after the second firing event in cylinder 4, and a fourth firing event may follow in cylinder 3. The fourth firing event in cylinder 3 may occur 120 CA degrees after the third firing event in cylinder 1. As will be noted, this is the firing sequence in the four-cylinder mode. Cylinder 3 may be deactivated towards the end of its power stroke ensuing after the fourth firing event in cylinder 3. Cylinder 2 may be fired in a fifth firing event at 240 CA degrees after the fourth firing event. The fifth firing event may be followed by a sixth firing event in cylinder 4 at 240 CA degrees after the fifth firing event. Next, cylinder 4 may be deactivated towards the end of its power stroke following the sixth firing event. A seventh firing event may occur in cylinder 1 at 120 CA degrees after the sixth firing event. Since cylinder 3 has been deactivated, the next firing event or an eighth firing event occurs in cylinder 2 at 360 CA degrees after the seventh firing event. Beyond this firing event, the engine may continue to operate in two-cylinder mode with even firing intervals of 360 CA degrees in two activated cylinders (cylinder 1 and cylinder 2). It will also be noted that at least a 120 CA degree interval is present between two successive firing events during the transition. For example, the interval between third and fourth firing events is 120 CA degrees. In another example, the sixth and seventh firing events have a 120 CA degree interval therebetween.

In this way, engine operation may be transitioned from a four-cylinder mode to a two-cylinder mode. The method may include deactivating the third cylinder (cylinder 3) and the fourth cylinder (cylinder 4) sequentially after respective firing events (fourth and sixth firing events), and firing the second cylinder and the first cylinder at 360 crank angle degree intervals.

Figure 14:
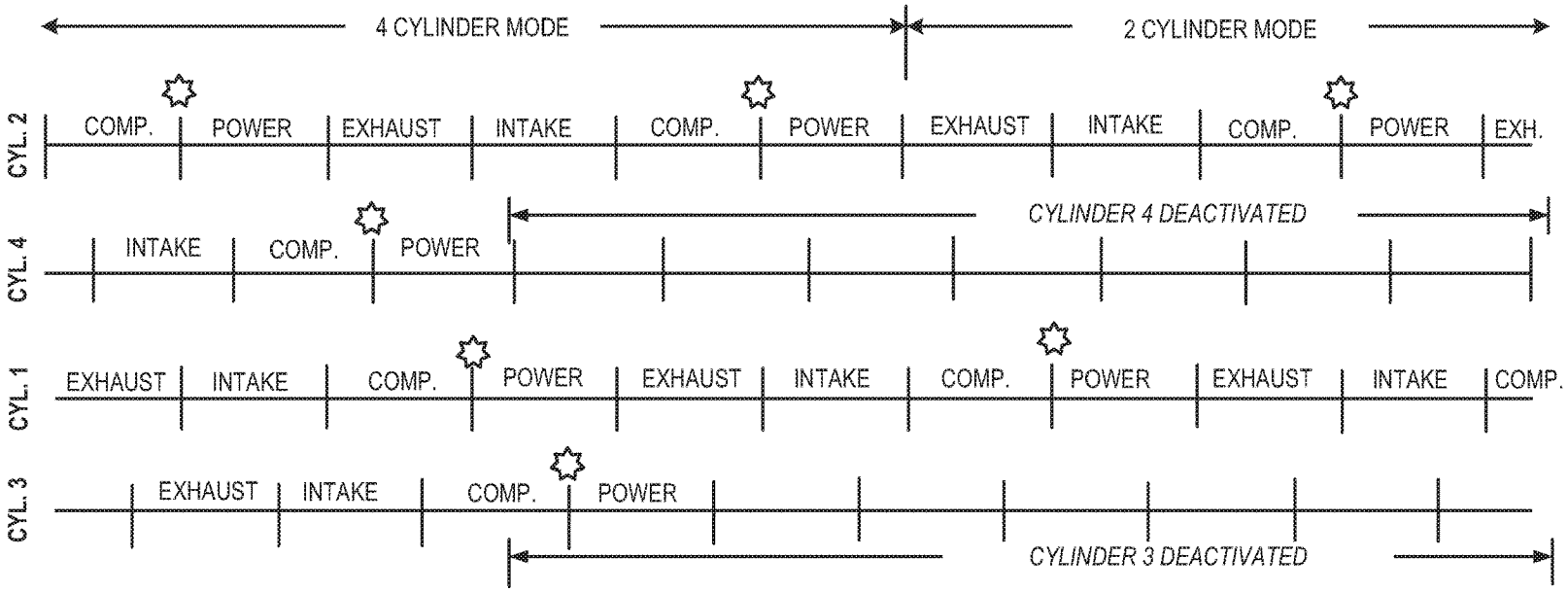

Another example transition from four-cylinder mode to two-cylinder mode is depicted in FIG. 14. This transition may be performed with a single, common solenoid triggering actuator systems in cylinders 3 and 4, as shown in the optional embodiment of FIG. 2*a*. Similar to FIG. 13, the left hand side of the diagram depicts the engine operating in full-cylinder mode with all cylinders activated and firing events in the engine occurring at unevenly spaced intervals. As described in reference to FIG. 13, the firing order in full-cylinder mode may be: 1-3-2-4 at the following CA degree intervals: 120-240-240-120. Further, intake and exhaust valves in cylinders 1, 3, and 4 may be actuated by their first intake and first exhaust cams respectively.

When a command to transition engine operation to two-cylinder mode is received, solenoid S2 may be actuated by CPS system 204 to deactivate cylinders 3 and 4. Further, cylinders 3 and 4 may be deactivated simultaneously. In response to the command, cam profiles may be switched such that intake valves and exhaust valves of cylinders 3 and 4 are now actuated by their respective second null cams. Switching between the first intake and exhaust cams and the second intake and exhaust null cams may be performed during either the compression or the power strokes within the cylinders. Therefore, cylinder 4 may be deactivated towards the end of the power stroke after a firing event within cylinder 4. Cylinder 3 may be deactivated at the same time as cylinder 4.

As explained earlier, deactivation of a cylinder may include actuating the intake and exhaust valves of the cylinder via their respective null cams, and disabling a fuel injector coupled to the cylinder. Spark, though, may continue to be provided within the deactivated cylinder. In alternate embodiments, spark may also be disabled after a desired firing event. As depicted in FIG. 14, cylinder 3 may be deactivated during its compression stroke. Since cylinder fueling may occur during an intake stroke or during an earlier portion of the compression stroke, fresh fuel with fresh intake air may be present within cylinder 3 when it is deactivated. Accordingly, when spark is supplied to cylinder 3 following deactivation in the compression stroke, a combustion (or firing) event can occur in cylinder 3 after deactivation. However, combusted gases may remain trapped within cylinder 3 (and cylinder 4) since the exhaust and intake valves remain closed during deactivation.

A sequence of events in engine 10 during the transition from non-VDE mode to two-cylinder mode may be described as: a first firing event in cylinder 2 followed after 240 CA degrees by a second firing event in cylinder 4. A third firing event may occur in cylinder 1 at 120 CA degrees after the second firing event in cylinder 4. Next, cylinders 4 and 3 may be deactivated. A fourth firing event may follow in cylinder 3 (post-deactivation) at 120 CA degrees after the third firing event in cylinder 1. As will be noted, this is the firing sequence in the four-cylinder mode. Next, cylinder 2 may be fired with a fifth firing event at 240 CA degrees after the fourth firing event. The fifth firing event may be followed by a sixth firing event in cylinder 1 at 360 CA degrees after the fifth firing event. Beyond this firing event, the engine may continue to operate in two-cylinder mode with even firing intervals of 360 CA degrees in two activated cylinders (cylinder 1 and cylinder 2). It will be observed that at least a 120 CA degree interval may be present between at least two successive firing events in the sequence described above. For example, the third and fourth firing events are separated by 120 CA degrees. Further, the above sequence of events may be possible with separate solenoids controlling each of cylinder 3 (or cylinder 35) and cylinder 4 (or cylinder 37). The timing of deactivation of each of cylinders 3 and 4 may substantially be the same as described above.

In this way, operation of a four cylinder engine may be transitioned from full-cylinder mode to a reduced two-cylinder mode. A method may comprise transitioning engine operation from the full-cylinder mode to the two-cylinder mode by deactivating a third cylinder and a fourth cylinder simultaneously. A first cylinder and a second cylinder may continue to be fired at even intervals wherein the even intervals are 360 crank angle degrees.

Figure 15:
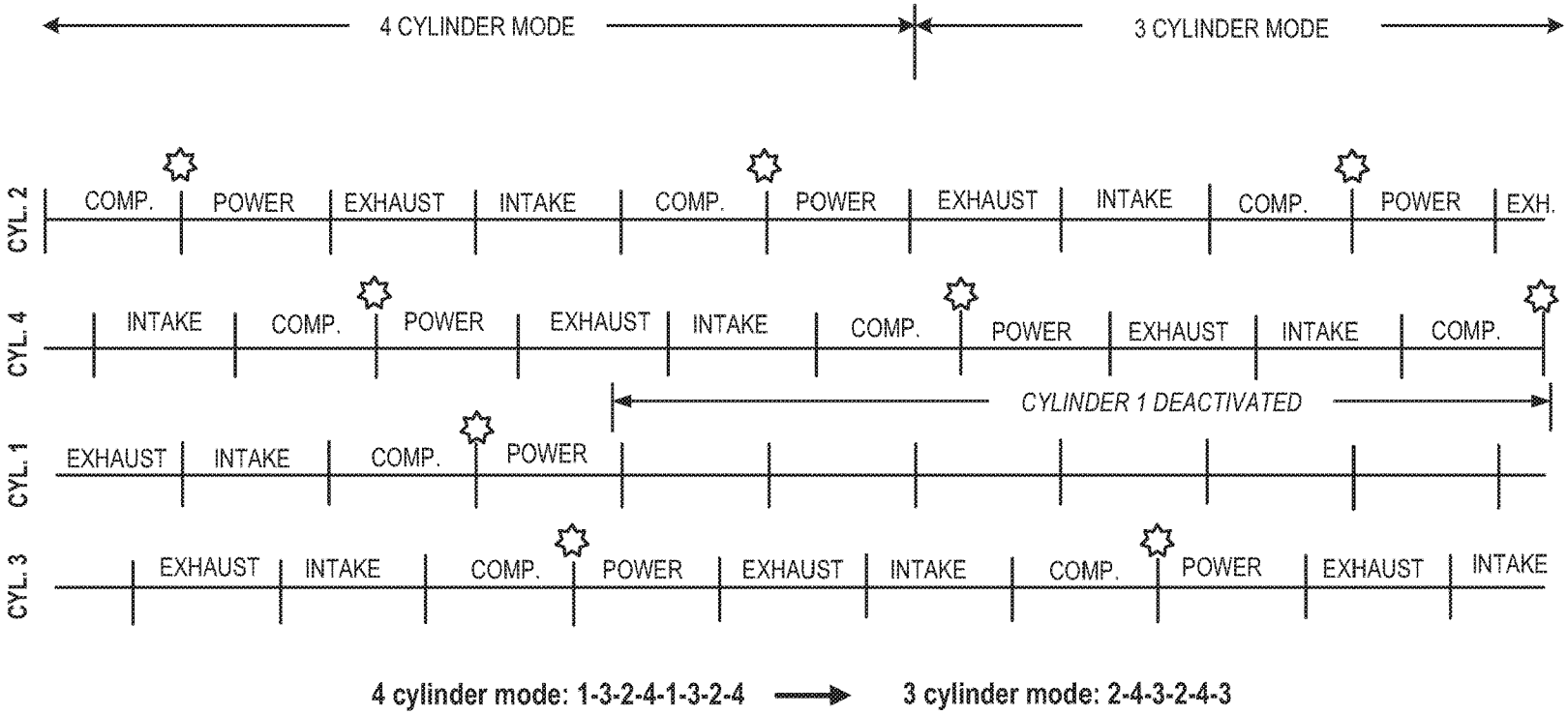

FIG. 15 is an example engine firing diagram illustrating a transition from four-cylinder (or non-VDE) mode to three-cylinder mode. The depicted example can be used in either the example optional embodiment of FIG. 2*b* wherein actuator systems of cylinder 3 (or cylinder 35) and cylinder 4 (or cylinder 37) are controlled by different solenoids e.g. S2 and S3 or in the example optional embodiment of FIG. 2*a* including a common solenoid actuating valves in cylinders 3 and 4.

At the left hand side of the diagram, the engine is shown operating in four-cylinder mode with all four cylinders activated and firing events in the engine occurring in an uneven mode. Specifically, cylinder 3 may be fired 120 CA degrees after a firing event in cylinder 1, cylinder 2 may be fired 240 CA degrees after the firing in cylinder 3, and cylinder 4 may be fired 240 CA degrees after the firing in cylinder 2. Cylinder 1 may be fired 120 CA degrees after firing cylinder 4. The firing order in full-cylinder mode may therefore be: 1-3-2-4 at the following intervals 120-240-240-120. Further, intake and exhaust valves in cylinders 1, 3, and 4 may be actuated by their first intake and first exhaust cams respectively.

When a command to transition engine operation to three-cylinder mode is received, solenoid S1 may be triggered by CPS system 204 to deactivate cylinder 1. In response to the command, cam profiles may be switched such that respective intake valves and exhaust valves in cylinder 1 are now actuated by their respective second intake null cams and second exhaust null cams. It will be appreciated that switching between the first intake and exhaust cams and the second intake and exhaust null cams may be performed during either the compression or the power strokes. Accordingly, cylinder 1 may be deactivated towards the end of a power stroke ensuing after a firing event in cylinder 1.

A sequence of events in engine 10 during the transition from non-VDE mode to three-cylinder mode may be described as: a first firing event in cylinder 2 followed after 240 CA degrees by a second firing event in cylinder 4. A third firing event may occur in cylinder 1 at 120 CA degrees after the second firing event in cylinder 4, and a fourth firing event may follow in cylinder 3. The fourth firing event in cylinder 3 may occur 120 CA degrees after the third firing event in cylinder 1. As will be noted, this is the firing sequence in the four-cylinder mode. Cylinder 1 may be deactivated towards the end of its power stroke which follows after the third firing event in cylinder 1. Next, cylinder 2 may be fired in a fifth firing event at 240 CA degrees after the fourth firing event. The fifth firing event may be followed by a sixth firing event in cylinder 4 at 240 CA degrees after the fifth firing event. A seventh firing event may occur in cylinder 3 at 240 CA degrees after the sixth firing event. Beyond this firing event, the engine may continue to operate in three-cylinder mode with even firing intervals of 240 CA degrees in the three activated cylinders (cylinders 2, 3, and 4). Further, the sequence of firing events during the transition may include a firing interval of at least 120 CA degrees. In this example, the shortest interval between two successive firing events is 120 CA degrees between the third and fourth firing events. The next shortest firing interval is 240 CA degrees (at least 120 CA degrees) between fourth and fifth firing events particularly after cylinder 1 is deactivated.

In this way, engine operation may be transitioned from full-cylinder or non-VDE mode to three-cylinder VDE mode. Thus, in another representation, a method for a four cylinder engine may comprise operating the engine in full-cylinder mode by activating all four cylinders and firing the four cylinders at uneven intervals, transitioning operation to three-cylinder mode by deactivating a first cylinder (cylinder 1), and firing remaining three activated cylinders at even intervals of 240 crank angle degrees. The first cylinder may be deactivated only after a power stroke in the first cylinder.

Another example method may comprise transitioning engine operation from the four-cylinder mode to the three-cylinder mode by deactivating the first cylinder and firing the second cylinder, the third cylinder, and the fourth cylinder at even intervals of 240 crank angle degrees. The method may further include deactivating the first cylinder only after firing the first cylinder.

Figure 16:
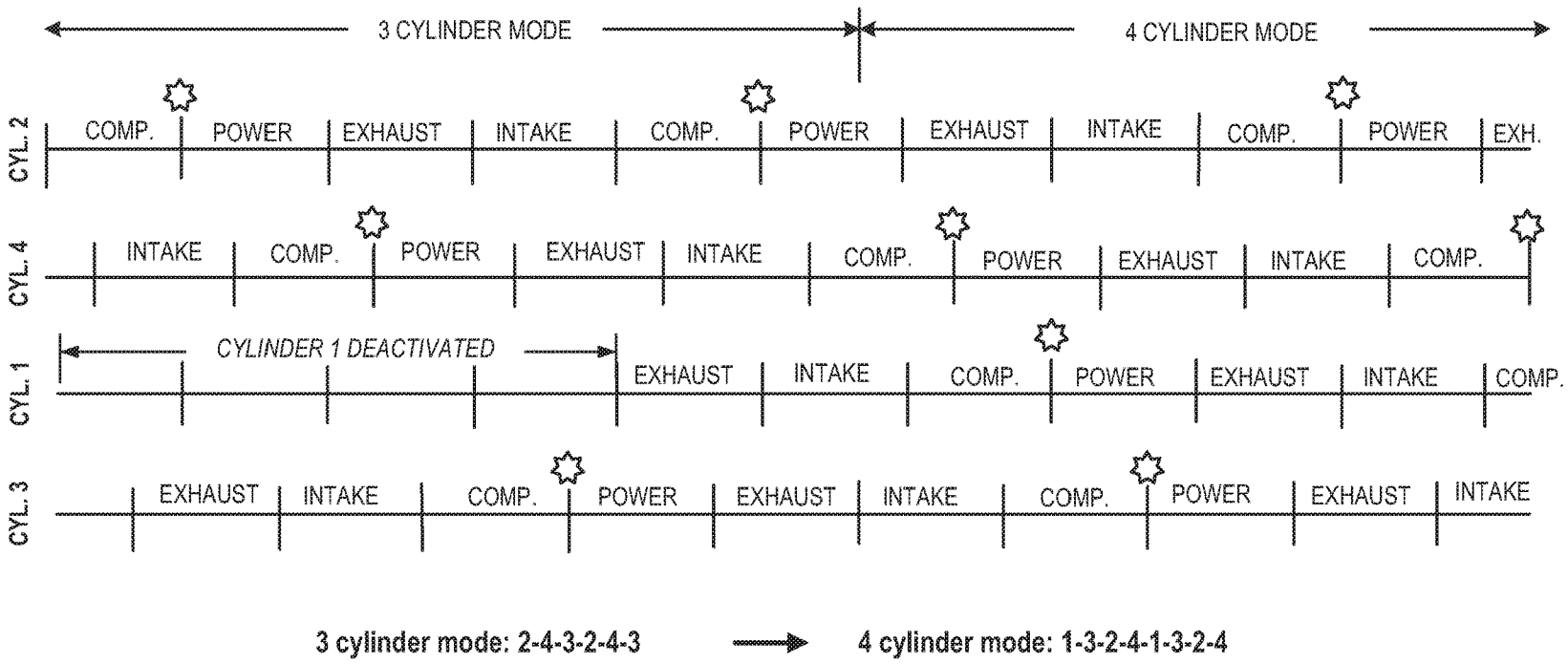

FIG. 16 is an example engine firing diagram illustrating a transition from three-cylinder mode to four-cylinder (or non-VDE) mode. The depicted example can be used in either the example optional embodiment of FIG. 2*b* or in the example optional embodiment of FIG. 2*a*.

At the left hand side of the diagram, the engine is shown operating in three-cylinder mode with cylinders 2, 3, and 4 activated and firing events in the engine occurring at evenly spaced 240 CA degree intervals. Further, cylinder 1 is deactivated by actuating the intake and exhaust valves via their respective second null cams. A firing sequence in the three-cylinder mode may be 2-4-3.

When a command to transition engine operation to four-cylinder mode is received, solenoid S1 may be triggered by CPS system 204 to activate cylinder 1. In response to the command, cam profiles may be switched such that respective intake valves and exhaust valves in cylinder 1 are now actuated by their respective first intake cams and first exhaust cams. Switching between the first intake and exhaust cams and the second intake and exhaust null cams may be performed only during either the compression or the power strokes. Accordingly, cylinder 1 may be activated towards the end of a power stroke (no combustion in cylinder 1 during deactivation). Further, any trapped gases may be expelled from cylinder 1 in the ensuing exhaust stroke.

A sequence of events in engine 10 during the transition may be described as: a first firing event in cylinder 2 followed after 240 CA degrees by a second firing event in cylinder 4. A third firing event may occur in cylinder 3 at 240 CA degrees after the second firing event in cylinder 4. As will be noted, this is the firing sequence in the three-cylinder mode. Cylinder 1 may be activated towards the end of its power stroke after the third firing event in cylinder 3. Next, cylinder 2 may be fired in a fourth firing event at 240 CA degrees after the third firing event. The fourth firing event may be followed by a fifth firing event in cylinder 4 at 240 CA degrees after the fourth firing event. Next, a sixth firing event may occur in cylinder 1 at 120 CA degrees after the fifth firing event in cylinder 4. Beyond this, the engine may continue to operate in full-cylinder mode with uneven firing intervals until another transition is commanded.

It will be observed that the sequence of firing events during the transition may include a firing interval of 240 CA degrees (greater than at least 120 CA degrees or at least 120 CA degrees) between successive firing events e.g. third and fourth firing events after cylinder 1 is activated.

In this way, engine operation may be transitioned from three-cylinder VDE mode to full-cylinder or non-VDE mode. Thus, in another representation, a method for a four cylinder engine may comprise operating the engine in three-cylinder mode by activating three cylinders and deactivating a first cylinder (cylinder 1). The three activated cylinders may be fired at even intervals of 240 crank angle degrees. Engine operation may be transitioned to four-cylinder mode by activating the first cylinder and firing the first cylinder midway between firing events in each of a fourth cylinder (cylinder 4) and a third cylinder (cylinder 3). Thus, the first cylinder may be fired at 120 CA degrees after a firing event in the fourth cylinder. In other words, the first cylinder may also be fired 120 CA degrees before a firing event in the third cylinder. The first cylinder may be activated after a power stroke (without preceding combustion) within the first cylinder. Further, the first cylinder may be activated immediately after a firing event in the third cylinder.

In another example, a method may comprise operating an engine with only four cylinders in a three-cylinder mode by deactivating a first cylinder and firing a second cylinder, a third cylinder, and a fourth cylinder 240 crank angle degrees apart, transitioning engine operation to a four-cylinder mode by activating the first cylinder, and firing the first cylinder between firing events in the fourth cylinder and the third cylinder. The method may further include firing the first cylinder between firing events in the fourth cylinder and the third cylinder such that the first cylinder is fired midway between firing events in the fourth cylinder and the third cylinder. Further, the first cylinder may be fired 120 crank angle degrees after firing the fourth cylinder and 120 crank angle degrees before firing the third cylinder. The method may also include activating the first cylinder immediately after a firing event in the third cylinder.

Figure 17:
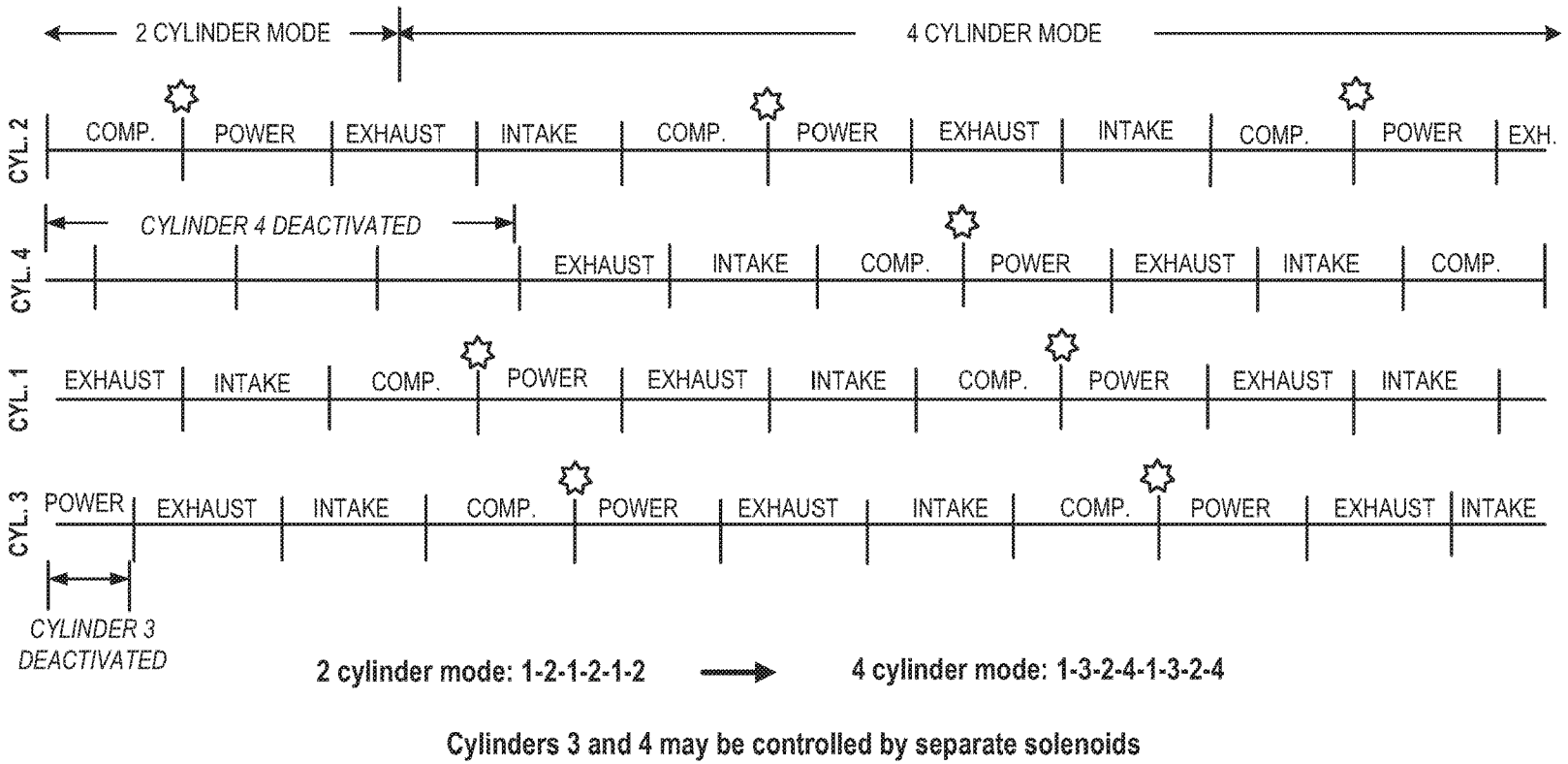

An example transition from two-cylinder mode to four-cylinder mode is depicted in FIG. 17. This transition includes using separate solenoids to control cylinder 3 and cylinder 4, as shown in the optional alternative embodiment of FIG. 2*b*. At the left hand side of the diagram, the engine is shown operating in two-cylinder mode with cylinders 1 and 2 activated and firing events in the engine occurring at 360 CA degree intervals. To elaborate, cylinders 1 and 2 may be fired 360 CA degrees apart in a firing order of 1-2-1-2. Further, cylinders 3 and 4 are deactivated by actuating the intake and exhaust valves of these cylinders via their respective second, null cams. Additionally, fuel injectors in cylinders 3 and 4 may be disabled. However, spark may continue to be provided to the two deactivated cylinders. Accordingly, without fresh air and unburned fuel in these deactivated cylinders, combustion may not occur.

When a command to transition engine operation to full-cylinder mode is received, solenoids S2 and S3 may be independently actuated by CPS system 204 to activate cylinders 3 and 4. In response to the command, cam profiles may be switched such that intake valves and exhaust valves of cylinders 3 and 4 are now actuated by first intake cams and first exhaust cams respectively. It will be appreciated that switching between the two cams may be performed during either the compression or the power strokes.

Cylinder 3 and cylinder 4 may be activated separately at different times via separate solenoids (e.g. S2 and S3). As depicted in FIG. 17, cylinder 3 may be activated via solenoid S2 towards the end of its power stroke (no combustion in cylinder 3 during deactivation). Meanwhile, cylinder 4 may be activated by solenoid S3 towards the end of its power stroke (no combustion previously in cylinder 4 during deactivation). Cylinders 3 and 4 may exhaust any trapped charges during their respective exhaust strokes following activation.

Therefore, a sequence of events in engine 10 during the transition from two-cylinder mode to non-VDE mode may include: activating cylinder 3 and triggering a first firing event in cylinder 2 followed by a second firing event in cylinder 1 at 360 CA degrees after the first firing event. Cylinder 4 may be activated in its power stroke, as explained above. A third firing event may occur in cylinder 3 at 120 CA degrees after the second firing event in cylinder 1. Next, cylinder 2 may be fired in a fourth firing event at 240 CA degrees after the third firing event. A fifth firing event may follow in cylinder 4 at 240 CA degrees after the fourth firing event in cylinder 2. Finally cylinder 1 may be fired at 120 CA degrees after the fifth firing event. Following this sequence, the engine may be fully transitioned to four-cylinder mode.

It will be noted that during the transition described above, successive firing events may include at least an interval of 120 CA degrees e.g. between second and third firing events.

In this way, engine operation may be transitioned from two-cylinder mode to four-cylinder mode. The method includes activating the third cylinder and the fourth cylinder sequentially, the third cylinder activated before the fourth cylinder, fueling and firing the third cylinder 120 crank angle degrees after a firing event in the first cylinder (second firing event), and fueling and firing the fourth cylinder 240 crank angle degrees after a firing event (fourth firing event) in the second cylinder.

In other words, transitioning engine operation from two-cylinder mode to full-cylinder mode may include activating the third cylinder and the fourth cylinder at different times, firing the third cylinder 120 crank angle degrees after firing the first cylinder, firing the second cylinder 240 crank angle degrees after firing the third cylinder, firing the fourth cylinder 240 crank angle degrees after firing the second cylinder, and firing the first cylinder 120 crank angle degrees after the fourth cylinder.

Figure 18:
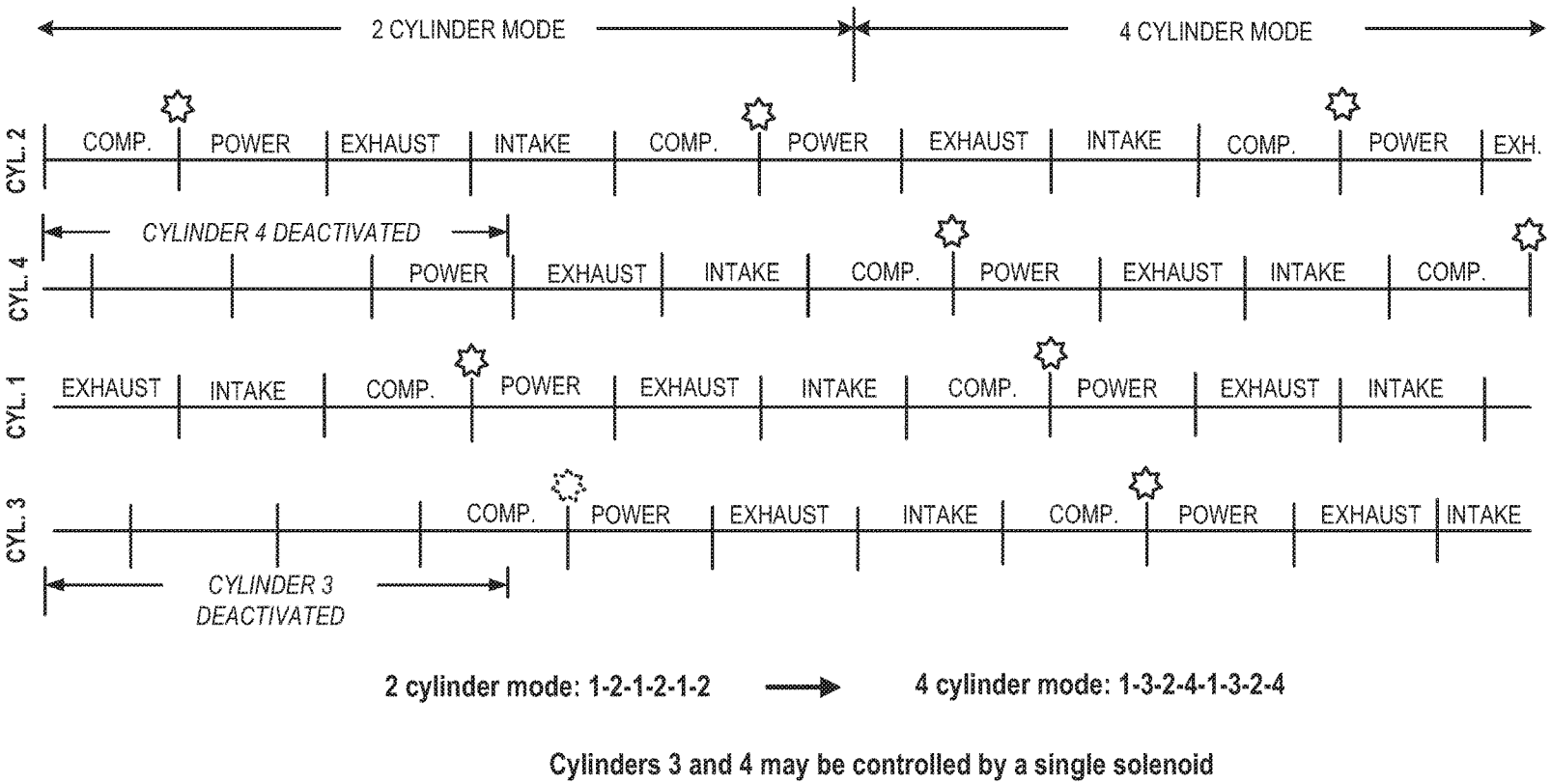

FIG. 18 depicts another example transition from two-cylinder mode to four-cylinder mode. In this example, a single, common solenoid (e.g. S2 in FIG. 2*a*) may be used to actuate intake and exhaust valves in each of cylinders 3 and 4. The engine, such as example engine 10, may be operating in two-cylinder mode (as shown towards the left hand side of FIG. 18) with even firing intervals of 360 CA degrees. Cylinders 3 and 4 may be deactivated and their intake valves and exhaust valves may be actuated by respective second intake null cams and second exhaust null cams.

When a command to transition to four-cylinder mode is received, the single solenoid e.g. S2, may be triggered to activate cylinders 3 and 4. In response to the command, cam profile switching may be activated by S2 such that intake valves and exhaust valves of cylinders 3 and 4 are now actuated by first intake cams and first exhaust cams respectively (instead of being actuated by second null cams). It will be appreciated that switching between the two cams may be performed during either the compression or the power strokes.

Cylinder 4 and cylinder 3 may be simultaneously activated such that cylinder 4 is activated towards the end of its power stroke and cylinder 3 is activated during a latter half of its compression stroke. Since fueling may occur either during a latter half of an intake stroke or during a former half of a compression stroke, activation in the latter half of the compression stroke does not result in fresh fuel being injected into cylinder 3. Consequently, a spark provided to cylinder 3 immediately after its activation may not initiate combustion. Therefore, this spark is denoted as a dotted spark in FIG. 18. Further, each of cylinders 3 and 4 may evacuate trapped air charges in their respective exhaust strokes that follow activation.

The sequence of events in engine 10 during the transition from two-cylinder mode to non-VDE mode may thus include: a first firing event in cylinder 2 followed by a second firing event in cylinder 1 at 360 CA degrees after the first firing event. A third firing event may occur in cylinder 2 at 360 CA degrees after the second firing event in cylinder 1. Next, cylinder 4 may be fired in a fourth firing event at 240 CA degrees after the third firing event. A fifth firing event may follow in cylinder 1 at 120 CA degrees after the fourth firing event in cylinder 4. Finally cylinder 3 may be fired in a sixth firing event at 120 CA degrees after the fifth firing event in cylinder 1. Following this sequence, the engine may be fully transitioned to four-cylinder mode.

The above described sequence of firing events may also be initiated with separate solenoids for cylinders 3 and 4. The timing of activation of each of cylinders 3 and 4 may substantially be the same as described above.

Further, as will be noted, the firing sequence comprises at least two successive events that include at least a 120 CA degree interval, e.g. fourth and fifth firing events, fifth and sixth firing events.

In this way, engine operation may be transitioned from two-cylinder mode to four-cylinder mode. The method includes activating the third cylinder and the fourth cylinder simultaneously after a firing event in the first cylinder, and fueling and firing the fourth cylinder 240 crank angle degrees after firing a second cylinder, the firing of the second cylinder occurring 360 crank angle degrees after the firing event in the first cylinder. Further, the first cylinder may be fired 120 crank angle degrees after firing the fourth cylinder, and the third cylinder may be fired 120 crank angle degrees after firing the first cylinder.

Engine operation transitions may be made with sequences different and distinct from those detailed in the present disclosure. It will be appreciated that sequences other than those detailed in the present disclosure may be used for engine operation transitions without departing from the scope of the present disclosure.

Figure 19:
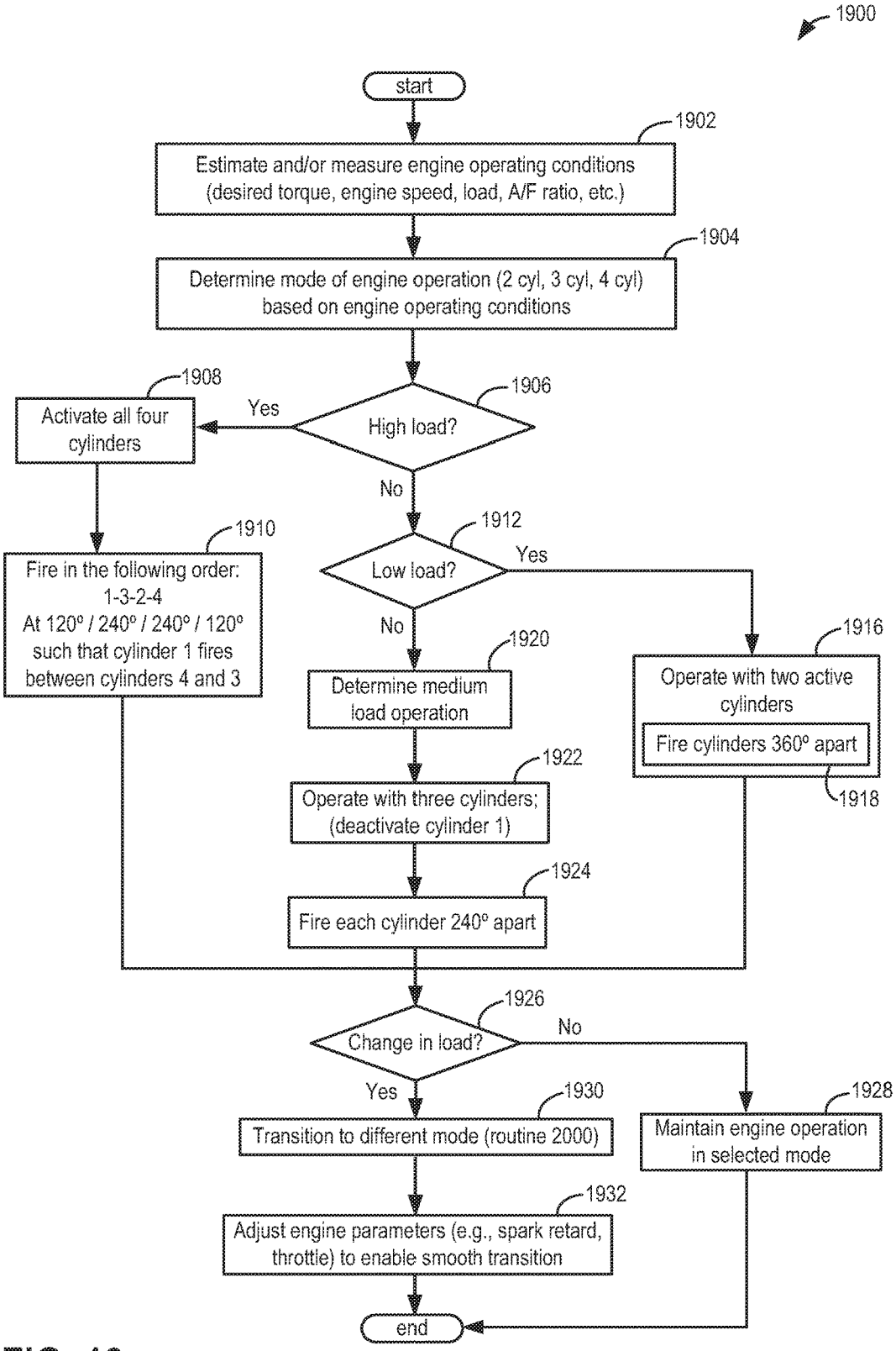
FIG. 19 depicts an example flowchart for selecting a VDE mode or non-VDE mode of operation based on engine operating conditions.

Turning now to FIG. 19, it shows an example routine 1900 for determining a mode of engine operation in a vehicle based on engine load. Specifically, a two-cylinder VDE mode, a three-cylinder VDE mode, or a non-VDE mode of operation may be selected based on engine loads. Further, transitions between these modes of operation may be determined based on changes in engine loads. Routine 1900 may be controlled by a controller such as controller 12 of engine 10.

At 1902, the routine includes estimating and/or measuring engine operating conditions. These conditions may include, for example, engine speed, engine load, desired torque (for example, from a pedal-position sensor), manifold pressure (MAP), mass air flow (MAF), boost pressure, engine temperature, spark timing, intake manifold temperature, knock limits, etc. At 1904, the routine includes determining a mode of engine operation based on the estimated engine operating conditions. For example, engine load may be a significant factor to determine engine mode of operation which includes two-cylinder VDE mode, three-cylinder VDE mode or non-VDE mode (also termed full-cylinder mode). In another example, desired torque may also determine engine operating mode. A higher demand for torque may include operating the engine in non-VDE or four-cylinder mode. A lower demand for torque may enable a transition of engine operation to a VDE mode. As elaborated earlier in reference to FIG. 8, in particular Map 840, a combination of engine speed and engine load conditions may determine engine mode of operation.

At 1906, therefore, routine 1900 may determine if high (or very high) engine load conditions exist. For example, the engine may be experiencing higher loads as the vehicle ascends a steep incline. In another example, an air-conditioning system may be activated thereby increasing load on the engine. If it is determined that high engine load conditions exist, routine 1900 continues to 1908 to activate all cylinders and operate in the non-VDE mode. In the example of engine 10 of FIGS. 1, 2*a*, 2*b*, and 4, all four cylinders may be operated during the non-VDE mode. As such, a non-VDE mode may be selected during very high engine loads and/or very high engine speeds.

Further, at 1910, the four cylinders may be fired in the following sequence: 1-3-2-4 with cylinders 2, 3, and 4 firing about 240 CA degrees apart, and cylinder 1 firing about halfway between cylinder 4 and cylinder 3. As described earlier, when all cylinders are activated, a first cylinder (cylinder 3) may be fired at 120 degrees of crank rotation after cylinder 1, a second cylinder (cylinder 2) may be fired at 240 degrees of crank rotation after firing the first cylinder, a third cylinder (cylinder 4) may be fired at 240 degrees of crank rotation after firing the second cylinder, and a fourth cylinder (cylinder 1) may be fired at 120 degrees of crank rotation after firing the third cylinder. Routine 1900 may then proceed to 1926.

If at 1906, it is determined that high engine load conditions do not exist, routine 1900 progresses to 1912 where it may determine if low engine load conditions are present. For example, the engine may be operating at a light load when cruising on a highway. In another example, lower engine loads may occur when the vehicle is descending an incline. If low engine load conditions are determined at 1912, routine 1900 continues to 1916 to operate the engine in a two-cylinder VDE mode. Additionally, at 1918, the two activated cylinders (cylinders 1 and 2) may be fired at 360 crank angle degree intervals. Routine 1900 may then proceed to 1926.

If it is determined at 1912 that low engine load conditions are not present, routine 1900 progresses to 1920 where it may determine medium engine load operation. Next, at 1922, the engine may be operated in a three-cylinder VDE mode wherein cylinder 1 may be deactivated and cylinders 2, 3, and 4 may be activated. Further, at 1924, the three activated cylinders may be fired 240 crank angle degrees apart such that the engine experiences combustion events at 240 crank angle degree intervals.

Once an engine operating mode is selected and engine operation in selected mode is commenced (e.g., at one of 1910, 1916 or 1924), routine 1900 may determine at 1926 if a change in engine load is occurring. For example, the vehicle may complete ascending the incline to reach a more level road thereby reducing the existing high engine load to a moderate load (or low load). In another example, the air-conditioning system may be deactivated. In yet another example, the vehicle may accelerate on the highway to pass other vehicles so that engine load may increase from a light load to a moderate or high load. If it is determined at 1926 that a change in load is not occurring, routine 1900 continues to 1928 to maintain engine operation in the selected mode. Else, engine operation may be transitioned at 1930 to a different mode based on the change in engine load. Mode transitions will be described in detail in reference to FIG. 20 which shows an example routine 2000 for transitioning from an existing engine operation mode to a different operation mode based on determined engine loads.

At 1932, various engine parameters may be adjusted to enable a smooth transition and reduce torque disturbance during transitions. For example, it may be desired to maintain a driver-demanded torque at a constant level before, during, and after the transition between VDE operating modes. As such, when cylinders are reactivated, the desired air charge and thus the manifold pressure (MAP) for the reactivated cylinders may decrease (since a larger number of cylinders will now be operating) to maintain constant engine torque output. To attain the desired lower air charge, the throttle opening may be gradually reduced during the preparing for transition. At the time of the actual transition, that is, at the time of cylinder reactivation, the throttle opening may be substantially reduced to attain the desired airflow. This allows the air charge to be reduced during the transition without causing a sudden drop in engine torque, while allowing the air charge and MAP levels to be immediately reduced to the desired level at the onset of cylinder reactivation. Additionally or alternatively, spark timing may be retarded to maintain a constant torque on all the cylinders, thereby reducing cylinder torque disturbances. When sufficient MAP is reestablished, spark timing may be restored and throttle position may be readjusted. In addition to throttle and spark timing adjustments, valve timing may also be adjusted to compensate for torque disturbances. Routine 1900 may end after 1932.

It should be noted that when the relative speed (or loads or other such parameters) is indicated as being high or low, the indication refers to the relative speed compared to the range of available speeds (or loads or other such parameters, respectively). Thus, low engine loads or speeds may be lower relative to medium and higher engine loads and speeds, respectively. High engine loads and speeds may be higher relative to medium (or moderate) and lower engine loads and speeds respectively. Medium or moderate engine loads and speeds may be lower relative to high or very high engine loads and speeds, respectively. Further, medium or moderate engine loads and speeds may be greater relative to low engine loads and speeds, respectively.

Figure 20:
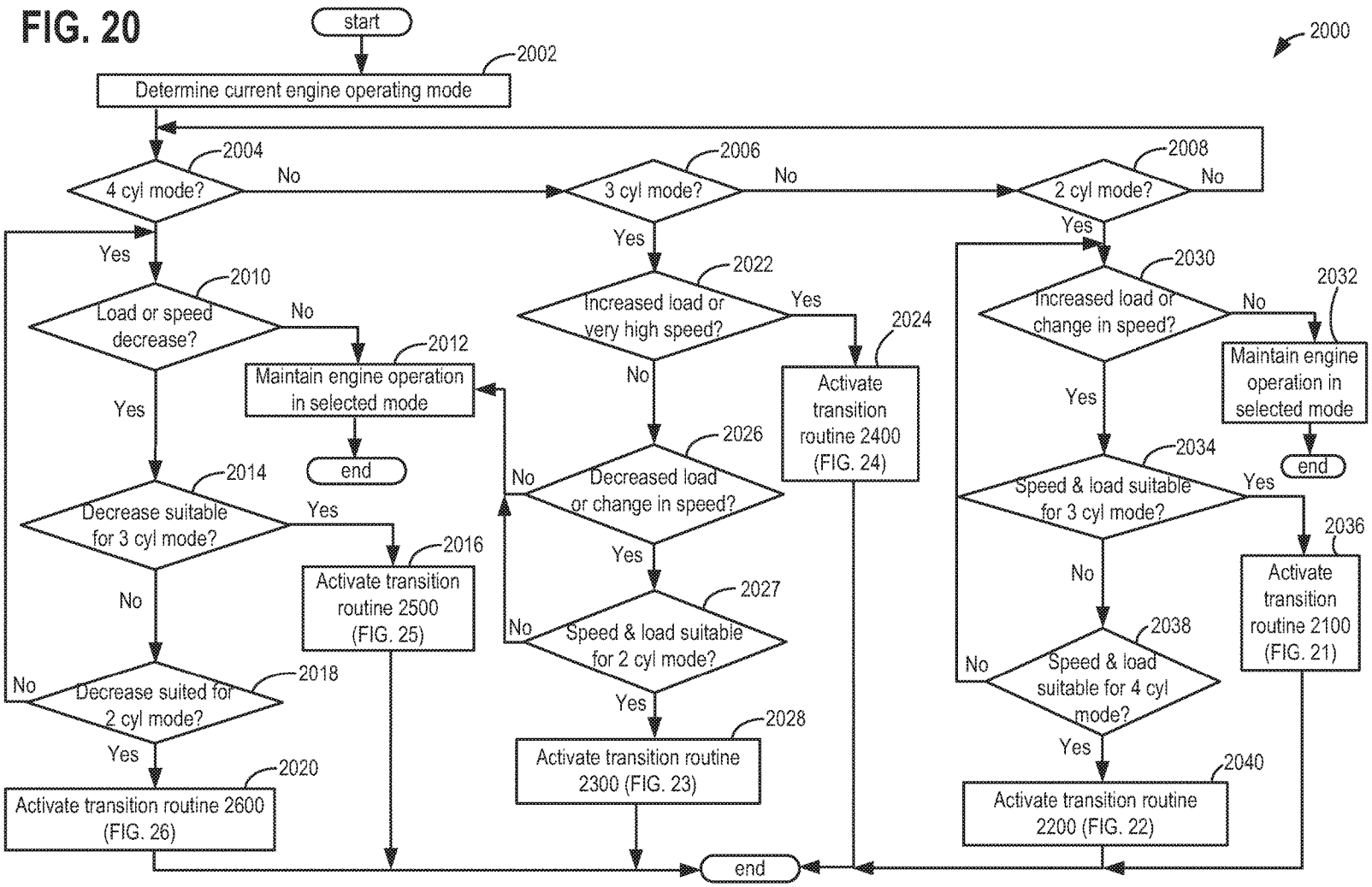
FIG. 20 portrays an example flowchart for transitions between different engine modes based on engine operating conditions.

Turning now to FIG. 20, routine 2000 for determining transitions in engine operating modes based on engine load and engine speed conditions is described. Specifically, the engine may be transitioned from a non-VDE mode to one of two VDE modes and vice versa, and may also be transitioned between the two VDE modes.

At 2002, the current operating mode may be determined. For example, the four-cylinder engine may be operating in a non-VDE full cylinder mode, a three-cylinder VDE mode, or a two-cylinder VDE mode. At 2004, it may be determined if the engine is operating in the four-cylinder mode. If not, routine 2000 may move to 2006 to determine if the current mode of engine operation is the three-cylinder VDE mode. If not, routine 2000 may determine at 2008 if the engine is operating in the two-cylinder VDE mode. If not, routine 2000 returns to 2004.

At 2004, if it is confirmed that a non-VDE mode of engine operation is present, routine 2000 may continue to 2010 to confirm if engine load and/or engine speed have decreased. If the existing engine operating mode is a non-VDE mode with all four cylinders activated, the engine may be experiencing high or very high engine loads. In another example, a non-VDE mode of engine operation may be in response to very high engine speeds. Thus, if the engine is experiencing high engine loads to operate in a non-VDE mode, a change in operating mode may occur with a decrease in load. A decrease in engine speed may also enable a transition to a VDE mode. An increase in engine load or speed may not change operating mode.

If it is confirmed that a decrease in load and/or speed has not occurred, at 2012, the existing engine operating mode may be maintained and routine 2000 ends. However, if it is determined that a decrease in engine load and/or speed has occurred, routine 2000 progresses to 2014 to determine if the decrease in engine load and/or speed makes it suitable to operate in three-cylinder mode. As described earlier in reference to Map 840 of FIG. 8, a transition to moderate load-moderate speed conditions, and to moderate load-high speed conditions may enable engine operation in three-cylinder VDE mode. It will be appreciated that a transition to three-cylinder VDE mode may also occur during low speed-low load conditions, as shown in Map 840 of FIG. 8. Accordingly, if it is confirmed that existing load and/or speed conditions enable a transition to three-cylinder mode, at 2016, transition routine 2500 may be activated. Routine 2500 of FIG. 25 may enable a transition to three-cylinder VDE mode from non-VDE mode. Routine 2500 will be further described in reference to FIG. 25 below. Routine 2000 may then end.

If at 2014 it is determined that the decrease in engine load and/or engine speed is not suitable for operating in three-cylinder mode, routine 2000 continues to 2018 to confirm that the decrease in engine load and/or engine speed enables engine operation in two-cylinder mode. As depicted in Map 840 of FIG. 8, low engine loads with moderate engine speeds may enable a two-cylinder VDE mode. If the engine load and/or engine speed are not suited for the two-cylinder mode, routine 2000 returns to 2010. Else, at 2020 transition routine 2600 may be activated. As will be described in reference to FIG. 26, routine 2600 may enable a transition to two-cylinder VDE mode from non-VDE mode. Routine 2000 may then end.

Returning to 2006, if it is confirmed that the current engine operating mode is the three-cylinder VDE mode, routine 2000 continues to 2022 to determine if engine load has increased or if the engine speed is very high. If the existing operating mode is the three-cylinder mode, the engine may have previously experienced moderate load-moderate speed conditions, or moderate load-high speed conditions. Alternatively, the engine may be at low load-low speed conditions. Therefore, a transition from the existing mode may occur with an increase in engine load or a significant increase in engine speed. As shown in map 840 of FIG. 8, if the engine speed is very high, engine operation may occur in full-cylinder mode. Thus, if an increase in engine load and/or very high engine speed is confirmed at 2022, routine 2000 progresses to 2024 to activate transition routine 2400. Herein, a transition may be made from three-cylinder mode to non-VDE mode. Further details will be explained in reference to FIG. 24.

If an increase in engine load and/or very high engine speed is not determined at 2022, routine 2000 may confirm at 2026 if a decrease in engine load or a change in engine speed has occurred. As explained earlier, if the engine had previously been operating at moderate load-moderate speed conditions, a decrease in load may enable a transition to two-cylinder VDE mode. In another example, a transition to two-cylinder VDE mode may also be initiated if an existing low load-low speed condition changes to a low load-moderate speed condition. In yet another example, a transition from a low load-high speed condition to a low load-moderate speed condition may also enable engine operation in two-cylinder VDE mode. If the change in speed and/or decrease in load is not determined, routine 2000 progresses to 2012 where the existing engine operating mode may be maintained. However, if a decrease in engine load or a change in engine speed is confirmed, routine 2000 continues to 2027 to determine if the changes in speed and/or the decrease in load are suitable for engine operation in two-cylinder mode. For example, the controller may determine if the existing speed and/or load fall within zone 826 of Map 840 in FIG. 8. If yes, transition routine 2300 may be activated at 2028. Herein, routine 2300 may enable transition of engine operation to two-cylinder VDE mode. Further details regarding routine 2300 will be elaborated in reference to FIG. 23. If the decrease in engine load and/or change in engine speed do not enable operation in two-cylinder mode, routine 2000 continues to 2012 where the existing engine operating mode may be maintained.

Returning to 2008, if it is confirmed that the current engine operating mode is the two-cylinder VDE mode, routine 2000 continues to 2030 to determine if engine load has increased or if engine speed has changed. If the existing operating mode is the two-cylinder mode, the engine may have previously experienced low to moderate engine loads at moderate engine speeds. Therefore, a transition from the existing mode may occur with an increase in engine load. A decrease in load may not change the engine operating mode. Further, a change from the existing mode may also occur if engine speed decreases to low speed or increases to high (or very high) speed. If an increase in engine load and/or a change in engine speed is not confirmed at 2030, routine 2000 progresses to 2032 to maintain the existing two-cylinder VDE mode.

If an increase in engine load and/or a change in engine speed is confirmed at 2030, routine 2000 may continue to 2034 to determine if the engine load and/or engine speed enable a transition to three-cylinder VDE mode. For example, engine load may be at moderate levels to enable transition to three-cylinder VDE mode. If yes, routine 2100 of FIG. 21 may be activated at 2036 to transition engine operation to three-cylinder VDE mode. Transition routine 2100 will be further elaborated in reference to FIG. 21 below.

If the engine load and/or engine speed are not suitable for engine operation in three-cylinder mode, routine 2000 may continue to 2038 to determine if the engine load and/or engine speed enable engine operation in four-cylinder mode. For example, engine load may be very high. In another example, engine speed may be very high. If yes, at 2040, transition routine 2200 may be activated. Routine 2200 may enable transition of engine operation to non-VDE mode. As such, routine 2200 will be further elaborated in reference to FIG. 22 below. Routine 2000 may then end. If the increase in engine load and/or change in speed is not sufficient to operate the engine in full-cylinder mode, routine 2000 may return to 2030.

Thus, a controller may determine engine operating modes based on the existing combination of engine speed and engine load. A map, such as example Map 840, may be utilized to decide engine mode transitions. In addition, as described earlier in reference to FIG. 4, mapped data regarding signals to active mounts may also be utilized to determine input functions for active mounts based on engine mode transitions. These transitions will be further described in reference to FIGS. 21-26.

It will be appreciated that routines 2100-2600 incorporate references to the example engine 10 with four cylinders as depicted in FIGS. 2*a* and 2*b*. Further, as noted earlier in reference to FIGS. 5-7, cylinder 31 may correspond to cylinder 1, cylinder 33 may correspond to cylinder 2, cylinder 35 may correspond to cylinder 3, and cylinder 37 may correspond to cylinder 4. Further still, each routine may describe alternative transitions based on whether the example engine embodiments includes a single common solenoid or separate solenoids for cylinders 3 and 4 (optional embodiments in FIGS. 2*a* and 2*b* respectively).

It will be noted that engine load conditions as mentioned in this disclosure are relative. As such, low engine load conditions may include conditions where engine load is lower than each of medium engine loads and high (or higher) engine loads. Medium engine loads include conditions where engine load is greater than low load conditions, but lower than high (or higher) load conditions. High or very high engine load conditions include engine loads that may be higher than each of medium and low (or lower) engine loads.

Figure 21:
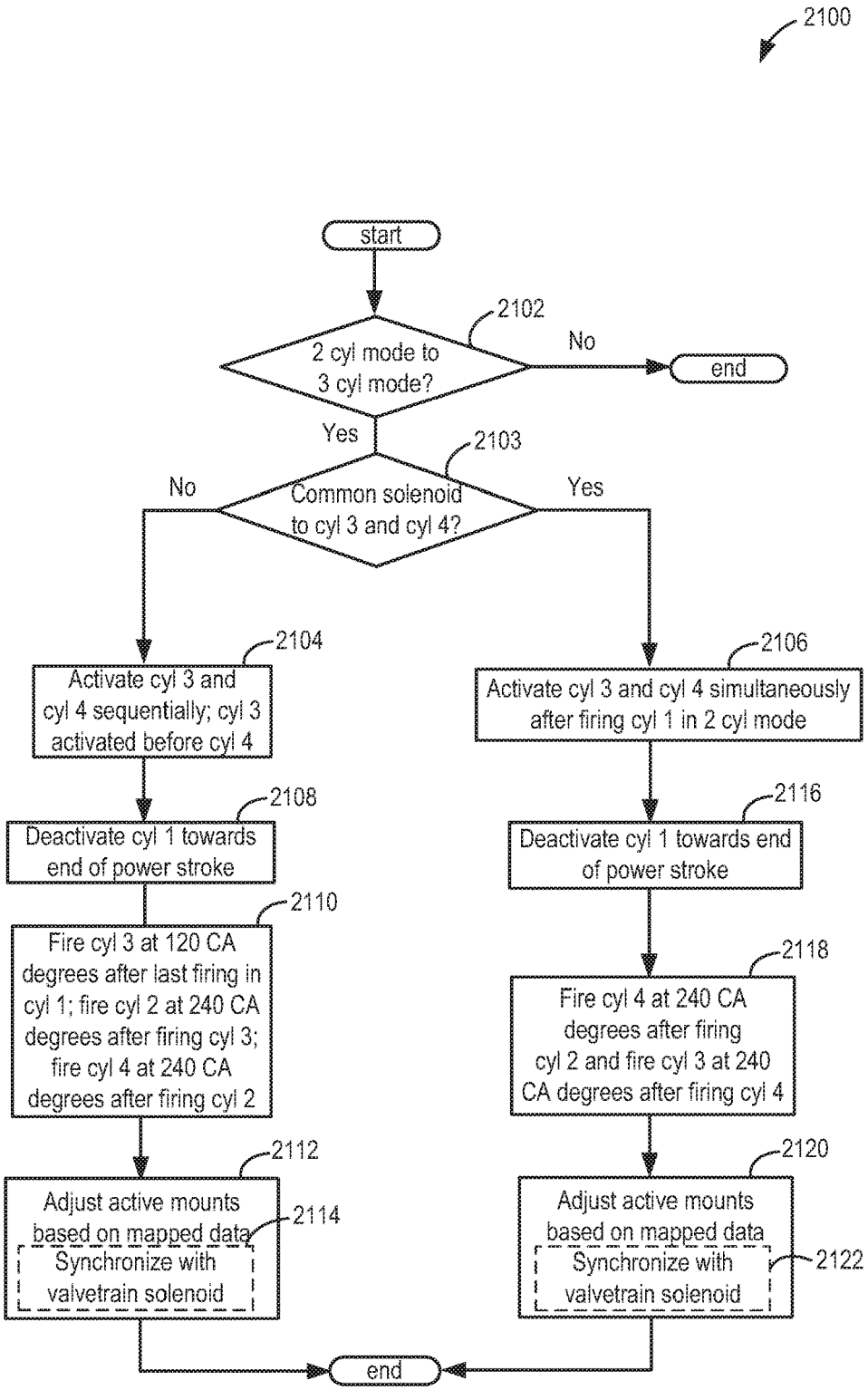
FIG. 21 depicts an example flowchart illustrating a transition in engine operation from two-cylinder to three-cylinder mode.

Turning now to FIG. 21, it illustrates routine 2100 for transitioning engine operation from a two-cylinder mode to a three-cylinder mode. Specifically, transition sequences including activation and/or deactivation and firing events in various cylinders is described. Transition sequences may be based on the presence of either a common solenoid or separate solenoids to actuate intake and exhaust valves in cylinders 3 and 4.

At 2102, routine 2100 may confirm that the impending transition in engine operation is from a two-cylinder mode to a three-cylinder mode. If not, routine 2100 ends. Else, routine 2100 progresses to 2103 to determine if the existing engine embodiment includes a common, single solenoid for cylinders 3 and 4. If yes, routine 2100 continues to 2106 to activate cylinders 3 and 4 simultaneously after a first firing event in cylinder 1 when in two-cylinder mode. Activation of cylinders 3 and 4 may include actuating their intake and exhaust valves via their respective first intake cams and first exhaust cams. Further, fuel injection into these cylinders may also be enabled. It will be noted that it may be possible to activate cylinders 3 and 4 simultaneously even when intake and exhaust valves in cylinders 3 and 4 are actuated by separate solenoids, as in the embodiment of FIG. 2*b*.

As described earlier in reference to FIG. 9, cylinder 4 may be activated towards the end of its power stroke while cylinder 3 is activated in a latter half of its compression stroke. Next, at 2116, cylinder 1 may be deactivated towards the end of its power stroke after the first firing event. Deactivation includes actuating the intake and exhaust valves of cylinder 1 via their respective second null cams.

At 2118, cylinder 4 may be fired at 240 CA degrees after a second firing event in cylinder 2, the second firing event following the first firing event in cylinder 1. Further, cylinder 3 may be fired at 240 CA degrees after firing cylinder 4. In this way, a transition to three-cylinder mode with cylinders 2, 3, and 4 firing at evenly spaced 240 CA degree intervals is attained.

At 2120, active mounts coupled to the engine may be adjusted based on mapped data. For example, each transition may generate specific vibration frequencies in the engine that may be transferred to the active mounts. Consequently, active mounts may be triggered with individual inputs to respond to and counter these specific vibration frequencies. Therefore, each transition may demand a distinct input function to the active mounts. By mapping these vibration frequencies and storing individual respective responses in a controller's memory, a specific signal may be provided to the active mounts based on which transition is occurring. Thus, at 2120, the controller may signal the active mounts to provide an input function based on previously mapped data for engine transitions from two-cylinder mode to three-cylinder mode when cylinders 3 and 4 are activated simultaneously.

Further, at 2122, signals to the active mounts may be synchronized with signals to the solenoids operatively coupled to actuating systems in cylinders 1, 3, and 4. In one example, active mounts may be actuated when a signal to activate cylinders 3 and 4 is received at solenoid S2 of FIG. 2*a*. Specifically, the active mounts may be synchronized with the actuation of solenoid S2. Further, a different input function may be provided to the active mounts when cylinder 1 is deactivated. Herein, active mounts may be triggered in a synchronized manner with the actuation of solenoid S1 of FIG. 2*a*.

Returning to 2103, if the existing engine embodiment is determined to not include a common, single solenoid for cylinders 3 and 4, routine 2100 continues to 2104 where cylinder 3 and cylinder 4 may be activated sequentially. Herein, the engine embodiment may include distinct and separate solenoids for controlling intake and exhaust valves in cylinders 3 and 4 (e.g. S2 and S3 of optional engine embodiment FIG. 2*b*). Specifically, activation of cylinder 3 may precede cylinder 4, as described earlier in reference to FIG. 10. Further, each of cylinder 3 and cylinder 4 may be activated towards the end of their respective power strokes.

Next, at 2108, cylinder 1 may be deactivated towards the end of a power stroke ensuing after a combustion event in cylinder 1. At 2110, cylinder 3 may be fired at 120 CA degrees after the combustion event (or firing event) in cylinder 1. Additionally, cylinder 2 may be fired at 240 CA degrees after firing cylinder 3, and cylinder 4 may be fired at 240 CA degrees after firing cylinder 2. Thus, a three-cylinder mode may be achieved. Further, at 2112, active mounts coupled to the engine may be actuated based on mapped data in the controller for a transition from two-cylinder mode to three-cylinder mode with separate solenoids. Specifically, at 2114, the adjusting of active mounts may be synchronized with the actuation of the valvetrain solenoids, e.g. S1, S2, and S3. Therefore, in one example, active mounts may provide a first input function when solenoid S2 is triggered to activate cylinder 3. The active mounts may be actuated to provide a second input function when solenoid S3 is triggered to activate cylinder 4. Eventually, the active mounts may provide a third distinct input function when solenoid S1 is triggered to deactivate cylinder 1.

The sequence described above with separate solenoids for cylinders 3 and 4 may result in increased NVH due to the firing of cylinder 3 within 120 CA degree interval of firing cylinder 1. Therefore, additional adjustments to one or more of the active mounts, throttle position, and spark timing may be used to enable a smoother transition.

Thus, an example method for transitioning from the two-cylinder mode to the three-cylinder mode may include deactivating the first cylinder after a firing event, activating the third cylinder and the fourth cylinder simultaneously after the firing event in the first cylinder, firing the second cylinder 360 crank angle degrees after the firing event in the first cylinder, firing the fourth cylinder 240 crank angle degrees after firing the second cylinder, and firing the third cylinder 240 crank angle degrees after firing the fourth cylinder.

Figure 22:
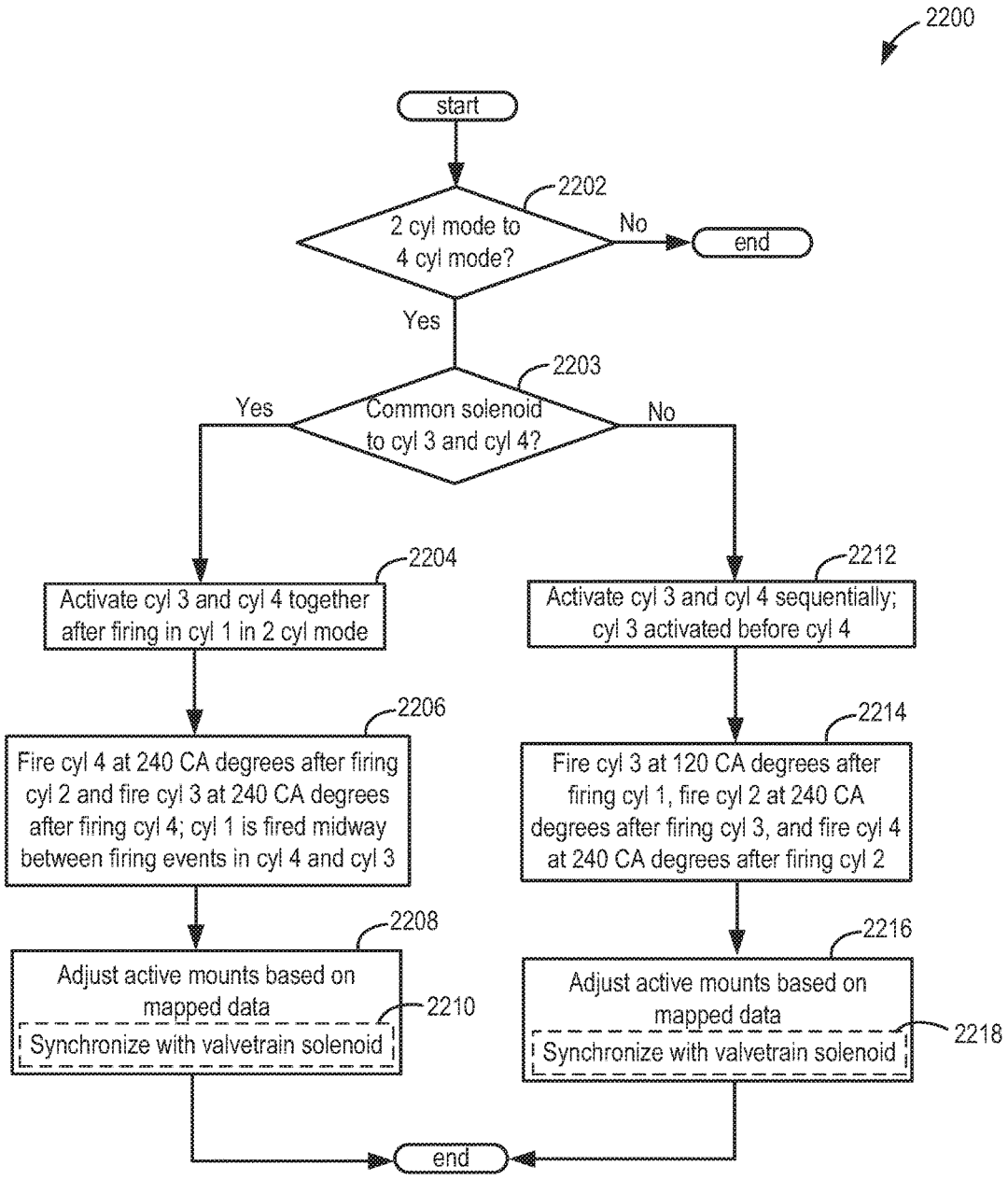
FIG. 22 portrays an example flowchart depicting a transition from two-cylinder mode to full-cylinder mode.

Turning now to FIG. 22, it illustrates routine 2200 for transitioning engine operation from a two-cylinder mode to a four-cylinder mode. Specifically, transition sequences including activation and/or deactivation and firing events in various cylinders is described. Transition sequences may be based on the presence of either a common solenoid or separate solenoids to actuate intake and exhaust valves in cylinders 3 and 4.

At 2202, routine 2200 may confirm that the impending transition in engine operation is from a two-cylinder mode to a full-cylinder or four-cylinder mode. If not, routine 2200 ends. Else, routine 2200 progresses to 2203 to determine if the existing engine embodiment includes a common, single solenoid for cylinders 3 and 4. If yes, routine 2200 continues to 2204 to activate cylinders 3 and 4 simultaneously after a first firing event in cylinder 1 when in two-cylinder mode. Activation of cylinders 3 and 4 may include actuating their intake and exhaust valves via their respective first intake cams and first exhaust cams. Further, fuel injection into these cylinders may also be enabled. As described earlier in reference to FIG. 18, cylinder 4 may be activated towards the end of its power stroke while cylinder 3 is activated in a latter half of its compression stroke.

Next, at 2206, cylinder 4 may be fired 240 CA degrees after a firing event in cylinder 2. As such, the firing event in cylinder 2 may ensue 360 CA degrees after a first firing event in cylinder 1. Further, cylinder 3 may be fired 240 CA degrees after firing cylinder 4. Further still, cylinder 1 may be fired midway between firing events in cylinder 4 and cylinder 3. Thus, operation of engine 10 may now in four-cylinder mode with the following sequence: 1-3-2-4 with firing intervals of 120-240-240-120.

It will be noted that the sequence of transition described above will also be possible when cylinders 3 and 4 are actuated by two separate solenoids. To elaborate, cylinders 3 and 4 may be activated simultaneously even when they are coupled to two separate solenoids.

At 2208, active mounts coupled to the engine may be adjusted based on mapped data. For example, the transition from two-cylinder mode to four-cylinder mode with the specified order of activating cylinder 3 and cylinder 4 may generate certain vibration frequencies in the engine that may be transferred to the active mounts. Consequently, active mounts may be triggered with individual inputs learned from previously mapped data to respond to and counter these specific vibration frequencies. Further, at 2210, signals to the active mounts may be synchronized with signals to the single, common solenoid (e.g. S2 in FIG. 2*a*) operatively coupled to actuating systems in cylinders 3 and 4.

An example method for transitioning from the two-cylinder mode to the four-cylinder mode may comprise activating the third cylinder and the fourth cylinder simultaneously after a firing event in the first cylinder, firing the second cylinder 360 crank angle degrees after the firing event in the first cylinder, firing the fourth cylinder 240 crank angle degrees after firing the second cylinder, firing the first cylinder 120 crank angle degrees after firing the fourth cylinder, and firing the third cylinder 120 crank angle degrees after firing the first cylinder. One or more active mounts may be actuated to counter vibrations resulting from the above transition sequence.

Returning to 2203, if the existing engine embodiment is determined to not include a common, single solenoid for cylinders 3 and 4, routine 2200 continues to 2212 where cylinder 3 and cylinder 4 may be activated sequentially. Herein, the engine embodiment may include distinct and separate solenoids (e.g. S2 and S3 of optional engine embodiment FIG. 2*b*) for controlling intake and exhaust valves in cylinders 3 and 4. Specifically, cylinder 3 may be activated before cylinder 4 via separate solenoids, as described earlier in reference to FIG. 17. Further, each of cylinder 3 and cylinder 4 may be activated towards the end of their respective power strokes.

Next, at 2214, cylinder 3 may be fired 120 CA degrees after firing cylinder 1. Further, cylinder 2 may be combusted at 240 CA degrees after firing cylinder 3, and cylinder 4 may be fired at 240 CA degrees after firing cylinder 2. As depicted in FIG. 17, cylinder 1 may be fired again at 120 CA degrees after firing cylinder 4. Thus, a four-cylinder mode may be achieved.

Further, at 2216, active mounts coupled to the engine may be actuated based on mapped data in the controller for a transition from two-cylinder mode to full-cylinder mode with separate solenoids. Specifically, at 2218, the adjusting of active mounts may be synchronized with the actuation of the valvetrain solenoids, e.g. S2 and S3. Therefore, in one example, active mounts may provide a first input function when solenoid S2 is triggered to activate cylinder 3. The active mounts may be actuated to provide a second input function when solenoid S3 is triggered to activate cylinder 4.

In this way, engine operation may be transitioned from a two-cylinder VDE mode to a non-VDE mode. A different sequence of transition events may be utilized based on whether the engine includes a common solenoid for cylinders 3 and 4, or not.

Thus, a method may comprise operating an engine with only four cylinders in a two-cylinder mode by firing a first cylinder and a second cylinder 360 crank angle degrees apart, transitioning engine operation to four-cylinder mode by activating a third cylinder and a fourth cylinder, firing the third cylinder 120 crank angle degrees after firing the first cylinder, and firing the fourth cylinder 240 crank angle degrees after firing the second cylinder, and actuating one or more active mounts in response to the transitioning. Further, the second cylinder may be fired 240 crank angle degrees after firing the third cylinder, and the first cylinder may be fired 120 crank angle degrees after firing the fourth cylinder. Further still, the third cylinder and the fourth cylinder may be controlled by separate solenoids, and the third cylinder and the fourth cylinder may be activated sequentially, the third cylinder activated before the fourth cylinder. An audio system may be adjusted to either selectively add or cancel noise in a vehicle cabin responsive to the transitioning. In addition, one or more active mounts may be actuated to provide an input function specific to the above transition sequence.

Another example method may include transitioning engine operation from two-cylinder mode to four-cylinder mode by activating the third cylinder and the fourth cylinder simultaneously after a firing event in the first cylinder. The method may further comprise firing the second cylinder 360 crank angle degrees after the firing event in the first cylinder, firing the fourth cylinder 240 crank angle degrees after firing the second cylinder, firing the first cylinder 120 crank angle degrees after firing the fourth cylinder, and firing the third cylinder 120 crank angle degrees after firing the first cylinder. As such, active mounts may be actuated in response to the transition sequence. Furthermore, the audio system may be adjusted to either selectively add or cancel noise in a vehicle cabin responsive to the transitioning.

Figure 23:
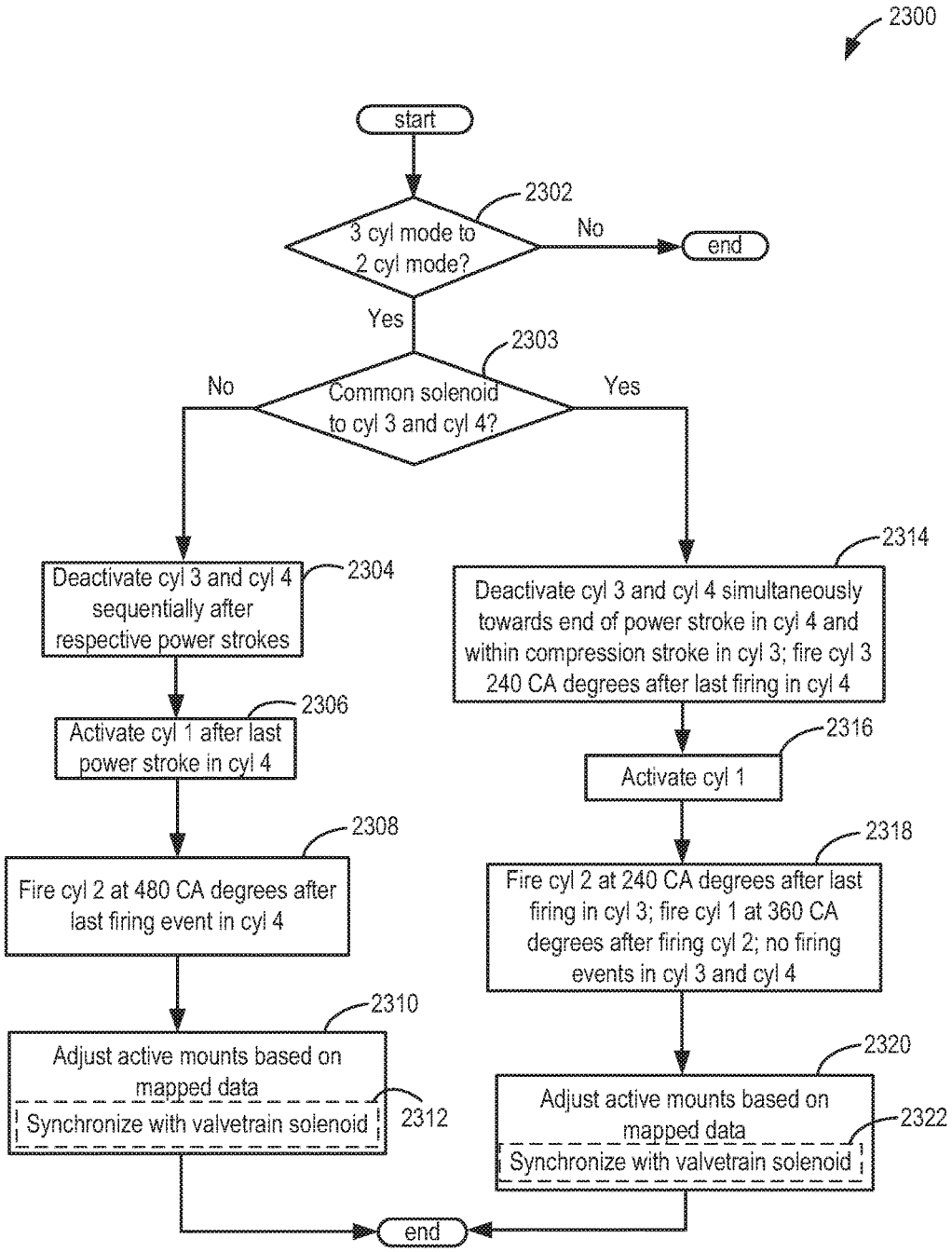
FIG. 23 shows an example flowchart depicting a transition in engine operation from three-cylinder mode to two-cylinder mode.

FIG. 23 illustrates routine 2300 for transitioning engine operation from a three-cylinder mode to a two-cylinder mode. Specifically, transition sequences including activation and/or deactivation and firing events in various cylinders is described. Transition sequences may be based on the presence of either a common solenoid or separate solenoids to actuate intake and exhaust valves in cylinders 3 and 4.

At 2302, routine 2300 may confirm that the impending transition in engine operation is from a three-cylinder mode to a two-cylinder mode. If not, routine 2300 ends. Else, routine 2300 progresses to 2303 to determine if the existing engine embodiment includes a common, single solenoid for cylinders 3 and 4. If yes, routine 2300 continues to 2314 to deactivate cylinders 3 and 4 simultaneously. Deactivation of cylinders 3 and 4 may include actuating their intake and exhaust valves via their respective second null cams. Further, fuel injection into these cylinders may be disabled. The timing of deactivation may be such that cylinder 4 is deactivated towards the end of a power stroke ensuing after a firing event in cylinder 4. Cylinder 3 may be deactivated in a latter half of its compression stroke. Further, cylinder 3 may experience a combustion event after deactivation and immediately after the completion of its compression stroke. The combustion event may occur since contents of cylinder 3 may include fresh fuel (injected during the intake stroke) and air, as explained earlier in reference to FIG. 11. Further still, the combustion event in cylinder 3 may occur 240 CA degrees after the last firing event in cylinder 4.

Next, at 2316, cylinder 1 may be activated by switching intake and exhaust actuating cams from second, null cams to first intake and first exhaust cams. Further, fuel injection may also be enabled. As mentioned in the description of FIG. 11, cylinder 1 may be activated towards the end of its power stroke (no combustion event may precede the power stroke during deactivation).

At 2318, cylinder 2 may be fired 240 CA degrees after the combustion event in cylinder 3 and cylinder 1 may be combusted at 360 CA degrees after firing cylinder 2. Since cylinders 3 and 4 are deactivated, no firing events may occur in these two cylinders and two-cylinder operation mode may now be established in the engine.

It will be appreciated that the above sequence may be possible even when cylinders 3 and 4 are controlled by separate solenoids, as in the example embodiment of FIG. 2*b*.

Active mounts coupled to the engine may be adjusted at 2320 based on learned and mapped data for the transition from three-cylinder mode to two-cylinder mode. As explained earlier in reference to FIGS. 21 and 22, active mounts may be triggered with different inputs learned from previously mapped data to respond to and counter specific vibration frequencies arising during different transitions. In this example transition, active mounts may be actuated by signals learned on-bench for the sequence of firing events described above wherein cylinders 3 and 4 are controlled by a common solenoid. Further, at 2322, signals to the active mounts may be synchronized with signals to the single, common solenoid (e.g. S2 in FIG. 2*a*) operatively coupled to actuating systems in cylinders 3 and 4.

Thus, an example method for transitioning from the three-cylinder mode to the two-cylinder mode may include deactivating the fourth cylinder and the third cylinder simultaneously, activating the first cylinder, and firing the first cylinder 360 crank angle degrees after a firing event in the second cylinder.

Returning to 2303, if the existing engine embodiment is determined to not include a common, single solenoid for cylinders 3 and 4, routine 2300 progresses to 2304 where cylinder 3 and cylinder 4 may be deactivated sequentially. Herein, the engine embodiment may include distinct and separate solenoids, e.g. S2 and S3 of optional engine embodiment FIG. 2*b*, for controlling intake and exhaust valves in cylinders 3 and 4. Specifically, cylinder 3 may be deactivated before cylinder 4 and each of cylinder 3 and cylinder 4 may be deactivated towards the end of their respective power strokes, as described earlier in reference to FIG. 12. It will be noted that each cylinder may be deactivated after a respective combustion event.

Next, at 2306, cylinder 1 may be activated after the deactivation of cylinder 4. At 2308, cylinder 2 may be fired 480 CA degrees after the last firing event in cylinder 4. Cylinder 1 may be fired 360 CA degrees after firing cylinder 2, and the two-cylinder mode may continue thereon. It will be appreciated that during the transition sequence described above and in reference to FIG. 12, the engine has no firing event between the last firing event in cylinder 4 and the subsequent firing event in cylinder 2. With this transition sequence, the engine may experience NVH issues due to the larger interval of 480 CA degrees and skipped combustion events.

At 2310, active mounts coupled to the engine may be actuated based on mapped data in the controller for a transition from three-cylinder mode to two-cylinder mode with separate solenoids. Specifically, at 2312, the adjusting of active mounts may be synchronized with the actuation of the valvetrain solenoids, e.g. S2 and S3. Therefore, in one example, active mounts may provide a first input function when solenoid S2 is triggered to deactivate cylinder 3. The active mounts may be actuated to provide a second input function when solenoid S3 is triggered to deactivate cylinder 4. Further, a third input function may be provided by the active mounts when solenoid S1 is triggered to activate cylinder 1. Additionally, the active mounts may be configured to simulate reaction forces as though a firing event may have occurred. To elaborate, active mounts may also be triggered to counter vibrations resulting from skipped firing events during the longer interval of 480 CA degrees between successive firing events in cylinder 4 and cylinder 2 described above. Actuating the active mounts may deliver a "tactile perception" of skipped firing events.

In addition to actuating the active mounts, the controller may also provide an appropriate audible experience to attain a complete simulation of a firing event. In one example, active noise cancellation (ANC) may be used to selectively add and cancel noise in the cabin to give an audible perception as desired. ANC may include a network of sensors that perceive cabin noise and in response to perceived cabin noise, an audio system may be activated. In one example, the audio system may be commanded to direct the speakers to reduce cabin pressure to selectively cancel noise. In another example, the audio system may be directed to add to cabin pressure for creating noise. Speaker motion within the audio system may be coordinated to match phase, amplitude, and frequency as required for either a noise cancellation or auditory generation effect. As an overall result, the noise produced by a given frequency of engine firing operation may be cancelled and auditory events that correspond to the desired order may be generated instead.

Figure 24:
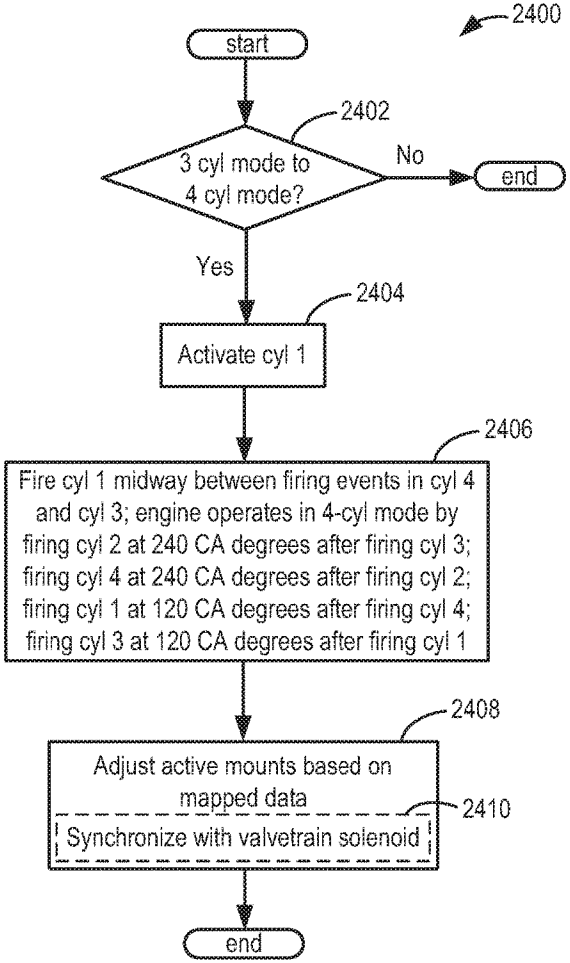
FIG. 24 illustrates an example flowchart showing a transition in engine operation from three-cylinder mode to full-cylinder mode.

FIG. 24 depicts routine 2400 for transitioning engine operation from three-cylinder mode to non-VDE or four-cylinder mode. Specifically, cylinder 1 may be activated to provide engine operation in non-VDE mode. Further, the transition sequence may be the same for the engine embodiment including a common solenoid for cylinders 3 and 4 and for the engine embodiment comprising separate solenoids for cylinders 3 and 4.

At 2402, routine 2400 may confirm that engine operation is to be transitioned from three-cylinder mode to four-cylinder mode. If not, routine 2400 ends. Else, at 2404, cylinder 1 may be activated towards the end of its power stroke (no combustion in cylinder 1 preceding activation). The sequence described herein was elaborated earlier in reference to FIG. 16. Activation, as described earlier, includes actuating intake and exhaust valves of cylinder 1 via their respective first intake and first exhaust cams. Fuel injection may also be enabled at activation.

Next, at 2406, cylinder 1 may be combusted midway between firing events in cylinder 4 and cylinder 3. Hereafter, the engine may operate in four-cylinder mode wherein cylinder 2 may be fired at 240 CA degrees after firing cylinder 3. Cylinder 2 may be fired after activating cylinder 1. Cylinder 4 may be fired 240 CA degrees after firing cylinder 2 and cylinder 1 may be fired at 120 CA degrees after firing cylinder 4. Finally, cylinder 3 may be combusted 120 CA degrees after firing cylinder 1.

At 2408, active mounts coupled to the engine may be adjusted to accommodate and counter specific vibrational changes arising out of the transition. The adjustments may be made according to learned and mapped data. Further, at 2410, the adjustment triggers sent to the active mounts may be synchronized with actuating the solenoid operatively coupled to cylinder 1. For example, active mounts may be triggered when cams are switched during the activation of cylinder 1.

Thus, an example method may comprise transitioning from three-cylinder mode of operation to four-cylinder mode of operation by activating the first cylinder and firing the first cylinder midway between firing events in the fourth cylinder and the third cylinder.

Figure 25:
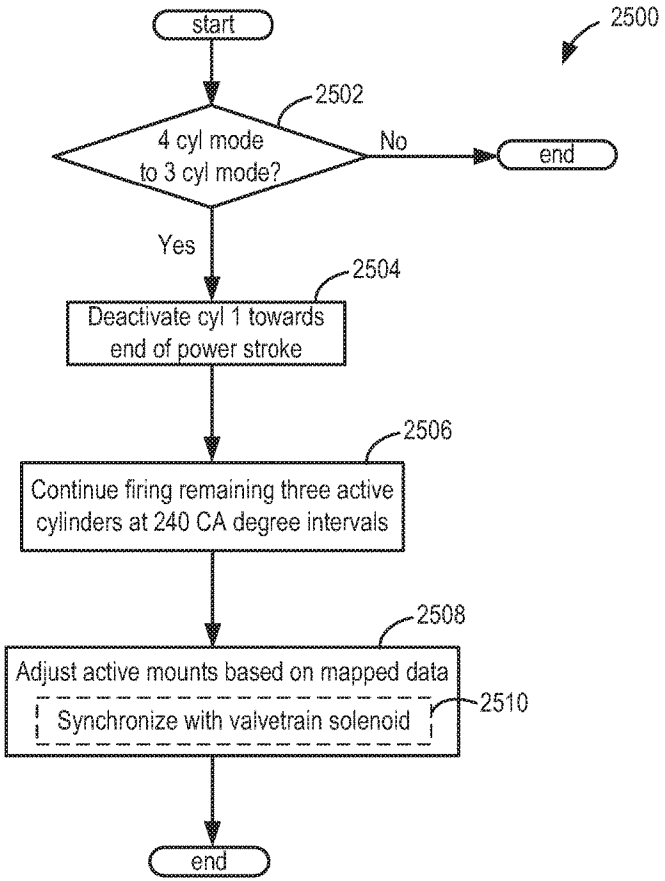
FIG. 25 portrays an example flowchart for shifting engine operation from full-cylinder to three-cylinder mode.

FIG. 25 portrays routine 2500 for transitioning engine operation from four-cylinder mode to three-cylinder mode. Specifically, cylinder 1 may be deactivated to transition engine operation to three-cylinder mode. Further, the transition sequence may be the same for the engine embodiment including a common solenoid for cylinders 3 and 4 and for the engine embodiment comprising separate solenoids for cylinders 3 and 4.

At 2502, routine 2500 may determine if engine operation is transitioning from non-VDE mode to three-cylinder mode. If not, routine 2500 ends. If the transition is confirmed to be from non-VDE mode to three-cylinder mode, routine 2500 continues to 2504 to deactivate cylinder 1 towards the end of its power stroke that follows a combustion event in cylinder 1. Deactivation of cylinder 1 may include disabling fuel injection and actuating intake and exhaust valves via their respective second intake and second exhaust null cams.

At 2506, the remaining three activated cylinders may continue to be combusted in three-cylinder mode at 240 CA degree intervals from each other. Next, at 2508, input function of active mounts may be adjusted to counter vibrations arising out of the above transition. At 2510, the adjustment may be triggered in time with signals sent to the solenoid coupled to actuator systems in cylinder 1. Therefore, active mount adjustments may be synchronized with valvetrain and/or cam profile switching solenoids. The above transition sequence was elaborated earlier in reference to FIG. 15.

Figure 26:
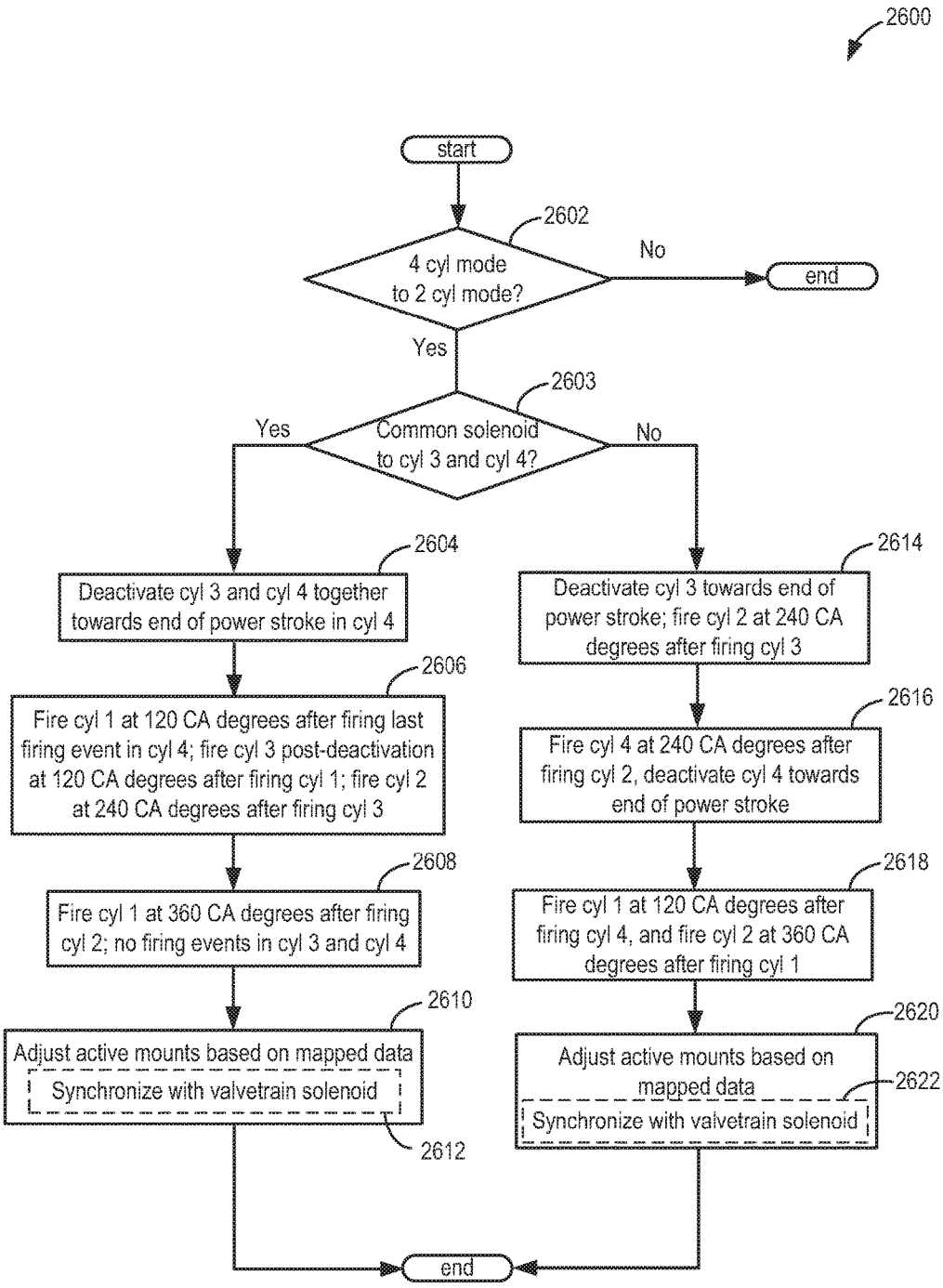
FIG. 26 depicts an example flowchart illustrating a transition in engine operation from full-cylinder to two-cylinder mode.

Turning now to FIG. 26, it illustrates routine 2600 for transitioning engine operation from a four-cylinder mode to a two-cylinder mode. Specifically, transition sequences including activation and/or deactivation and firing events in various cylinders is described. Transition sequences may be based on the presence of either a common solenoid or separate solenoids to actuate intake and exhaust valves in cylinders 3 and 4.

At 2602, routine 2600 may confirm that the impending transition in engine operation is from a four-cylinder mode to a two-cylinder mode. If not, routine 2600 ends. Else, routine 2600 progresses to 2603 to determine if the existing engine embodiment includes a common, single solenoid for cylinders 3 and 4. If yes, routine 2600 continues to 2604 to deactivate cylinders 3 and 4 simultaneously. Deactivation of cylinders 3 and 4 may include actuating their intake and exhaust valves via their respective second null cams. Further, fuel injection into these cylinders may also be disabled. As described earlier in reference to FIG. 14, cylinder 4 may be deactivated towards the end of its power stroke while cylinder 3 is deactivated in a latter half of its compression stroke. It should be noted that cylinder 4 is deactivated after a combustion event within cylinder 4.

Next, at 2606, cylinder 1 may be fired at 120 CA degrees after the last combustion event in cylinder 4 (prior to its deactivation). Cylinder 3 may undergo a combustion event post-deactivation at 120 CA degrees after firing cylinder 1. Since cylinder 3 is deactivated during its compression stroke, air charge within cylinder 3 may include fresh fuel injected during the intake stroke. Therefore, a spark provided to cylinder 3 after the completion of its compression stroke and after deactivation can initiate a combustion event in cylinder 3. Further, cylinder 2 may be fired at 240 CA degrees after the post-deactivation combustion event in cylinder 3. At 2208, cylinder 1 may be fired at 360 degrees after firing cylinder 2. Since cylinder 4 is deactivated, there is no firing event between firing events in cylinder 2 and cylinder 1. Thus, two-cylinder mode may be established with cylinders 1 and 2 firing at even intervals of 360 CA degrees from each other.

It will be appreciated that the above sequence may be possible even when cylinders 3 and 4 are controlled by separate solenoids, as in the example embodiment of FIG. 2*b*.

At 2610, active mounts coupled to the engine may be adjusted based on mapped data. For example, the transition from full-cylinder mode to two-cylinder mode with the given sequence of deactivating cylinder 3 and cylinder 4 may generate specific vibration frequencies in the engine that may be transferred to the active mounts. Consequently, active mounts may be triggered with individual inputs learned from previously mapped data to respond to and counter these specific vibration frequencies. Further, at 2612, signals to the active mounts may be synchronized with signals to the single, common solenoid (e.g. S2 in FIG. 2*a*) operatively coupled to actuating systems in cylinders 3 and 4.

Thus, an example method for transitioning from the four-cylinder mode to the two-cylinder mode may comprise deactivating the third cylinder and the fourth cylinder simultaneously, and firing the first cylinder and the second cylinder at even intervals of 360 crank angle degrees.

Returning to 2603, if the existing engine embodiment is determined to not include a common, single solenoid for cylinders 3 and 4, routine 2600 continues to 2614 where cylinder 3 may be deactivated towards the end of its power stroke following a combustion event in cylinder 3. Further, cylinder 2 may be fired at 240 CA degree intervals after the combustion event (last) in cylinder 3. At 2616, cylinder 4 may be fired at 240 CA degrees after firing cylinder 2 and may then be deactivated towards the end of its power stroke following the firing event within cylinder 4. As will be noted, the engine embodiment being described includes distinct and separate solenoids, e.g. solenoids S2 and S3 of optional engine embodiment FIG. 2*b*, for controlling intake and exhaust valves in cylinders 3 and 4. Specifically, cylinder 3 may be deactivated before cylinder 4, as described earlier in reference to FIG. 13.

Next, at 2618, cylinder 1 may be fired at 120 CA degrees after the last firing in cylinder 4, and cylinder 2 may be fired at 360 CA degrees after firing cylinder 1. Thus, a two-cylinder mode may be achieved.

At 2620, active mounts coupled to the engine may be actuated based on mapped data in the controller for a transition from four-cylinder mode to two-cylinder mode with separate solenoids. Specifically, at 2622, the adjusting of active mounts may be synchronized with the actuation of the valvetrain solenoids, e.g. S2 and S3. Therefore, in one example, active mounts may provide a first input function when solenoid S2 is triggered to deactivate cylinder 3. The active mounts may be actuated to provide a second input function when solenoid S3 is triggered to deactivate cylinder 4.

In this way, engine operation may be transitioned from a non-VDE mode to a two-cylinder VDE mode. A different sequence of transition events may be utilized based on if the engine includes a common solenoid for cylinders 3 and 4.

As described in the example flow charts and engine timing diagrams above, a method for transitioning an engine with only four cylinders between two-cylinder, three-cylinder, and four-cylinder modes of operation may include a sequence of firing events, the sequence including at least two successive firing events separated by at least 120 crank angle degrees. Further, the method may include adjusting one or more active mounts coupled to the engine in response to the transitioning. The adjusting of the one or more active mounts may include providing a different input function during each transition between modes of operation of the engine. Further still, the one or more active mounts may be adjusted based on a triggering of a valvetrain switching solenoid during each transition. An audio system may also be adjusted to either selectively add or cancel noise in a vehicle cabin responsive to the transitioning.

Thus, an example system may comprise a vehicle, an engine including four cylinders arranged inline wherein a first cylinder, a third cylinder, and a fourth cylinder are deactivatable, the engine mounted on a chassis of the vehicle supported by at least one active mount, the at least one active mount being synchronized with a valvetrain switching solenoid. The system may also include a controller configured with computer readable instructions stored on non-transitory memory for during a first condition, transitioning from two-cylinder mode of operation to three cylinder mode of operation by activating the third cylinder and the fourth cylinder, deactivating the first cylinder, firing the fourth cylinder 240 crank angle degrees after a firing event in a second non-deactivatable cylinder, and firing the third cylinder 240 crank angle degrees after firing the fourth cylinder. Herein, the first condition may include an increase in engine load from a lower load to a medium load. The controller may also be configured for, during a second condition, transitioning from two-cylinder mode of operation to full-cylinder mode of operation by activating the third cylinder and the fourth cylinder at different times, firing the third cylinder 120 crank angle degrees after firing the first cylinder, firing the second cylinder 240 crank angle degrees after firing the third cylinder, firing the fourth cylinder 240 crank angle degrees after firing the second cylinder, and firing the first cylinder 120 crank angle degrees after the fourth cylinder. Herein, the second condition may include an increase in engine load from a lower load to a higher load. The controller may also be configured for, during a third condition, transitioning from three-cylinder mode of operation to four-cylinder mode of operation by activating the first cylinder and firing the first cylinder midway between the fourth cylinder and the third cylinder. Herein, the third condition may include an increase in engine load from a medium load to a higher load. The controller may include further instructions for adjusting the at least one active mount to provide a different response during each of the first, second, and third conditions.

In this way, a four-cylinder engine can be smoothly transitioned between two-cylinder VDE mode, three-cylinder VDE mode, and full-cylinder mode. By timing activation and/or deactivation of specific cylinders as well as firing events in a desired sequence, NVH issues may be reduced. Further, active mounts coupled to the engine may be triggered to counter vibration frequencies specific to different transitions. By using mapped data to provide adjustments to active mounts during transitions, a simpler control method can be applied to the active mounts. In addition to actuating active mounts, an audio system may also be enabled to further diminish transmission of noise to a vehicle cabin during transitions. Thus, passenger comfort and experience may be enhanced. Overall, drivability and engine operation can be improved.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising transitioning an engine with only four cylinders between two-cylinder, three-cylinder, and four-cylinder modes of operation, the transitioning including a sequence of at least two firing events, wherein the at least two firing events are successive and are separated by crank angle degrees dependent on the mode of operation and may occur over a range of degrees with a minimum of 120 degrees, wherein the engine operates with uneven firing intervals in the four-cylinder mode, the uneven firing intervals including four successive firing events of a cycle with two successive firing events having a 120 crank angle degrees firing interval, and another two successive firing events of the cycle having a 240 crank angle degrees firing interval.

2. The method of claim 1, wherein the engine operates with even firing intervals in the two-cylinder and three-cylinder modes.

3. The method of claim 2, wherein the firing interval in the two-cylinder mode is 360 crank angle degrees, and wherein the firing interval in the three-cylinder mode is 240 crank angle degrees.

4. The method of claim 3, wherein only a first cylinder and a second cylinder are activated and firing during the two-cylinder mode.

5. The method of claim 4, wherein the first cylinder is deactivated and only the second cylinder, a third cylinder and a fourth cylinder are activated and firing during the three-cylinder mode.

6. The method of claim 5, wherein during the four-cylinder mode, all cylinders are activated and the first cylinder is fired 120 crank angle degrees after a firing event in the fourth cylinder, the third cylinder is fired 120 crank angle degrees after firing the first cylinder, the second cylinder is fired 240 crank angle degrees after firing the third cylinder, and the fourth cylinder is fired 240 crank angle degrees after firing the second cylinder.

7. The method of claim 6, wherein transitioning from the two-cylinder mode to the three-cylinder mode includes activating the third cylinder and the fourth cylinder simultaneously after a firing event in the first cylinder, deactivating the first cylinder after the firing event, firing the second cylinder 360 crank angle degrees after the firing event in the first cylinder, and firing the fourth cylinder 240 crank angle degrees after firing the second cylinder.

8. The method of claim 7, wherein transitioning from the three-cylinder mode to the two-cylinder mode includes deactivating the fourth cylinder and the third cylinder simultaneously, activating the first cylinder, and firing the first cylinder 360 crank angle degrees after a firing event in the second cylinder.

9. The method of claim 8, wherein transitioning from the two-cylinder mode to the four-cylinder mode includes activating the third cylinder and the fourth cylinder sequentially, fueling and firing the third cylinder 120 crank angle degrees after the firing event in the first cylinder, and fueling and firing the fourth cylinder 240 crank angle degrees after the firing event in the second cylinder.

10. The method of claim 9, wherein transitioning from the four-cylinder mode to the two-cylinder mode includes deactivating the third cylinder and the fourth cylinder sequentially after respective firing events, and firing the second cylinder and the first cylinder at 360 crank angle degree intervals.

11. A method comprising transitioning an engine with only four cylinders between two-cylinder, three-cylinder, and four-cylinder modes of operation, wherein the engine operates with uneven firing intervals in the four-cylinder mode, the transitioning including a sequence of at least two firing events, wherein the at least two firing events are successive and are separated by at least 120 crank angle degrees, adjusting a plurality of active mounts coupled to the engine and a chassis to provide a different input function during each transition in modes of operation of the engine.

12. The method of claim 11, wherein the plurality of active mounts is adjusted based on a triggering of a valve-train switching solenoid.

* * * * *